US007354123B2

(12) United States Patent
Otsuki

(10) Patent No.: US 7,354,123 B2
(45) Date of Patent: Apr. 8, 2008

(54) PRINTING METHOD AND PRINTING APPARATUS

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 381 days.

(21) Appl. No.: 10/859,599

(22) Filed: Jun. 3, 2004

(65) Prior Publication Data

US 2005/0024406 A1 Feb. 3, 2005

(30) Foreign Application Priority Data

| | | |
|---|---|---|
| Jun. 4, 2003 | (JP) | 2003-159360 |
| Feb. 20, 2004 | (JP) | 2004-044642 |
| Apr. 13, 2004 | (JP) | 2004-117880 |
| Jun. 2, 2004 | (JP) | 2004-164258 |
| Jun. 2, 2004 | (JP) | 2004-164259 |
| Jun. 2, 2004 | (JP) | 2004-164260 |

(51) Int. Cl.
*B41J 29/38* (2006.01)

(52) U.S. Cl. ..... 347/5; 347/9; 347/19

(58) Field of Classification Search ..... 347/5, 347/9, 23, 40, 19, 14, 15; 358/1.15, 1.18
See application file for complete search history.

(56) References Cited

U.S. PATENT DOCUMENTS

| | | | | |
|---|---|---|---|---|
| 6,089,695 | A * | 7/2000 | Takagi et al. | 347/40 |
| 6,456,391 | B1 * | 9/2002 | Miyamoto et al. | 358/1.18 |
| 2004/0145770 | A1 * | 7/2004 | Nakano et al. | 358/1.15 |

FOREIGN PATENT DOCUMENTS

| | | | |
|---|---|---|---|
| JP | 6-139401 | A | 5/1994 |
| JP | 11-192763 | A | 7/1999 |
| JP | 2002-283643 | A | 10/2002 |
| JP | 2002-314809 | A | 10/2002 |
| JP | 2002-344881 | A | 11/2002 |

* cited by examiner

*Primary Examiner*—Lam Son Nguyen
(74) *Attorney, Agent, or Firm*—Sughrue Mion, PLLC

(57) ABSTRACT

A printing method of the present invention includes the steps of: carrying a medium and ejecting ink from a print head to print, on the medium, a mark that can be filled in by a user; detecting, with a sensor, whether or not the mark has been filled in; and performing a process in accordance with a result of the detection by the sensor. With this printing method, operations with respect to a printing apparatus can be performed with ease.

25 Claims, 65 Drawing Sheets

| | |
|---|---|
| 0 | 0000000 |
| 1 | 0010010 |
| 2 | 1011101 |
| 3 | 1011011 |
| 4 | 0111010 |
| 5 | 1101011 |
| 6 | 1101111 |
| 7 | 1010010 |
| 8 | 1111111 |
| 9 | 1111011 |

1073

PRINTING METHOD AND PRINTING APPARATUS

CROSS-REFERENCE TO RELATED APPLICATIONS

The present application claims priority upon Japanese Patent Application No. 2003-159360 filed on Jun. 4, 2003, Japanese Patent Application No. 2004-044642 filed on Feb. 20, 2004, Japanese Patent Application No. 2004-117880 filed on Apr. 13, 2004, Japanese Patent Application No. 2004-164258 filed on Jun. 2, 2004, Japanese Patent Application No. 2004-164259 filed on Jun. 2, 2004, and Japanese Patent Application No. 2004-164260 filed on Jun. 2, 2004, which are herein incorporated by reference.

BACKGROUND OF THE INVENTION

1. Field of the Invention

The present invention relates to printing methods and printing apparatuses.

2. Description of the Related Art

The spread of digital cameras in recent years has resulted in a heightened demand for printing apparatuses with which captured images can be freely printed at home. Conversely, when printing images that have been captured with a digital camera using a printing apparatus, it is necessary to specify the image(s) to be printed and to set the type of print paper, the size, and the picture quality, etc.

However, this task of setting is a burden for users not accustomed to apparatus controls, and it can be arduous even for users who are familiar with the controls.

Accordingly, the inventors of the present application have already proposed an invention for printing, on a print paper, a group of images that are candidates for printing as index images and then referencing these index images when carrying out printing (see JP 2002-283643A (abstract)).

In the above invention, the user operates an input device of a computer that is connected to the printing apparatus or a control panel furnished on the printing apparatus while referencing the index images. However, there is the problem that operations made through the control panel of the printing apparatus are burdensome, and operation mistakes occur easily.

SUMMARY OF THE INVENTION

Accordingly, it is an object of the present invention to allow operations with respect to a printing apparatus to be carried out with ease.

A printing method of the present invention for achieving the foregoing objects comprises the steps of: carrying a medium and ejecting ink from a print head to print, on the medium, a mark that can be filled in by a user; detecting, with a sensor, whether or not the mark has been filled in; and performing a process in accordance with a result of the detection by the sensor.

Features and objects of the present invention other than the above will become clear by reading the description of the present specification with reference to the accompanying drawings.

BRIEF DESCRIPTION OF THE DRAWINGS

FIG. 7 is a diagram showing an example of a case in which check boxes of the mark sheet shown in FIG. 6 have been filled in.

FIG. 10B is an explanatory diagram of an example in which check boxes have been filled in.

Figure 1:
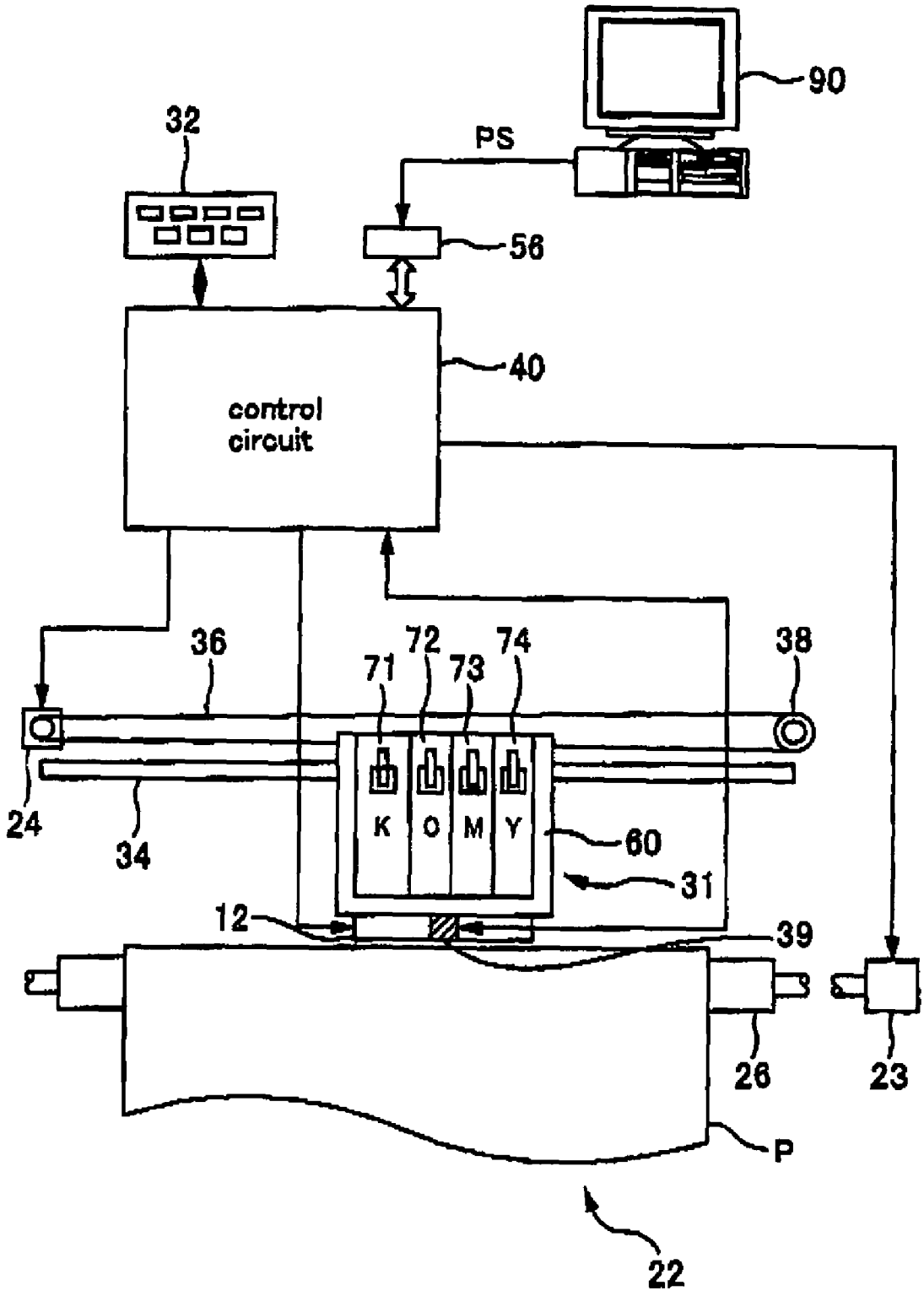
FIG. 1 is a diagram schematically showing the configuration of the primary components of a printing apparatus according to an embodiment of the present invention.

In order to facilitate a more complete understanding of the present invention and the advantages thereof, reference is now made to the following description taken in conjunction with the accompanying drawings.

DESCRIPTION OF PREFERRED EMBODIMENTS

Overview of the Disclosure

A printing method according to the present embodiment comprises the steps of:

carrying a medium and ejecting ink from a print head to print, on the medium, a mark that can be filled in by a user;

detecting, with a sensor, whether or not the mark has been filled in; and performing a process in accordance with a result of the detection by the sensor.

According to this printing method, a printing apparatus can be operated with ease.

In the foregoing printing method it is preferable that the sensor moves together with the print head. Thus, the marks can be detected using a sensor that moves together with the print head, thereby allowing the marks to be detected with an inexpensive sensor.

In the foregoing printing method it is preferable that data indicating the position of the mark is read from a memory; and that based on the data, the sensor detects whether or not the mark has been filled in. Thus, it is possible to detect specific positions only, thereby allowing the detection time to be shortened.

In the foregoing printing method it is preferable that the print head prints a position-adjustment mark on the medium; that the sensor detects the position-adjustment mark; and that the sensor detects whether or not the mark has been filled in at a position corresponding to a result of this detection. Thus, the marks can be detected accurately even if the sheet is misaligned when the marks are detected.

In the foregoing printing method it is preferable that a list of a plurality of images and a plurality of the marks respectively corresponding to the images are printed on the medium; and that an image to be printed is determined according to a result of detecting the mark with the sensor. Thus, the operation of determining which images to print can be carried out with ease.

In the foregoing printing method it is preferable that a print signal is created in accordance with the result of the detection; and that an image is formed on the medium in accordance with the print signal. Thus, instructions for creating print signals can be made with ease.

In the foregoing printing method it is preferable that the print signal is created after adjusting at least one of brightness, color saturation, and contrast in accordance with the result of the detection. Thus, the operation of adjusting to a desired brightness etc. can be carried out with ease.

In the foregoing printing method it is preferable that the print signal is created after adjusting a dot recording ratio in accordance with the result of the detection. Thus, the operation of adjusting to a dot recording ratio at which banding does not occur can be carried out with ease.

In the foregoing printing method it is preferable that adjustment of a printing mechanism for carrying the medium and ejecting ink from the print head is performed in accordance with the result of the detection. Thus, the operation of adjusting the printing mechanism can be carried out with ease.

In the foregoing printing method it is preferable that an ink ejection timing when ink is ejected during back and forth movement of the print head is adjusted in accordance with the result of the detection. Thus, the operation of Bi-D adjustment can be performed with ease.

In the foregoing printing method it is preferable that at least one of a carrying operation of carrying the medium and an ink ejection operation of ejecting ink from the print head is adjusted in accordance with the result of the detection by the sensor. Thus, the operation of adjusting the operations of the printing mechanism can be carried out with ease.

In the foregoing printing method it is preferable that the ink ejection operation is an operation for ejecting the ink from the print head that moves back and forth; and that an ink ejection timing for a return pass with respect to an ink ejection timing for a forward pass is adjusted in accordance with the result of the detection by the sensor. Thus, so-called Bi-D adjustment (adjustment of the ejection timing of the ink) can be carried out with ease.

In the foregoing printing method it is preferable that a carry amount of the carrying mechanism is adjusted in accordance with the result of the detection by the sensor. Thus, so-called PF adjustment (adjustment of the carry amount carried by the carrying mechanism) can be carried out with ease.

In the foregoing printing method it is preferable that a plurality of patterns are printed on the medium, each of the patterns having a different adjustment amount by which the carrying operation or the ink ejection operation is adjusted; and that when the sensor detects that the marks corresponding to two patterns, from among the plurality of patterns, have been filled in, the carrying operation or the ink ejection operation is adjusted by an adjustment amount that is between the two adjustment amounts corresponding to the two patterns. Thus, adjustment can be carried out properly even when the user cannot narrow down to a single pattern from among the plurality of patterns.

In the foregoing printing method it is preferable that a confirmation mark is printed on the medium; and that when the sensor detects that the confirmation mark has been filled in, the mark that can be filled in by the user is again printed on the medium in accordance with the operation that has been adjusted. Thus, actual printing can be performed after reconfirming whether or not suitable patterns are printed after adjustment, and this reduces printing mistakes.

In the foregoing printing method it is preferable that the print head is provided with a plurality of nozzles; and that clogging of the nozzles is adjusted in accordance with the result of the detection by the sensor. Thus, adjustment of clogging of the nozzles can be carried out with ease.

In the foregoing printing method it is preferable that a list of images to be printed and marks for selecting the images are printed on the medium, and a mark for determining whether or not it is necessary to adjust the operation is printed on the medium; that when the sensor detects the marks for selecting the images, the sensor detects the mark for determining whether or not it is necessary to adjust the operation; and that if it is determined that adjustment of the operation is necessary based on the result of the detection by the sensor, then the mark for adjusting the operation is printed on the medium. Thus, when the user has determined that adjustment is necessary, adjustment can be performed with ease before actual printing of an image.

In the foregoing printing method it is preferable that the sensor detects the mark for determining whether or not it is necessary to adjust the operation before detecting the marks for selecting the images. Thus, the printing mechanism can be adjusted quickly.

In the foregoing printing method it is preferable that a print signal is created based on the result of the detection by the sensor; and that an image is printed on the medium in accordance with the print signal. Thus, the printing apparatus can be operated with ease.

In the foregoing printing method it is preferable that the mark is a mark for setting print properties; and that based on the result of the detection by the sensor, the print signal is created in correspondence with the print properties that have been set. Thus, the print properties can be set with ease.

In the foregoing printing method it is preferable that the mark is a mark for adjusting at least one of color saturation, brightness, and contrast; and that the print signal is created after adjusting at least one of color saturation, brightness, and contrast based on the result of the detection by the sensor. Thus, the color saturation etc. can be adjusted with ease.

In the foregoing printing method it is preferable that the mark is a mark for selecting monochrome, sepia, or others; and that the print-signal is created based on the result of the detection by the sensor. Thus, the selection of adjustments such as monochrome can be made with ease.

In the foregoing printing method it is preferable that the mark is a mark for selecting an adjustment standard; and that the print signal corresponding to the adjustment standard is created based on the result of the detection by the sensor. Thus, the adjustment standard can be selected with ease.

In the foregoing printing method it is preferable that the mark is a mark for selecting a sharpness; and that the print signal is created based on the result of the detection by the sensor. Thus, contours within the printed image can be adjusted with ease.

In the foregoing printing method it is preferable that the mark is a mark for selecting an image-capturing condition; and that the print signal corresponding to the image-capturing condition is created based on the result of the detection by the sensor. Thus, the image-capturing conditions can be selected with ease.

In the foregoing printing method it is preferable that a confirmation mark is printed together with the mark for setting print properties; and that when the sensor detects that the confirmation mark has been filled in, the mark for setting print properties is again printed on the medium at the print properties that have been set. Thus, actual printing can be performed after reconfirming whether or not suitable patterns are printed after adjustment, and this reduces printing mistakes.

Another printing method according to the present implementation comprises the steps of: carrying a medium and ejecting ink from a print head to print, on the medium, a mark that can be filled in by a user; detecting, with a sensor that moves together with the print head, whether or not the mark has been filled in; and performing a process in accordance with a result of the detection by the sensor.

This printing method allows a printing apparatus to be operated with ease.

Further, a printing apparatus according to the present embodiment comprises: a printing mechanism that is provided with a carrying mechanism for carrying a medium and a print head for ejecting ink, and that is for printing an image on the medium; a sensor for detecting the image that has been printed on the medium; and a controller for causing a mark that can be filled in by a user to be printed on the medium, causing the sensor to detect whether or not the mark has been filled in, and performing a process in accordance with a result of the detection by the sensor.

Such a printing apparatus allows operations to be performed with ease.

A printing apparatus having an optical sensor in the print head comprises draw-up means for drawing (feeding) into the printing apparatus a mark sheet to which predetermined information has been written with a writing instrument, reading means for reading the information that has been written with the writing instrument to the mark sheet drawn in by the draw-up means using the optical sensor furnished in the print head, and processing means for executing processing corresponding to the information that is read by the reading means.

Thus, various types of settings can be performed easily and quickly.

Also, the foregoing configuration further comprises mark sheet creation means for creating a mark sheet by printing predetermined information on a print medium. Thus, a mark sheet that corresponds to the content of the process to be executed by the processing means can be created as necessary.

Also, the foregoing configuration further comprises storage means storing information indicating the positions on the mark sheet where information has been written, and the reading means reads the information written to the mark sheet by moving the print head having the optical sensor to positions corresponding to the information stored on the storage means. Thus, the mark sheet can be read using the optical sensor that is used for paper end detection, for example, and thus it is not necessary to provide a new optical sensor, allowing the manufacturing costs of the apparatus to be reduced.

Also, in the foregoing configuration, a list of the images to be printed and check boxes corresponding to each image are printed on the mark sheet, and the processing means executes processing for printing images corresponding to check boxes that have been checked in using a writing instrument. Thus, by referring to a list of printed images and checking in check boxes that correspond to images to be printed using a writing instrument, images can be printed with ease.

Also, in the foregoing configuration, a plurality of check boxes are printed for a single image, and by combining the checks of these plurality of check boxes it is possible to designate a number of prints of that image. Thus, by suitably altering how checks are added to the check boxes, it is possible to print a required number of prints of an image.

Also, in the foregoing configuration, the mark sheet further comprises check boxes for setting print attributes when printing images, and the processing means performs processing for setting the print attributes in accordance with the status of checks in the check boxes for setting print attributes. Thus, print attributes during printing can be set with ease.

Also, in the foregoing configuration, the mark sheet has check boxes for adjusting the print properties of the printing apparatus, and the processing means adjusts the print properties of the printing apparatus in accordance with the status of checks in the check boxes for adjusting the print properties. Thus, print properties during printing can be set with ease.

Also, in the foregoing configuration, examples of the print properties include the print positions in the forward and return passes in bidirectional printing, and the dot recording ratio. Thus, by correcting deviation in the print positions between the forward and return passes in bidirectional printing and adjusting the dot recording ratio, banding can be prevented.

Also, in the foregoing configuration, examples of the print properties include brightness, color saturation, contrast, or color balance. Thus, the brightness, color saturation, contrast, or color balance can be adjusted with ease.

A method for reading information using a printing apparatus having an optical sensor in a print head comprises a draw-up step of drawing (feeding) into the printing apparatus a mark sheet to which predetermined information has been written with a writing instrument, a reading step of reading the information written to the mark sheet drawn in through the draw-up step with a writing instrument using the optical sensor furnished in the print head, and a processing step of executing processing in correspondence with the information that has been read in the reading step.

Thus, with this information reading method it is possible to easily and quickly perform various settings.

An information reading program for a printing apparatus, in which a computer is caused to execute a process of reading information with a printing apparatus having an optical sensor in a print head, causes the computer to function as draw-up means for drawing (feeding) into the printing apparatus a mark sheet to which predetermined information has been written with a writing instrument, reading means for reading the information that has been written to the mark sheet drawn in by the draw-up means with the writing instrument using the optical sensor furnished in the print head, and processing means for executing processing corresponding to the information that has been read by the reading means.

Thus, by installing this program, it is possible to easily and quickly perform various settings.

Further, a printing apparatus comprises print property pattern print means for printing a plurality of print property patterns, draw-up means for drawing (feeding) into the printing apparatus a mark sheet on which the plurality of print property patterns have been printed, a sensor for detecting marks added to the mark sheet in order to select some of the plurality of print property patterns, reading means for reading information on the position of the marks that are detected by the sensor, memory means for storing a database that correlates the print properties with the information on the positions of the marks on the mark sheet, and print property determining means for comparing the information on the positions of the marks that are read by the reading means against the database to determine print properties. Thus, when printing, it is possible to easily and quickly perform various settings.

It should be noted that the CPU 1061, which is described later, functions as print property pattern print means for printing a plurality of print property patterns, draw-up means for drawing into the printer 1001 a mark sheet on which the plurality of print property patterns have been printed, reading means for reading information on the position of the marks that are detected by the optical sensor 1053, print property determining means for determining print properties based on the information on the positions of the marks that are read by the reading means, and confirmation printing execution means that, when the optical sensor 1053 detects confirmation marks for confirming the print properties determined based on marks that have been added to the mark sheet, again executes printing for confirming the print properties at the print properties that have been determined based on the marks that have been added. The CPU 1401, which is described later, also functions as print property pattern print means for printing a plurality of print property patterns, draw-up means for drawing into the printer a mark sheet on which the plurality of print property patterns have been printed, reading means for reading information on the position of the marks that are detected by the optical sensor 1053, and confirmation printing execution means that, when the optical sensor 1053 detects confirmation marks etc. for confirming the print properties determined based on marks etc. that have been added to the mark sheet, again executes printing for confirming the print properties at the print properties that have been determined based on the marks that have been added. It should be noted that the CPU 1401 can also further function as a portion of print property determining means for determining print properties based on the information on the positions of the marks etc. that are read by the reading means.

In the foregoing printing apparatus, the print properties are gap adjustment in the forward and return passes during bidirectional printing, and adjustment in the paper feed direction. Thus, particularly when performing gap adjustment in the forward and return passes during bidirectional printing (Bi-D adjustment) or adjustment in the paper feed direction (PF adjustment), it is possible to easily execute Bi-D adjustment or PF adjustment, simply by the user selecting one (may also be a plurality) of the plurality of Bi-D adjustment patterns or the plurality of PF adjustment patterns printed on the mark sheet and causing that mark sheet to be read.

In the foregoing printing apparatus, the sensor is an optical sensor that is attached to a print head that moves back and forth in a main-scanning direction that is perpendicular to the paper feed direction. Thus, it is possible to read the mark sheet using the optical sensor used for paper end detection, for example. Consequently, it is not necessary to provide a separate sensor and separate drive means for scanning using this sensor, and this allows the manufacturing costs of the printing apparatus to be reduced.

In the foregoing printing apparatus, the sensor is a CCD camera, and the CCD camera is scanned in the paper feed direction or the main-scanning direction, which is perpendicular to the paper feed direction, to read the information on the positions of the marks. It is possible to read the mark sheet by adding such a scanner function as well. Consequently, if the printing apparatus has a scanner function, then the mark sheet can be read without providing a separate sensor for mark sheet reading. Thus, the manufacturing costs of the printing apparatus can be reduced.

In the foregoing printing apparatus, when two marks are detected on the mark sheet, the print property determining means determines a print property between the two print properties that the two marks indicate. Thus, even when the print state of the patterns indicating the plurality of print properties is poor or the resolution of the printing apparatus is low, suitable print properties can be executed by adding marks to two check boxes considered suitable without narrowing down the choices to a single check box.

The foregoing printing apparatus further comprises confirmation printing execution means that, when the sensor detects confirmation marks for confirming the print properties that have been entered based on marks added to the mark sheet, once again executes printing for confirming the print properties at the print properties that have been determined based on the marks that have been added. Thus, it is possible to perform actual printing after reconfirming whether or not suitable print properties can be achieved at the print property patterns marked by the user. Consequently, printing mistakes are reduced.

A print property adjustment method comprises a print property pattern print step of printing a plurality of print property patterns, a draw-up step of drawing into a printing apparatus a mark sheet on which the plurality of print property patterns have been printed, a position detection step of detecting the position of marks that have been added to the mark sheet in order to select a portion of the plurality of print property patterns, a reading step of reading information on the position of the marks, and a print property determining step of referencing a database correlating the print properties with the information on the position of the marks on the mark sheet and determining the print properties based on the position of the marks that have been read. Thus, when printing, it is possible to easily and quickly perform various settings.

In the foregoing print property adjustment method, when two marks are detected on the mark sheet, the print property between the two print properties indicated by the marks is determined in the print property determining step. Thus, even when the print state of the patterns indicating the plurality of print properties is poor or the resolution of the printing apparatus is low, suitable print properties can be executed by adding marks to two check boxes considered suitable without narrowing down the choices to a single check box.

The foregoing print property adjustment method further comprises a confirmation printing execution step of, when confirmation marks for confirming the print properties determined based on the marks added to the mark sheet are detected, once again executing printing for confirming the print properties at the print properties determined based on those marks that have been added. Thus, it is possible to perform actual printing after reconfirming whether or not suitable print properties can be achieved with the pattern marked by the user. Consequently, printing mistakes are reduced.

A print property adjustment program for executing processing for adjusting print properties on a computer, wherein the computer is caused to function as print property pattern print means for printing a plurality of print property patterns, draw-up means for drawing into a printing apparatus a mark sheet on which the plurality of print property patterns have been printed, reading means for reading information on the position of the marks added to the mark sheet in order to select a portion some of the plurality of print property patterns, and print property determining means for referencing a database correlating the print properties with the information on the position of the marks on the mark sheet and determining the print properties based on the information on the position of the marks that have been read. Thus, by installing this program on a printing apparatus and executing it, it is possible to easily and quickly perform various settings when printing.

In the foregoing print property adjustment program, when two marks are detected on the mark sheet, the print property determining means determines the print property between those two print properties indicated by the marks. Thus, by installing this program on a printing apparatus and executing it, even when the print state of the plurality patterns indicating the print properties is poor or the resolution of the printing apparatus is low, suitable print properties can be executed by adding marks to two check boxes considered suitable without narrowing down the choices to a single check box.

The foregoing print property adjustment program further causes the computer to function as confirmation printing execution means that, when confirmation marks for confirming the print properties determined based on marks added to the mark sheet are detected, once again executes printing for confirming the print properties at the print properties determined based on the marks that have been added. Thus, by installing this program on the printing apparatus and executing the program, it is possible to perform actual printing after reconfirming whether or not suitable print properties can be achieved with the patterns marked by the user. Consequently, printing mistakes are reduced.

Further, a printing apparatus comprises image correction adjustment pattern print means for printing a plurality of image correction adjustment patterns, draw-up means for drawing into the printing apparatus a mark sheet on which the plurality of image correction adjustment patterns have been printed, a sensor for detecting marks added to the mark sheet in order to select some of the plurality of image correction adjustment patterns, reading means for reading information on the position of the marks that are detected by the sensor, memory means for storing a database that correlates image correction adjustments with the information on the positions of the marks on the mark sheet, and image correction adjustment determining means for comparing the information on the positions of the marks that are read by the reading means against the database and determining how to adjust image correction. Thus, it is possible to easily and quickly perform image correction adjustment when printing.

It should be noted that the CPU 2061, which is described later, functions as image correction adjustment pattern print means for printing a plurality of image correction adjustment patterns and image effect setting pattern print means for printing a plurality of image effect setting patterns, draw-up means for drawing into the printer 2001 a mark sheet on which the plurality of image correction adjustment patterns or the plurality of image effect setting patterns have been printed, reading means for reading information on the position of the marks that are detected by the optical sensor 2053, image correction adjustment determining means for determining image correction adjustments and image effect determining means for determining image effects based on the information on the positions of the marks that are read by the reading means, confirmation printing execution means that, when the optical sensor 2053 detects confirmation marks for confirming the image correction adjustments or image effects (print properties) determined based on marks that have been added to the mark sheet, executes printing at the print properties that have been determined based on the marks that have been added, and image data reading means for reading target image data for printing the plurality of image effect setting patterns. The CPU 2861, which is described later, functions as image correction adjustment pattern print means for printing a plurality of image correction adjustment patterns, image effect setting pattern print means for printing a plurality of image effect setting patterns, draw-up means for drawing into the printer 2802 a mark sheet 2500 etc. on which the plurality of image correction adjustment patterns or the plurality of image effect setting patterns have been printed, reading means for reading information on the position of the marks 2515 etc. that are detected by the optical sensor 2853, confirmation printing execution means that, when the optical sensor 2853 detects a confirmation mark 2662 for confirming the image correction adjustments determined based on the marks 2515 etc. that have been added to the mark sheet 2500 etc., executes printing at the image correction adjustments that have been determined based on those added marks 2515 etc., and image data reading means for reading target image data for printing the plurality of image effect setting patterns. It should be noted that the CPU 2861 can also further function as a part of image correction adjustment determining means for determining image correction adjustments or image effect determining means for determining image effects based on the information on the positions of the marks that are read by the reading means.

In the foregoing printing apparatus, the image correction adjustment is an adjustment of at least one of color saturation, brightness, and contrast. Thus, particularly when performing correction of the color saturation, brightness, or contrast, it is possible to easily and quickly execute image correction adjustment, simply by the user selecting a portion of the plurality of image correction adjustment patterns printed on the mark sheet and causing that mark sheet to be read.

Further, a printing apparatus comprises image effect setting pattern print means for printing a plurality of image effect setting patterns, draw-up means for drawing into the printing apparatus a mark sheet on which the plurality of image effect setting patterns have been printed, a sensor for detecting marks added to the mark sheet in order to select some of the plurality of image effect setting patterns, reading means for reading information on the position of the marks that are detected by the sensor, memory means storing a database that correlates the image effects with the information on the positions of the marks on the mark sheet, and image effect determining means for comparing the information on the positions of the marks that are read by the reading means against the database and determining the image effects. Thus, it is possible to easily and quickly set the image effects when printing.

In the foregoing printing apparatus, the image effect setting is a setting of an effect including at least one from among monochrome and sepia. Thus, particularly when setting to monochrome or sepia, it is possible to easily and quickly set the image effect, simply by the user selecting a portion of the plurality of image effect setting patterns printed on the mark sheet and causing that mark sheet to be read.

In the foregoing printing apparatus, the image effect settings are the settings of the adjustment standard if photograph data are to be printed. Thus, particularly in a case where there are a plurality of adjustment standards for printing photograph data and the user would like to perform printing using a desired adjustment standard from among these, it is possible to easily and quickly set a desired adjustment standard, simply by the user selecting a portion of the plurality of adjustment standards printed on the mark sheet and causing this mark sheet to be read.

In the foregoing printing apparatus, the settings of the image effects are settings for at least one of a person, natural scenery, and a close-up shot. Thus, particularly when it is desired to perform printing after setting the image effects to image effects suited for person, natural scenery, or close-up shot, it is possible to easily and quickly set the image effects to those suited for the captured image or the image-capturing conditions, simply by the user selecting a portion of the plurality of image effects printed on the mark sheet and causing this mark sheet to be read.

The foregoing printing apparatus further comprises image data reading means for reading target image data for printing the plurality of image effect setting patterns. Thus, when setting the image effects, a list of the image data that has been actually captured is printed with a plurality of image effects, and after confirming what printing is possible, it is possible to adjust the settings for desired image effects. Consequently, even users who are not familiar with the image effects can easily and quickly set the print properties.

In the foregoing printing apparatus, the sensor is an optical sensor that is attached to a print head that moves back and forth in a main-scanning direction that is perpendicular to the paper feed direction. Thus, it is possible to read the mark sheet using the optical sensor used for paper end detection, for example. Consequently, it is not necessary to provide a separate sensor and separate drive means for scanning using this sensor, and this allows the manufacturing costs of the printing apparatus to be reduced.

In the foregoing printing apparatus, the sensor is a CCD camera, and the CCD camera is scanned in the paper feed direction or the main-scanning direction, which is perpendicular to the paper feed direction, to read the information on the positions of the marks. It is possible to read the mark sheet by adding such a scanner function as well. Consequently, if the printing apparatus has a scanner function, then the mark sheet can be read without providing a separate sensor for mark sheet reading. Thus, the manufacturing costs of the printing apparatus can be reduced.

The foregoing printing apparatus further comprises confirmation printing execution means that, when the sensor detects confirmation marks for confirming the print properties that have been determined based on the marks added to the mark sheet, executes printing at the print properties that have been determined based on the marks that have been added. Thus, actual printing can be carried out after confirming whether or not suitable print Properties can be achieved with the print property pattern marked by the user. Consequently, printing mistakes are reduced.

Further, a print property adjustment method comprises an image correction adjustment pattern print step of printing a plurality of image correction adjustment patterns, a draw-up step of drawing into the printing apparatus a mark sheet on which the plurality of image correction adjustment patterns have been printed, a position detection step of detecting the positions of the marks added to the mark sheet in order to select some of the plurality of image correction adjustment patterns, a reading step of reading information on the position of the marks, and an image correction adjustment determining step of referencing a database that correlates the various image correction adjustments with the information on the positions of the marks on the mark sheet and determining the image correction adjustment based on the position of the marks that are read. Thus, it is possible to easily and quickly perform image correction adjustment when printing.

Further, a printing apparatus comprises image effect setting pattern print means for printing a plurality of image effect setting patterns, draw-up means for drawing into the printing apparatus a mark sheet on which the plurality of image effect setting patterns have been printed, a sensor for detecting marks added to the mark sheet in order to select some of the plurality of image effect setting patterns, reading means for reading information on the position of the marks that are detected by the sensor, memory means storing a database that correlates the image effects with the information on the position of the marks on the mark sheet, and image effect determining means for comparing the information on the position of the marks that are read by the reading means against the database and determining the image effect. Thus, it is possible to easily and quickly set image effects when printing.

Further, a print property adjustment program for causing a computer to execute image correction adjustment, wherein the computer is made to function as image correction adjustment pattern print means for printing a plurality of image correction adjustment patterns, draw-up means for drawing into the printing apparatus a mark sheet on which the plurality of image correction adjustment patterns have been printed, reading means for reading information on the position of the marks that are added to the mark sheet to select some of the plurality of image correction adjustment patterns, and image correction adjustment determining means for referencing a database that correlates the image correction adjustments to the information on the positions of the marks on the mark sheet and determining the image correction adjustment based on the information on the position of the marks that are read. Thus, by installing this print property adjustment program on the computer and executing it, image correction adjustment can be performed easily and quickly when printing.

Further, a print property adjustment program for causing a computer to setting of the image effects, wherein the computer is made to function as image effect setting pattern print means for printing a plurality of image effect Betting patterns, draw-up means for drawing into the printing apparatus a mark sheet on which the plurality of image effect setting patterns have been printed, reading means for reading information on the position of the marks that are added to the mark sheet to select some of the plurality of image effect setting patterns, and image effect determining means for referencing a database that correlates the image effects to the information on the position of the marks on the mark sheet and determining the image effect based on the information on the position of the marks that are read.

Thus, by installing this print property adjustment program on the computer and executing it, the image effects can be set easily and quickly when printing.

First Embodiment

<Configuration of the Printing Apparatus>

First, an overview of the printing apparatus is described with reference to FIGS. 1 and 2. It should be noted that in the following, the combination of a printer 22 and a personal computer 90 is referred to as a "printing apparatus."

FIG. 1 is a structural diagram that schematically shows the printer 22 of the printing apparatus. FIG. 2 is a block diagram showing an example of the structure of the primary components of the printer 22, focusing on a control circuit 40.

As shown in FIG. 1, the printer 22 has a carrying mechanism (sub-scan feed mechanism) and a carriage moving mechanism (main-scan feed mechanism). The carrying mechanism carries a print paper P using a paper feed motor 23. The carriage moving mechanism moves a carriage 31 back and forth in the axial direction of a paper feed roller 26 using a carriage motor 24. Here, the direction in which the print paper P is fed by the carrying mechanism is referred to as the carrying direction (also referred to as the sub-scanning direction), and the direction in which the carriage 31 is moved by the carriage moving mechanism is referred to as the movement direction (also referred to as the main-scanning direction).

Also, the printer 22 is provided with a print head unit 60, a head drive mechanism, and the control circuit 40. The print head unit 60 is mounted to the carriage 31 and is provided with a print head 12. The head driving mechanism drives the print head unit 60 to control the ejection of ink and dot formation. The control circuit 40 governs the sending and receiving of signals among the paper feed motor 23, the carriage motor 24, the print head unit 60, and a control panel 32.

As shown in FIG. 1, four ink cartridges are detachably mounted to the carriage 31. The four ink cartridges are detachable structural components, and are: a cartridge 71 containing black (K) ink, a cartridge 72 containing cyan (C) ink, a cartridge 73 containing magenta (M) ink, and a cartridge 74 containing yellow (Y) ink.

The print head 12 is provided in a lower portion of the carriage 31. Nozzles serving as ink ejection locations are disposed in the print head 12 in rows in the carrying direction of the print paper P. Each nozzle row respectively corresponds to a predetermined color of ink.

Further, piezo elements, which are a type of electrostrictive element with excellent responsiveness, are provided in a lower section of the carriage 31 and disposed for each nozzle in the nozzle rows corresponding to the various inks. The piezo elements are arranged at positions in contact with a member forming the ink path over which ink is guided to the nozzles. When voltage is applied to the piezo elements, their crystalline structure is deformed and they very quickly convert this electrical energy into mechanical energy.

In this embodiment, voltage of a predetermined duration is applied between electrodes provided on both sides of the piezo element, and the piezo element is elongated during application of the voltage and deforms one lateral wall of the ink path. As a result, the volume of the ink path is constricted by an amount corresponding to the elongation of the piezo element, and ink corresponding to this amount of constriction becomes an ink droplet and is quickly ejected from the tip of the nozzle. The ink droplet soaks into the print paper P, which is guided along the paper feed roller 26, thereby forming a dot and carrying out printing. The size of the ink droplets can be changed depending on the method for applying voltage to the piezo elements. It is thus possible to form dots at, for example, three different sizes, these being large, medium, and small.

The control circuit 40 is connected to the personal computer 90 via a connector 56. The personal computer 90 is provided with a driver program (printer driver) for the printer 22, as discussed later, and constitutes a user interface for receiving commands made by a user operating an input device such as a keyboard or a mouse, and for displaying various types of information in the printer 22 through a screen display on a display device.

The carrying mechanism for carrying the print paper P is provided with a gear train (not shown) that transmits the rotation of the paper feed motor 23 to the paper feed roller 26 and a paper carry roller (not shown).

Also, the carriage moving mechanism for moving the carriage 31 back and forth is provided with a slide shaft 34 which runs parallel to the axis of the paper feed roller 26 and which slidably retains the carriage 31, a pulley 38, with an endless drive belt 36 being provided spanning between the pulley 38 and the carriage motor 24, and an optical sensor 39 for detecting the position of origin of the carriage 31 and for detecting checks on a mark sheet that is discussed later. It should be noted that the optical sensor 39 is made of a light source for emitting light onto the print paper P, and a photodiode (or a CCD (charge coupled device) element), for example, for converting light that is reflected from the print paper P into corresponding image signals. The optical sensor 39 is mounted to the carriage 31, and thus is capable of movement in the movement direction of the carriage 31. The optical sensor 39 can also detect whether or not the paper is present, and thus can detect the paper width by detecting the end portions of the paper during movement of the carriage 31, and can detect the upper end and lower end of the paper by detecting the end portions of the paper during carrying.

It should be noted that a "mark sheet" (or, "bubble sheet") is a sheet on which marks such as check boxes have been printed. The user selectively checks (for example, fills in) the marks using a pencil, and the optical sensor 39 detects whether or not the marks have been checked. Thus, the printer can receive commands from the user via the mark sheet.

Figure 2:
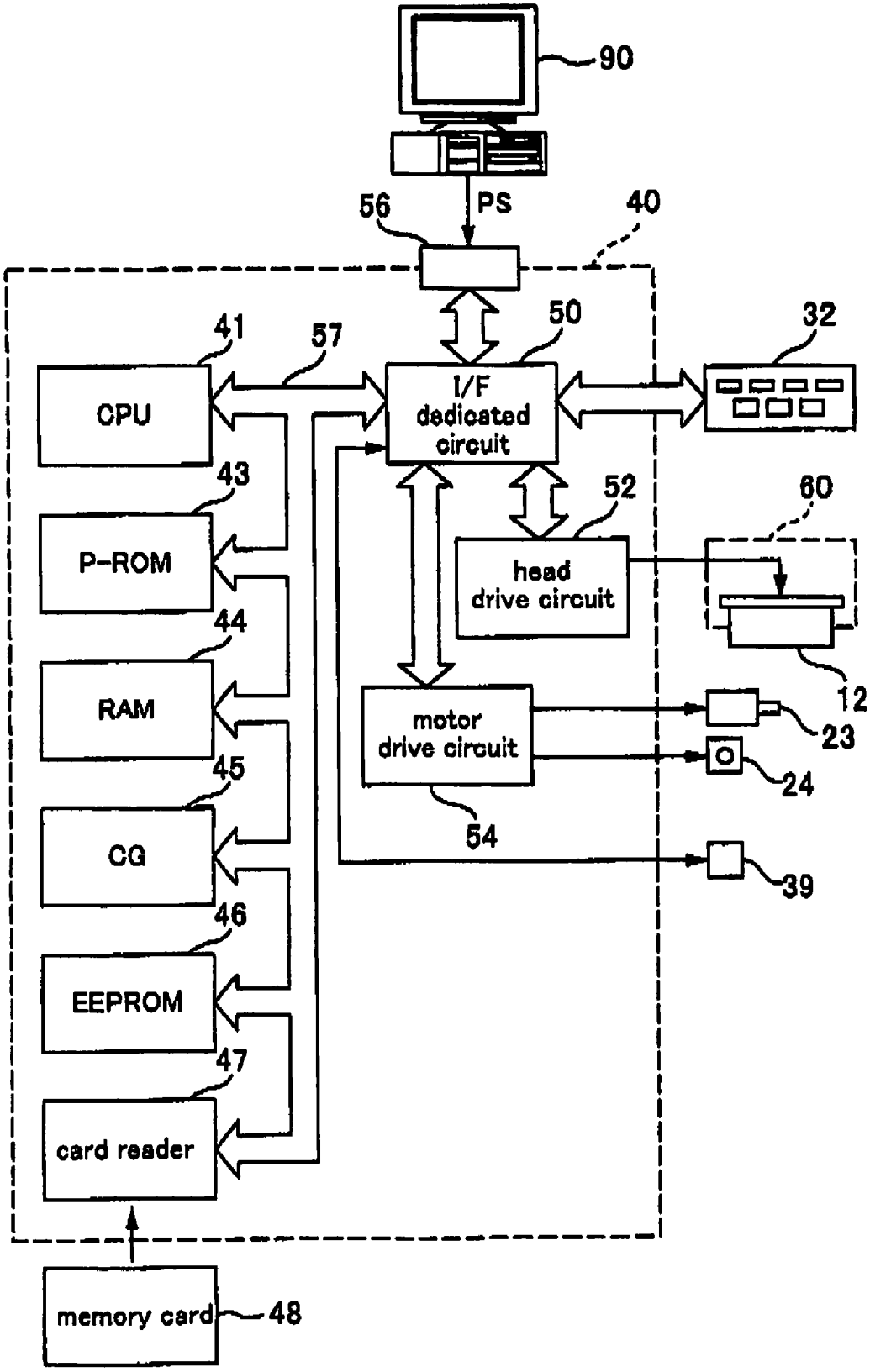
FIG. 2 is a block diagram showing the configuration of the primary components of the printer, focusing of the control circuit in the printing apparatus shown in FIG. 1.

As shown in FIG. 2, the control circuit 40 is constituted by an arithmetic and logic circuit that is provided with a CPU (Central Processing Unit) 41, a programmable ROM (P-ROM (Read only Memory)) 43, a RAM (Random Access Memory) 44, a character generator (CG) 45 storing character dot matrix, an EEPROM (Electronically Erasable and Programmable ROM) 46, which is a memory (storage means), and a card reader 47. Here, the CPU 41 of the control circuit 40 performs various computer processing in accordance with a program stored on the ROM 43. The CPU 41 functions as a controller (controlling section) for controlling the various sections in the printer. For example, the CPU 41 controls the carriage moving mechanism to move the carriage (and print head) and controls the carrying mechanism to carry the print paper in the carrying direction, and controls the head driving mechanism to cause the print head to eject ink. The CPU 41 can also control the various sections in the printer based on the results of detection by the optical sensor 39.

The control circuit 40 is further provided with an I/F dedicated circuit 50, which is an interface (I/F) between the control circuit 40 and the external motors etc., a head drive circuit 52 that is connected to the I/F dedicated circuit 50 and that drives the print head unit 60 and causes it to eject ink, and a motor drive circuit 54 for driving the paper feed motor 23 and the carriage motor 24.

The I/F dedicated circuit 50 is internally provided with a parallel interface circuit, and via the connector 56 is capable of receiving print signals PS that are supplied from the personal computer 90. It should be noted that when the printer receives print signals PS, the printer repeats, in alternation, the process of ejecting ink from the print head 12 during movement of the carriage to form dots on the print paper P and the process of carrying the print paper P using the carrying mechanism, in order to print an image on the print paper P. In this case, the process of converting image information into print signals PS is performed by the personal computer 90, on which a printer driver has been installed.

A memory card 48, which is a storage medium for a digital camera that is not shown, is inserted into the card reader 47. As discussed later, the information stored on the memory card 48 is read out and printed by the printer. It should be noted that in place of the card reader 47 it is also possible to provide a predetermined interface circuit and to send and receive image information via wire or wirelessly to and from the digital camera. It should be noted that when the printer has obtained image information from the memory card 48, the printer converts the image information into print signals in accordance with the printer driver within the printer and prints an image on the print paper P based on these print signals.

The memory card 48 is constituted by a semiconductor memory device, is detachably mounted to a digital camera that is not shown, and is designed to store captured images.

The external appearance of the printer 22 is described next with reference to FIG. 3.

Figure 3:
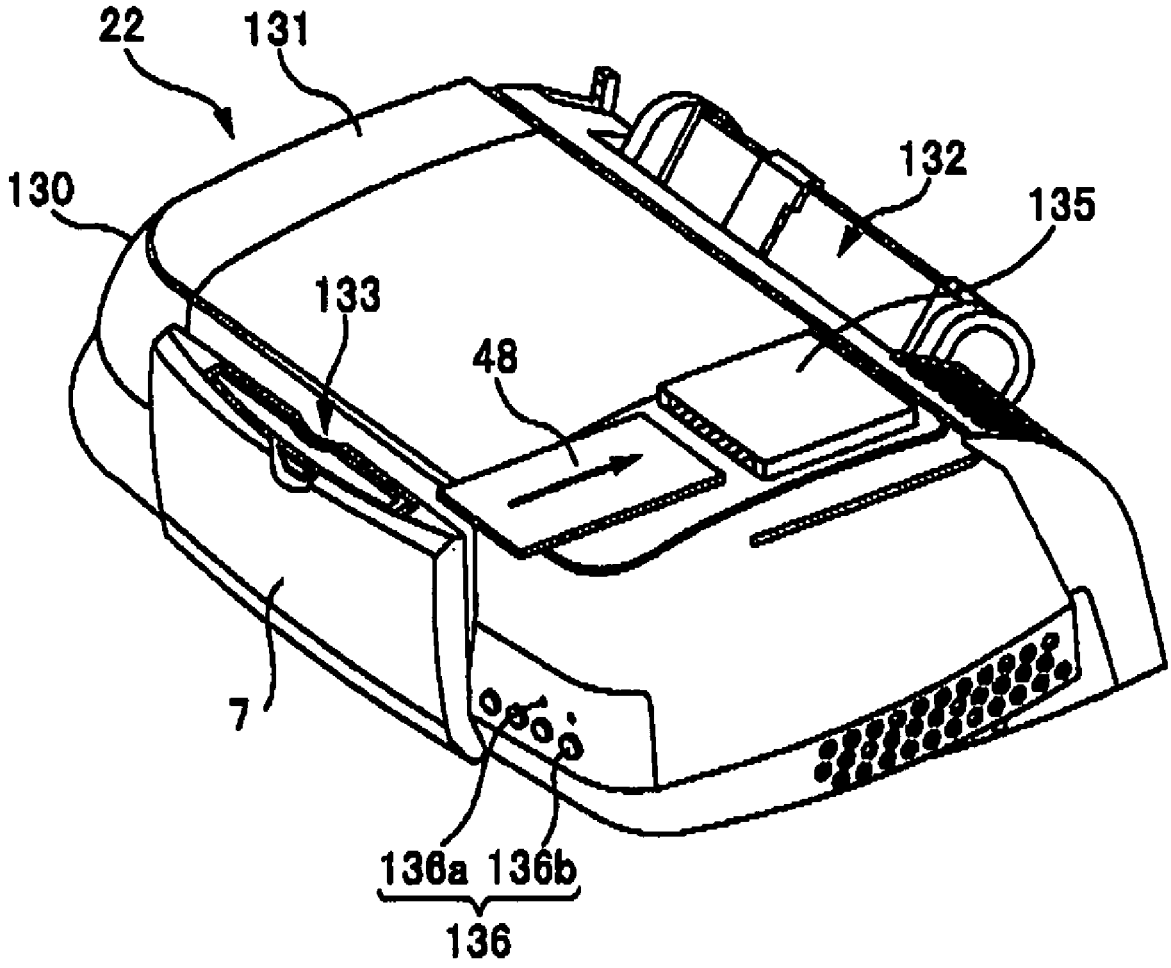
FIG. 3 is an external appearance diagram showing the external configuration of the printer shown in FIG. 1.

FIG. 3 is a diagram showing the external appearance of the printer 22 shown in FIG. 1. As shown in FIG. 3, the printer 22 is made of a housing 130, an upper lid 131, a paper supply section 132, a paper discharge section 133, a slot 135, and a control section 136.

Here, the housing 130 is made of resin or the like and is internally provided with a mechanism section and a control section as shown in FIG. 1 and FIG. 2. The upper lid 131 is interlocked in such a manner that it can rotate in the opening and closing direction about a rotation shaft (not shown) that is provided on the housing 130. When the upper lid 131 is opened it is possible to see the print head unit 60 etc. accommodated within the housing 130.

The paper supply section 132 has a stocker for storing print paper P and a paper supply mechanism for supplying print paper P stored in the stocker one sheet at a time. The paper discharge section 133 is constituted by a paper discharge opening through which print paper P for which printing has finished is discharged and a paper discharge tray that is, for example, for storing print paper P that has been discharged through the paper discharge opening. In FIG. 3, the paper discharge section 133 is not in a state in which paper can be discharged, and thus for it to discharge paper it is necessary to rotate the paper discharge tray of the paper discharge section 133 to bring the paper discharge opening in communication with the outside.

The slot 135 is attached to the top of the upper lid 131, and has a card insertion opening to and from which the memory card 48 can be attached and detached. When the memory card 48 is inserted into the slot 135, the position of the memory card 48 is restricted by the inner wall of the slot 135. It should be noted that when the memory card 48 has been inserted into the slot 135, it is also possible for lamps 136*a*, which are discussed later, to flash or for the color of the lamps 136*a* to change. It should be noted that the card reader 47 shown in FIG. 2 is provided inside the slot 135.

The control section 136 is made of the lamps 136*a* and buttons 136*b*, and is operated when turning the power on and off, supplying or discharging the print paper P, and performing cleaning of the print head 12, and is also a section for performing a display for notifying the user of the operating state of the printer in accordance with these operations.

<Configuration of the Computer 90 Side>

The configuration of the personal computer 90 is described next with reference to FIG. 4.

Figure 4:
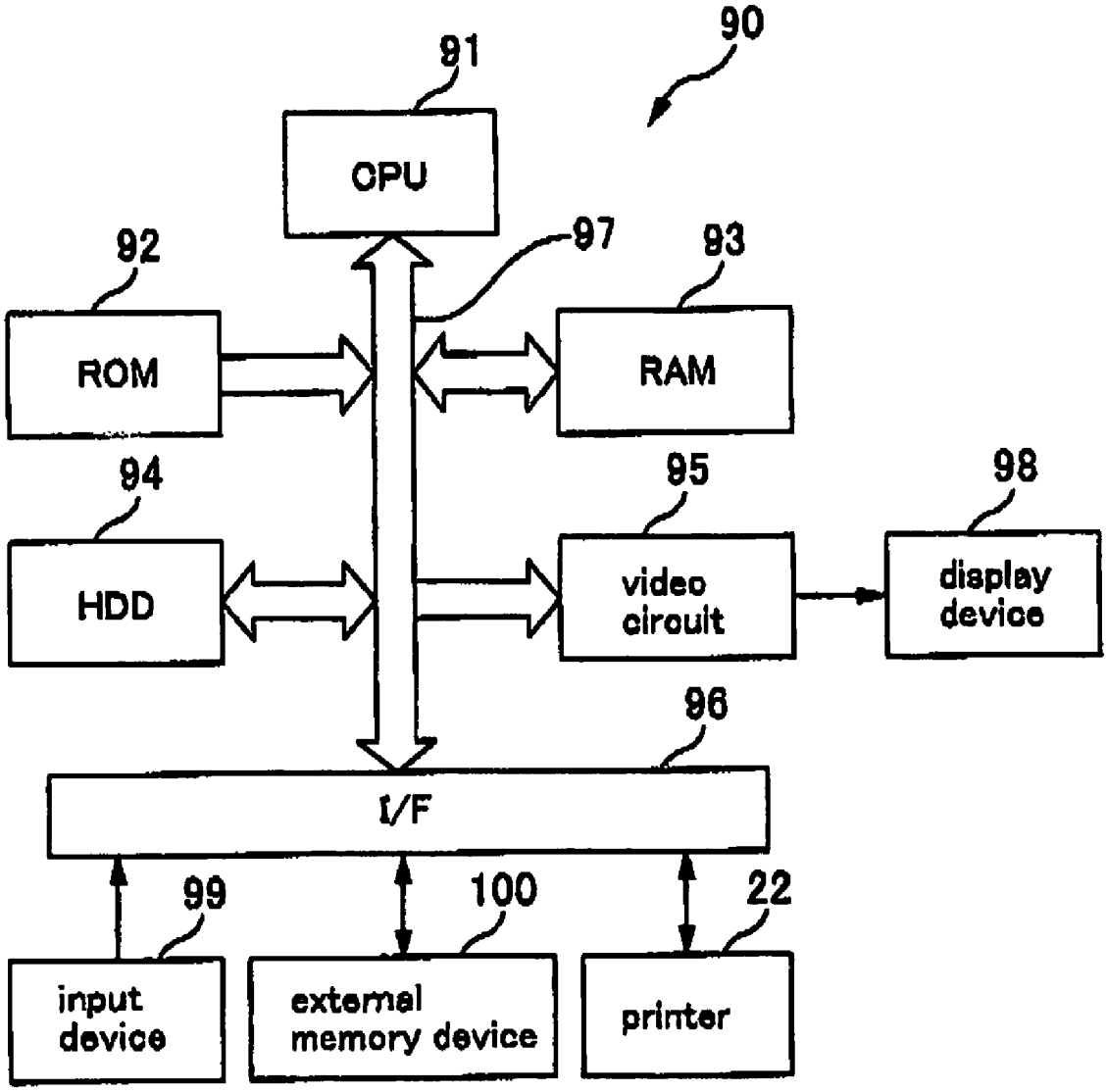
FIG. 4 is a block diagram showing the detailed configuration of the computer in the printing apparatus shown in FIG. 1.

As shown in FIG. 4, the personal computer 90 is constituted by a CPU 91, a ROM 92, a RAM 93, a EDD (Hard Disk Drive) 94, a video circuit 95, an I/F 96, a bus 97, a display device 98, an input device 99, and an external memory device 100.

Here, the CPU 91 is a controller that performs various computer processing in accordance,with the programs stored on the ROM 92 and the HDD 94, and controls the various sections of the apparatus.

The ROM 92 is a memory storing basic programs and data executed by the CPU 91. The RAM 93 is a memory for temporarily storing programs being executed by the CPU 91 and data being computed, for example.

The HDD 94 is a storage device for reading out data or programs stored on a hard disk, which is a storage medium, in accordance with requests from the CPU 91, and for storing data generated as the outcome,of computer processing by the CPU 91 on that hard disk.

The video circuit 95 is a circuit for executing rendering processes in accordance with picture commands supplied from the CPU 91 to convert obtained image data into a video signal, and outputting this signal to the display device. 98.

The I/F 96 is a circuit for suitably converting the expression format of signals that are output from the input device 99 and the external memory device 100 and outputting print signals PS to the printer 22.

The bus 97 is a signal line that connects the CPU 91, the ROM 92, the RAM 93, the HDD 94, the video circuit 95, and the I/F 96 to one another, allowing data to be sent and received between them.

The display device 98 is a device such as a LCD (Liquid Crystal Display) monitor or a CRT (Cathode Ray Tube)

monitor, and displays images corresponding to video signals output from the video circuit 95.

The input device 99 is a device such as a keyboard or a mouse, and is for generating signals corresponding to operations performed by a user and supplying these to the I/F 96.

The external memory device 100 is a device such as a CD-ROM (Compact Disk-ROM) drive unit, a MO (Magneto optic) drive unit, or a FDD (Flexible Disk Drive) unit, and is for reading data and programs stored on CD-ROM disks, MO disks, or FDs and supplying these to the CPU 91. If the external memory device 100 is a MO drive unit or a FDD unit, then it also functions as a device for storing data supplied from the CPU 91 on a MO disk or a FD.

If the printer driver is installed on the personal computer 90, then various types of information in the printer 22 can be displayed on the display device 98, and the user can set the various parameters of the printer driver via the input device 99. The printer driver converts image data into print signals PS, or sets the printer, in accordance with the various parameters that have been set.

However, the task of setting the printer driver using the input device 99 forces the user to perform burdensome work.

Also, in recent years, printing apparatuses that are capable of printing images, without employing a computer, by directly connecting to a digital camera or by directly mounting the storage medium of a digital camera have appeared. With such printing apparatuses, it is necessary to perform all of the above operations for printing on the control panel of the printing apparatus. Generally, the display section of the control panel is set to a low resolution (or a display section may not be provided at all) to curb costs, and thus there is also the problem that the operation of specifying the image cannot be carried out smoothly. Further, with such printing apparatuses, it is also necessary to operate the control panel to set the printing properties of the printing apparatus, for example. An example of a setting of the printing properties is correction of the printing position during bidirectional printing, and because performing such an adjustment while referencing a screen with low resolution often proves difficult, there is also the problem that the printing properties cannot be sufficiently adjusted.

Accordingly, in the present embodiment, the printer prints a mark sheet, and by the user filling in the check boxes of the mark sheet, it is made possible to set the printer or the printer driver.

The operation of the embodiment is explained below.

<Printing the Mark Sheet>

Figure 5:
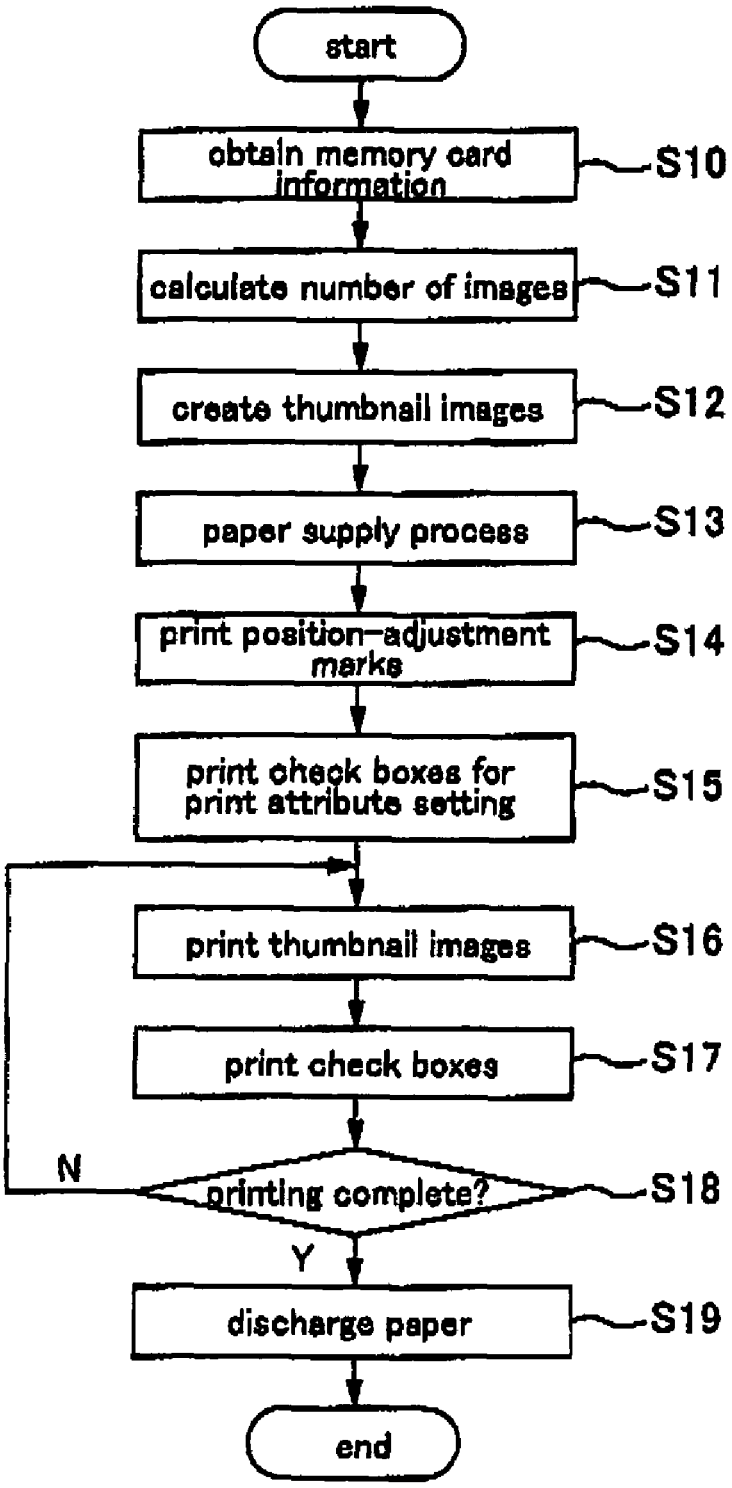
FIG. 5 is a flowchart showing an example of a process that is carried out when a memory card has been inserted into the printer shown in FIG. 1 and an operation for requesting printing of an image has been made through the control panel.

FIG. 5 is a flowchart for describing one example of the process that is executed when printing a mark sheet for image printing. The procedure of this flowchart is executed after the memory card 48 has been inserted into the slot 135 shown in FIG. 3 and the control section 136 has been operated to order printing of a mark sheet for image processing. It should be noted that it is also possible for this procedure to be executed when then input device 99 of the personal computer 90, instead of the control section 136 of the printer 22, has been operated.

When the process of the flowchart shown in FIG. 5 is started, the following steps are performed. It should be noted that the ROM 43 stores the program for performing the various steps. The CPU 41 controls the various sections in the printer in accordance with this program to execute the steps.

Step S10: The CPU 41 of the control circuit 40 sends a command to read information to the card reader 47 and so as to obtain the image information stored on the memory card 48.

Step 11: The CPU 41 of the control circuit 40 calculates the number of images obtained in step S10. For example, when 30 images are stored on the memory card 48, "30" is obtained.

Step 12: The CPU 41 of the control circuit 40 executes processing to create thumbnail images of the images obtained in step S10. More specifically, the CPU 41 for example creates thumbnail images of a predetermined size (for example, height 4 cm×width 3 cm) by thinning out, at a predetermined spacing, the pixels making up the images obtained in the step S10.

Step S13: The CPU 41 of the control circuit 40 executes a paper supply process of driving the paper feed motor 23 to supply one sheet of print paper P stored in the stocker of the paper supply section 132.

Step S14: The CPU 41 of the control circuit 40 prints, on both edges of the front end portion of the print paper P, position-adjustment marks for detecting the positions during the reading process discussed later.

Figure 6:
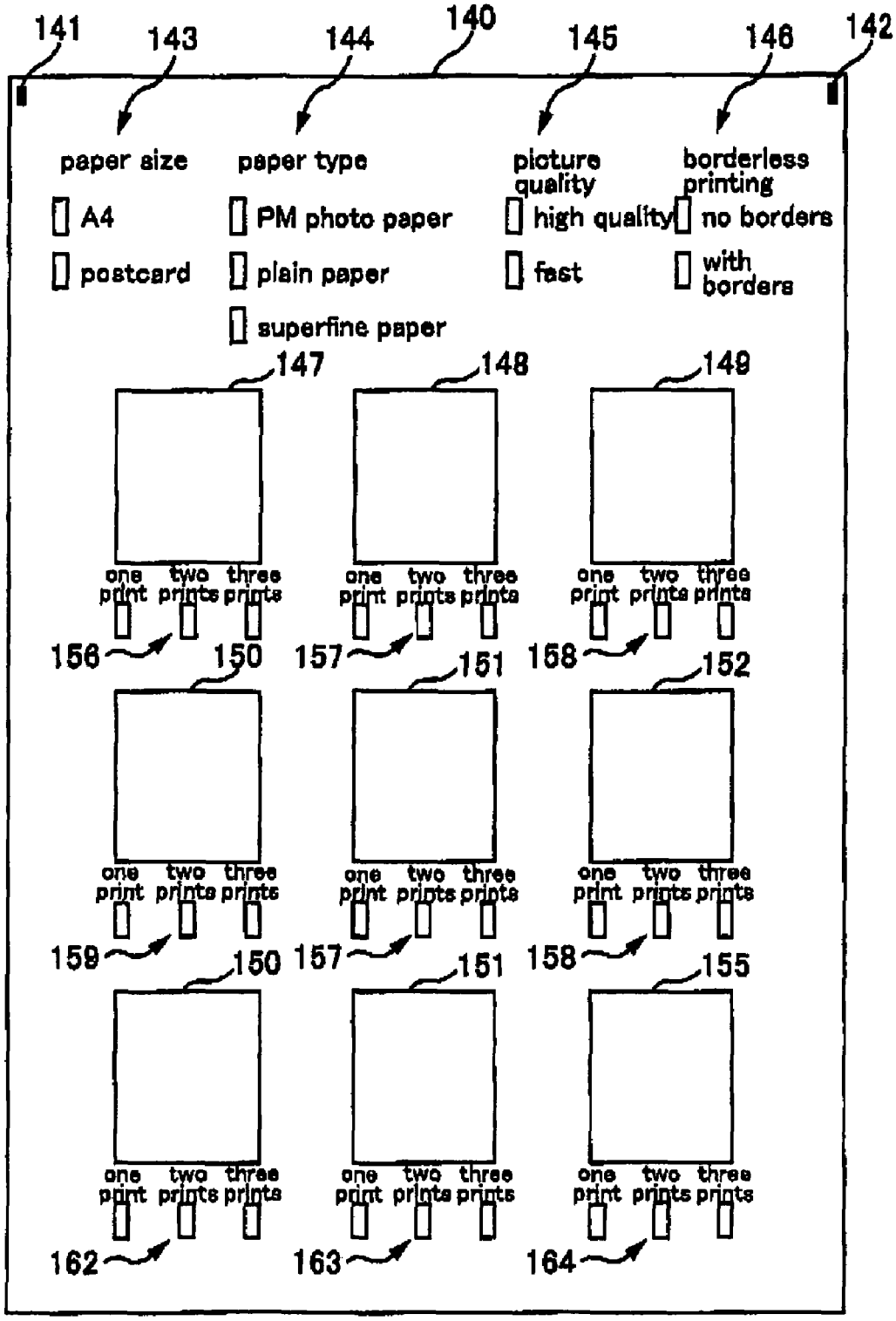
FIG. 6 is an example of the mark sheet that is printed as a result of executing the procedure of the flowchart shown in FIG. 5.

FIG. 6 shows an example of a mark sheet 140 obtained as a result of the process of FIG. 5. In the process of step S14, position-adjustment marks 141 and 142 are printed on both edges of the front end portion (portion that is printed first by the printer 22) of the mark sheet 140. It should be noted that it is also possible to print only on one edge instead of printing on both edges.

Step S15: The CPU 41 of the control circuit 40 moves the carriage 31 in the movement direction and causes ink to be ejected to predetermined positions, and when formation of a single line (the process of forming a single line is also referred to as a "main scan") has finished, it drives the paper feed motor 23 to effect carrying. By repeatedly performing the process of ejecting ink and the process of performing carrying in alternation in this manner, the printer prints check boxes for print attribute setting.

As a result, the check boxes 143 to 146 shown in FIG. 6 are printed. Here, the check box 143 includes boxes for setting the paper size, and lists "A4" and "postcard" as selection candidates. The check box 144 includes boxes for setting the paper type, and lists "PM photo paper," "plain paper," and "superfine paper" as selection candidates. The check box 145 includes boxes for setting the print quality, and lists "high quality" and "fast" as selection candidates. The check box 146 includes boxes for setting whether or not to perform borderless printing, and lists "borderless" and "with border" as selection candidates.

Step S15: The CPU 41 of the control circuit 40 obtains three thumbnails worth of images created in step S12 and prints these on the print paper P in order. As a result, for example, when the first printing process is finished, the thumbnail images 147 to 149 shown in FIG. 6 are printed (the thumbnail images within the frames 147 to 149 of FIG. 6 are printed).

Step S16: The CPU 41 of the control circuit 40 prints check boxes for setting the number of prints below the thumbnail images printed in step S15. For example, when the first printing process is finished, the check boxes 156 to 158 shown in FIG. 6 are printed. It should be noted that in this example, a check box that is filled in when printing a single image, a check box that is filled in when printing two sheets, and a check box that is filled in when printing three sheets are printed below the respective thumbnail images. The check boxes are printed at predetermined positions on the print paper P.

Step S18: The CPU 41 of the control circuit 40 determines whether or not there are any thumbnail images that still have not been printed, and if there are any remaining, then the procedure is returned to step S16 and the same processing is repeated, and in the alternate case, the procedure is advanced to step S19. It should be noted that if there is not enough blank space on the print paper P when there still are thumbnail images to be printed, then the paper is discharged and a new print paper P is fed. Further, the relationship between the thumbnail images and the check boxes will become unknown if these are printed on separate sheets of print paper P; thus, it is preferable that the settings are adjusted so that the thumbnail images and the check boxes are printed on the same print paper P.

Step S19: The CPU 41 of the control circuit 40 drives the paper feed motor 23 to discharge the print paper P for which printing has finished.

A mark sheet 140 for image printing such as that shown in FIG. 6 is obtained as a result of the above processing.

<Filling in the Mark Sheet>

Figure 7:
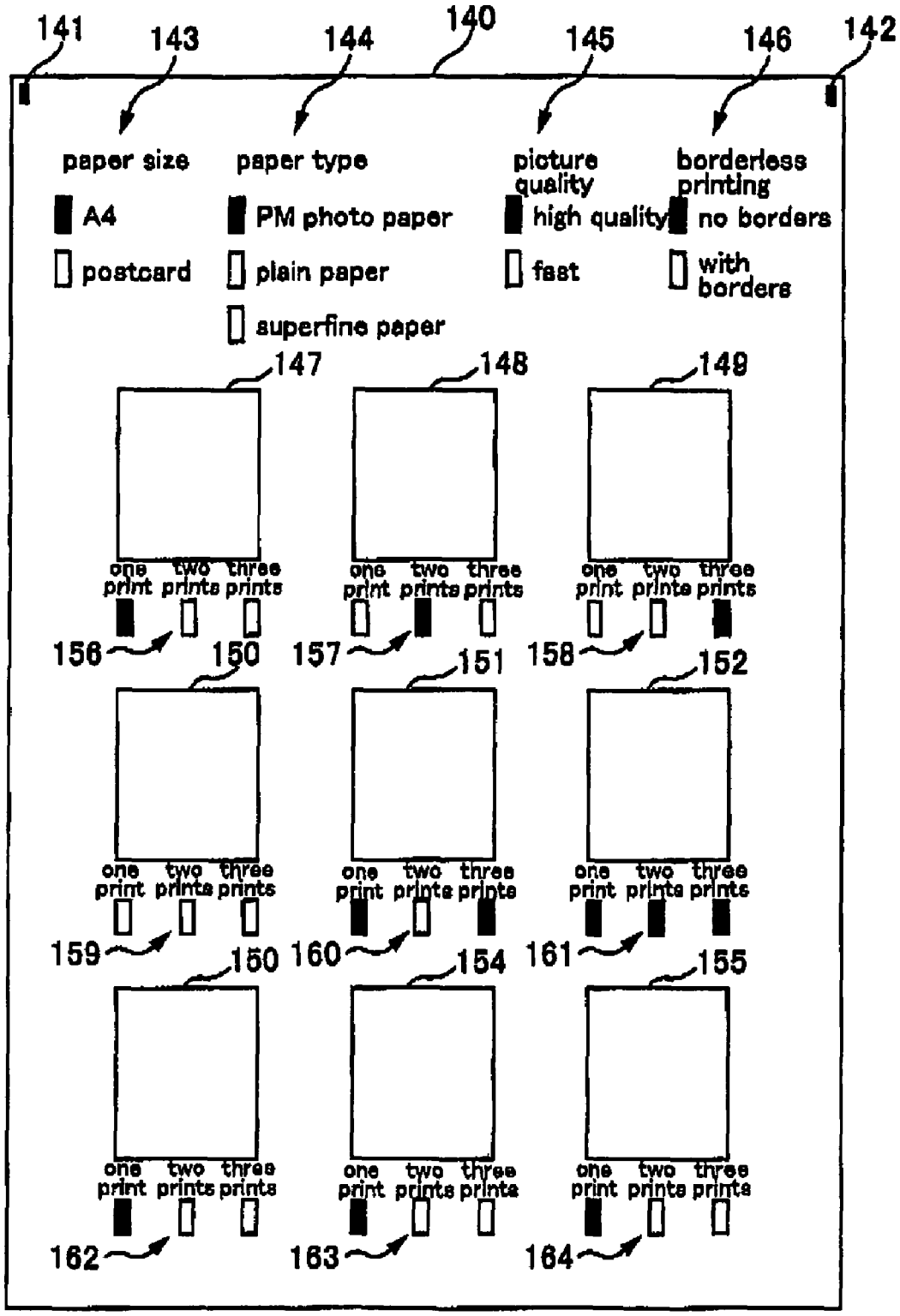

The user fills in the check boxes of the mark sheet for image printing 140 that is obtained through the above procedure, where necessary, using a writing instrument (such as a pencil). FIG. 7 shows an example of the mark sheet 140 after checks have been added by the user. In this example, in the check box 143 the check box on the "A4" side has been filled in, and thus "A4" is selected as the size of the print paper P.

In the check box 144, the check box on the "PM Photo Paper" side has been filled in, selecting "PM Photo Paper" as the type of print paper P. In the check box 145, the check box on the "high quality" side has been filled in, selecting "high quality" as the print quality. In the check box 146, the check box on the "borderless" side has been filled in, selecting "borderless printing" as the printing method.

Also, in the check box 156 that is printed below the thumbnail image 147, the check box corresponding to "one" has been filled in, selecting "one" as the number of prints of the image corresponding to the thumbnail 147. In the check box 157 that is printed below the thumbnail image 148, the check box corresponding to "two" has been filled in, selecting "two" as the number of prints of the image corresponding to the thumbnail 148. In the check box 158 that is printed below the thumbnail image 149, the check box corresponding to "three" has been filled in, selecting "three" as the number of prints of the image corresponding to the thumbnail 149.

In the check box 159 that is printed below the thumbnail image 150, none of the check boxes have been filled in, and thus "zero" is selected as the number of prints of the image corresponding to the thumbnail 150. In the check box 160 that is printed below the thumbnail image 151, the check box corresponding to "one" and the check box corresponding to "three" have been filled in, selecting "four," which is the result of adding "one" and "three," as the number of prints of the image corresponding to the thumbnail 151. In the check box 161 that is printed below the thumbnail image 152, all the check boxes have been filled in, selecting "six," which is the result of adding "one," "two" and "three," as the number of prints of the image corresponding to the thumbnail 152. It should be noted that since the check box corresponding to "one" has been filled in for the check boxes 162 to 164, "one" has been selected as the number of prints of the images corresponding to the thumbnail images 153 to 155.

<Reading the Mark Sheet>

Figure 8:
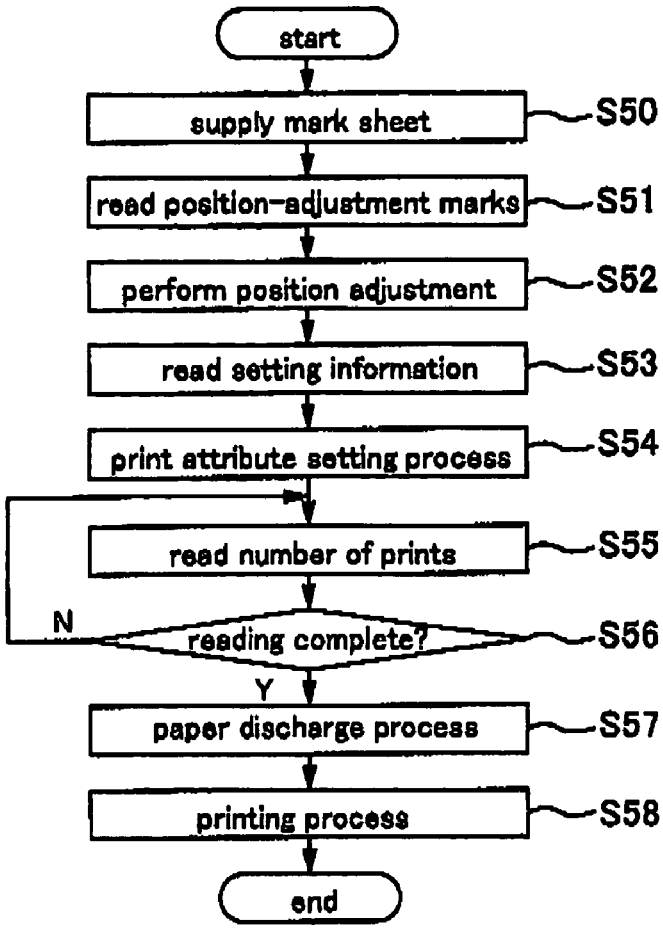
FIG. 8 is a flowchart for describing a process that is executed when the mark sheet shown in FIG. 7 has been read by the printing apparatus and images are printed.

Once checks have been added as above, the user sets the mark sheet 140 in the stocker of the paper supply section 132 of the printer 22 such that the printed face of the mark sheet 140 facing upward and the position-adjustment marks 141 and 142 facing down. The user then operates the control section 136 of the printer 22 to execute the process for reading the information written to the mark sheet for image printing 140. As a result, the procedure of the flowchart of FIG. 8 is executed. When the procedure of the flowchart has started, the following steps are executed.

Step S50: The CPU 41 of the control circuit 40 drives the paper feed motor 23 to execute the process for feeding of the mark sheet 140 for image printing loaded in the stocker. As a result, the mark sheet 140 is supplied to the printer 22 with its printed face facing the optical sensor 39 side of the carriage 31 and the side with the position-adjustment marks 141 and 142 in the front.

Step S51: The CPU 41 of the control circuit 40 drives the paper feed motor 23 by a predetermined amount to carry the mark sheet 140 in the carrying direction by a predetermined carry amount. Thus, the position-adjustment marks 141 and 142 of the mark sheet 140 are set to the same position as the optical sensor 39 as regards their position in the carrying direction, and are in a position where they can oppose the optical sensor 39. The CPU 41 of the control circuit 40 then drives the carriage motor 24 to move the carriage 31 in the movement direction, and the position-adjustment marks 141 and 142 are detected by referencing the output signals from the optical sensor 39.

Step S52: The CPU 41 of the control circuit 40 calibrates the reading position in correspondence with the position of the position-adjustment marks 141 and 142 detected in step S51. That is, the control circuit 40 has data indicating the position of the check boxes that are printed on the mark sheet 140, and corrects the detection position in the movement direction in correspondence with the detected position of the position-adjustment marks 141 and 142. For example, if the position-adjustment marks 141 and 142 are deviated to the right, then the mark sheet 140 has been fed deviated to the right, and thus the detection position is moved to the right by an amount that corresponds to that amount of deviation (that is, the control circuit 40 moves the position for sampling, which is described later, to the right).

Step S53: The CPU 41 of the control circuit 40 executes the process of reading the setting information of the mark sheet 140. That is, the CPU 41 reads the information indicating the position of the check boxes that is stored on the EEPROM 46, and while referencing this information, feeds the mark sheet 140 up to the positions where the check boxes 143 to 146 have been printed and moves the carriage 31 in the movement direction while monitoring the output of the output sensor 39.

Figure 9:
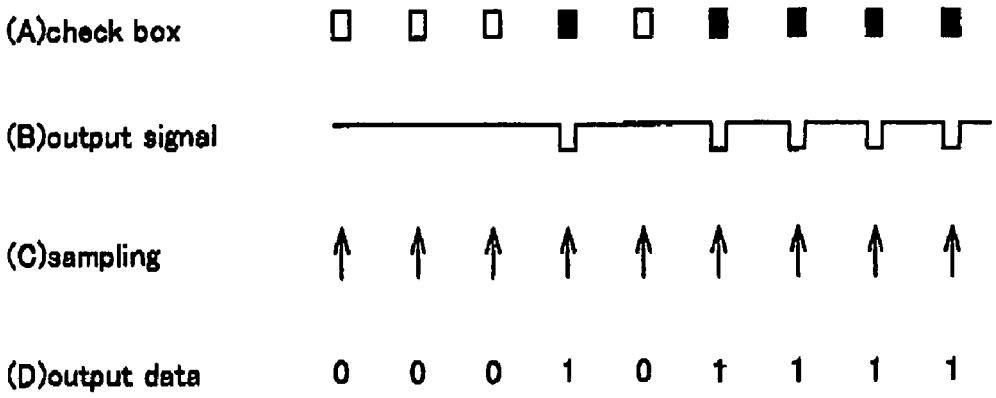
FIG. 9 is a diagram for describing the operation when reading the check boxes of the mark sheet shown in FIG. 7.

FIG. 9 is a diagram showing the relationship between the check state of the check boxes of the mark sheet 140 and the output data. If the check boxes are in the state shown in (A) of FIG. 9, then the output signal from the optical sensor 39 is like that shown in (B) of FIG. 9. That is, if the check box has been checked (filled in with a writing instrument), then the output signal is the state of "L," and if not filled in, then the output signal is the state of "H."

The CPU 41, as discussed above, recognizes the printed position of the check boxes in the movement direction based on information stored on the EEPROM 46. The CPU, 41 also detects the position of the carriage 31 based on the output from an encoder, which is not shown, provided in the carriage 31. Accordingly, the CPU 41 compares these and determines whether or not the optical sensor 39 is positioned above the check boxes. When the CPU 41 has determined that the optical sensor 39 is positioned above a check box, it samples the output signal from the optical sensor 39 (see (C) of FIG. 9), and if the signal level of that signal is "H," then the CPU 41 outputs "0" as the output data, and if the signal level is "L," then the CPU 41 obtains output data of "1" (see (D) of FIG. 9).

By performing the above operation for each check box, it is possible to obtain data corresponding to the checked state of each check box. The data row obtained in this manner is delivered to the CPU 41 as binary data such as "000101111."

Step S54: The CPU 41 of the control circuit 40 adjusts the settings of the printer 22 in accordance with the print attributes read in step S53. More specifically, in the case of the mark sheet 140 shown in FIG. 7, all of the check boxes on the uppermost level have been filled in, and thus "1111" is obtained, none of the check boxes of the next level have been filled in, and thus "0000" is obtained, and the check box on the lowest level is not filled in, and thus a "0" is obtained.

As a result, the CPU 41 selects "A4" as the paper size, and thus performs setting so that the image indicated by the print signals created by the printer becomes this size. Also, since the paper type is set to "PM Matte Paper," the CPU 41 performs color conversion (also known as white balance adjustment) to match this. Also, since "high quality" has been selected as the picture quality, the CPU 41 performs setting so that the resolution of the image is higher than if "fast printing" has been set as the image resolution during resolution conversion processing (or halftone processing) when the printer creates the print signals. Further, since "borderless printing" has been selected, the CPU 41 performs enlargement processing so that the image fills the print paper.

Step S55: The CPU 41 of the control circuit 40 executes a process for reading the number of prints of the images that have been marked on the mark sheet 140. That is, the CPU 41 feeds the mark sheet 140 up to the positions where the check boxes 156 to 158 are printed and monitors the output of the optical sensor 39 while moving the carriage 31 in the movement direction. The CPU 41 then detects the checked state of the check boxes by executing the same processing as above.

For example, in the case of the check box 156, the CPU 41 obtains the information of "one" as the number of prints because "100" is obtained as the output data. In the case of the check box 157, the CPU 41 obtains output data "010" and in the case of the check box 158 it obtains output data "001," and thus respectively obtains the information of "two" and "three" as the number of prints. In the case of the check box 159, the CPU 41 obtains the information of "zero" as the number of prints because "000" is obtained as the output data. In the case of the check box 160, the CPU 41 obtains "101" as the output data and thus obtains the information of "four" as the number of prints by adding "one" and "three". Also, in the case of the check box 161, the CPU 41 obtains "111" as the output data and thus obtains the information of "six" as the number of prints by adding "one," "two," and "three".

Step S56: The CPU 41 of the control circuit 40, when reading of the check boxes of one row is complete, determines whether or not reading of the information of the check boxes corresponding to the number of all of the images stored on the memory card 48 is complete. If it determines that reading is complete, then the procedure is advanced to step S57, and in the opposite case, the procedure is returned to step S55 and the same processing is repeated.

It should be noted that if information for all of the images stored on the memory card 48 has not been obtained even though reading of all of the check boxes of the mark sheet 140 is complete, then it is likely that the mark sheet has been printed over two or more sheets. Thus, in this case, a message or the like urging the user to insert the other mark sheet(s) is displayed on the display device 98 of the personal computer 90, for example.

Step S57: The CPU 41 of the control circuit 40 executes the process for discharging the mark sheet 140 for which reading is complete.

Step S58: The CPU 41 of the control circuit 40 executes the process for printing the same number of images as the number of prints of images read in step S55. In the example of the mark sheet 140 shown in FIG. 7, printing is carried out such that, on "A4" size "PM Matte Paper" at "high quality" and with "borderless printing," one print of the image corresponding to the thumbnail 147 and two prints of the image corresponding to the thumbnail 148 are printed, and this printing process is repeated until all the images have been printed.

According to the foregoing embodiment, a mark sheet 140 for image printing is printed by the printer 22, and by a user filling in necessary check boxes using a writing instrument, the print attributes and the number of prints can be set with ease.

Further, according to the foregoing embodiment, the state of the check boxes is ascertained using the optical sensor 39, which was originally provided for the purpose of paper end detection, and thus the manufacturing costs for the printer 22 can be kept low while its operability can be increased.

Also, in the foregoing embodiment, the number of prints of each image can be set using the check boxes, and thus it is possible to print a plurality of prints of the same image.

It should be noted that in the foregoing embodiment, check boxes indicating one, two, and three prints were used as the check boxes for designating the number of prints of an image, but it is also possible to use check boxes for a number of prints other than these (such as four or five prints).

Figure 10A:
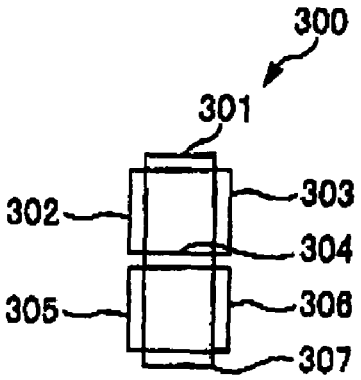
FIG. 10A is an explanatory diagram of an example of other check boxes for designating the number of prints of an image.
Figure 10B:
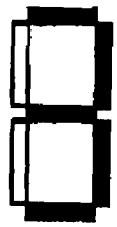

It is also possible to designate the number prints by using a check box such as that shown in FIG. 10A. That is, as shown in FIG. 10A, a check box 300 made of seven rectangles 301 to 307 is used to form numbers by filling in necessary rectangles, allowing the number of prints to be designated. FIG. 10B shows a case where the rectangles 301, 303, 304, 306, and 307 have been filled in to indicate the number "3."

Figure 10C:
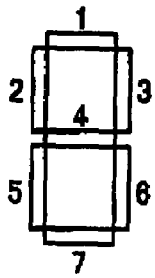
FIG. 10C is an explanatory diagram of the numbering of the check boxes.
Figures 11, 12:
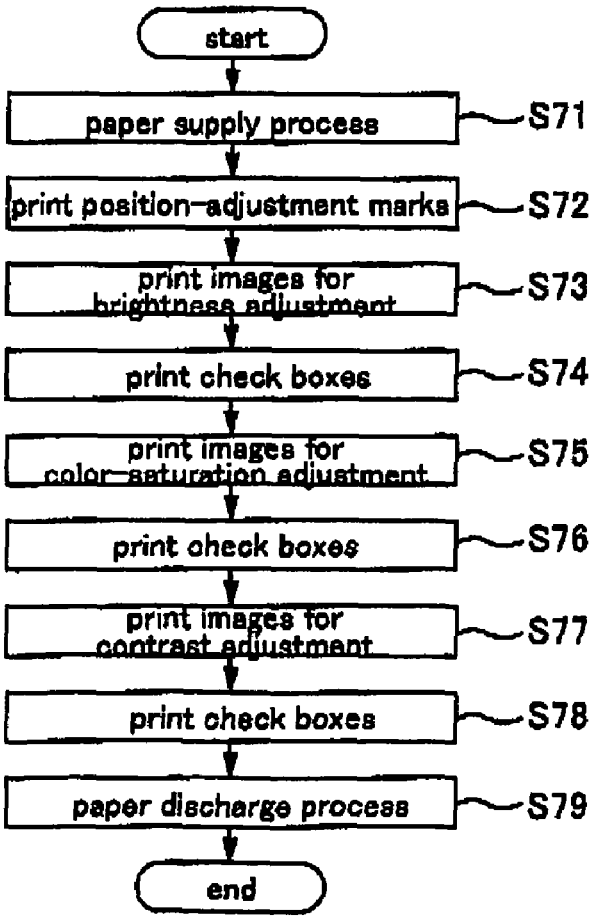
FIG. 11 is a diagram showing the relationship between the values expressed by the check boxes shown in FIG. 10 and the respective output data.
FIG. 12 is a flowchart for describing an example of a process that is executed when adjusting the print properties.

It should be noted that when reading information from such a check box 300, the information of the rectangles 301 to 307 is read in the order of the characters shown in the FIG. 10C, and by comparing this information with the table information shown in FIG. 11, information on the number can be obtained.

Figure 10D:
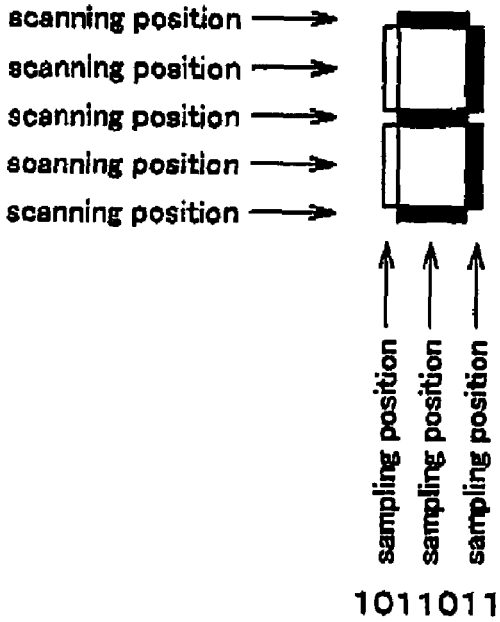
FIG. 10D is an explanatory diagram of the sampling positions.

More specifically, scanning using the optical sensor 39 is performed along the "scan positions" shown in FIG. 10D and the state of the rectangles 301 to 307 at the "sampling positions" is sampled. As a result, in the case of "3" for example, "1011011" is obtained as the output data. On the other hand, in the case of "0," output data of "0000000" is obtained, in the case of "1," output data of "0010010" is obtained, in the case of "2," output data of "1011101" is obtained, in the case of "4," output data of "0111010" is obtained, in the case of "5, " output data of "1101011" is obtained, in the case of "6," output data of "1101111" is obtained, in the case of "7," output data of "1010010" is obtained, in the case of "8," output data of "1111111" is obtained, and in the case of "9," output data of "1111011" is obtained.

With this method, it is possible to freely express any number from 0 to 9 by filling the rectangles as necessary. Also, since the rectangles that are filled in per se represent numbers, setting mistakes can be found with ease.

FIRST MODIFIED EXAMPLE OF THE FIRST EMBODIMENT

In the above embodiment, settings for the printer 22 are performed in accordance with the results of reading the check boxes 143 to 146 of the mark sheet. However, this is not a limitation. For example, it is also possible for a printer driver program installed on the personal computer 90 to be set in accordance with the results of reading the check boxes 143 to 146 of the mark sheet. In this case, the printer 22 sends the results of reading the mark sheet to the personal computer 90. The CPU 91 of the personal computer 90 sets the printer driver based on the reading results that are received. Also, the printer 22 sends the information on the images that have been selected for printing by filling in the mark sheet to the personal computer 90. The printer driver converts the image information that is received into print signals PS in accordance with the settings and transmits the print signals PS to the printer 22. As a result, the printer 22 can execute printing in accordance with the markings on the mark sheet.

SECOND MODIFIED EXAMPLE OF THE FIRST EMBODIMENT

In the foregoing embodiment, the CPU 41 of the control circuit 40 obtains image data stored on the memory card 48 and creates thumbnail images from the images that are obtained. However, this is not a limitation. If thumbnail image data is included in the image data of the memory card 48, then it is also possible for the CPU 41 of the control circuit 40 to obtain only the thumbnail image data stored on the memory card 48 and to print the mark sheet using the thumbnail image data that are obtained. In this case, the user fills in check boxes of a mark sheet, and after this mark sheet has been read, the CPU 41 of the control circuit 40 obtains the image data of the images to be printed from the memory card 48 based on the results of this reading and executes printing based on the image data that are obtained. It is thus possible to reduce the capacity of the printer memory.

Second Embodiment

The process when setting print properties such as the coloring of the images to be printed using a mark sheet is described next.

<Printing the Mark Sheet>

FIG. 12 is a flowchart for describing the process that is executed when adjusting print properties such as the coloring of the image. The procedure of this flowchart is executed when the control section 136 has been operated when adjusting the coloring etc. before printing an image. It should be noted that this procedure can also be executed when the input device 99 of the personal computer 90 has been operated.

When the procedure of this flowchart is started, the following steps are performed.

Step S71: The CPU 41 of the control circuit 40 performs the paper supply process for supplying a single sheet of print paper P stored in the stocker.

Step S72: The CPU 41 of the control circuit 40 prints position-adjustment marks on both edges of the front end portion of the print paper P.

Figure 13:
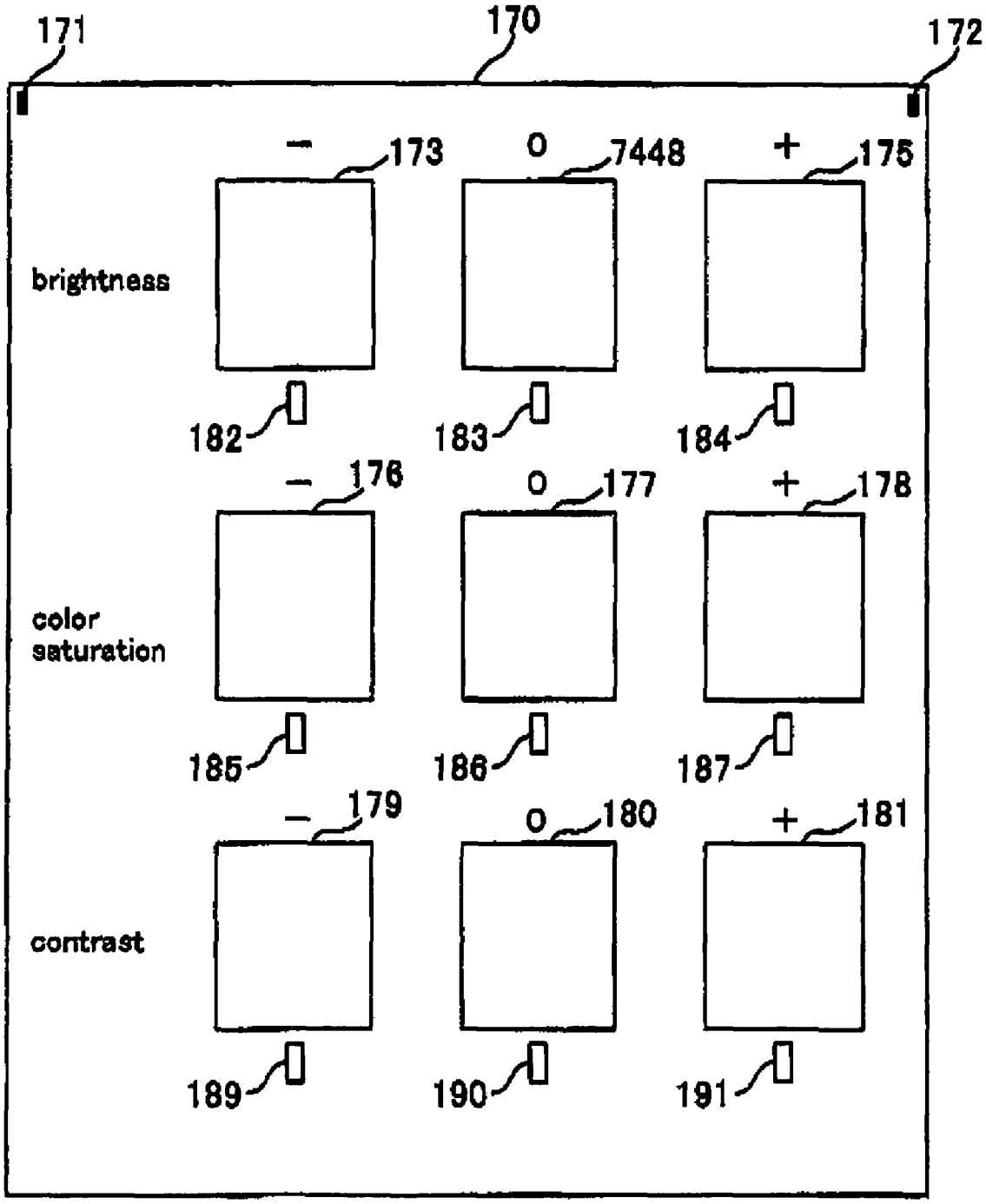
FIG. 13 is an example of the mark sheet that is printed as the result of executing the process of the flowchart shown in FIG. 12.

FIG. 13 shows an example of a check sheet 170 that is obtained as a result of the process of FIG. 12. In the process of step S72, position-adjustment marks 171 and 172 are printed on both edges of the front end portion (portion that is fed first to the printer 22) of the check sheet 170.

Step S73: The CPU 41 of the control circuit 40 prints an image for brightness adjustment. That is, the CPU 41 obtains an image for brightness adjustment from the EEPROM 44 and creates an image whose brightness has been adjusted downward, an original image whose brightness has not been adjusted, and an image whose brightness has been adjusted upward, and prints these on the print paper P in that order from left to right.

In the example of FIG. 13, images for brightness adjustment 173 to 175 are printed. The image 173 is the image whose brightness has been set low, the image 174 is the original image whose brightness has not been adjusted, and the image 175 is the image whose brightness has been set high. It should be noted that markings "−," "0," and "+" indicating how the brightness has been adjusted are printed immediately before or at the same time that the images 173 to 175 are printed.

Step S74: The CPU 41 of the control circuit 40 prints check boxes for brightness adjustment 182 to 184 below the images for brightness adjustment 173 to 175 that are printed in step S73.

Step S75: The CPU 41 of the control circuit 40 prints images for color-saturation adjustment 176 to 178 below the check boxes 182 to 184. That is, the CPU 41 obtains an image for color-saturation adjustment from the EEPROM 44 and creates an image whose color saturation has been adjusted downward, an original image whose color saturation has not been adjusted, and an image whose color saturation has been adjusted upward, and prints these on the print paper P in that order from left to right.

In the example of FIG. 13, images for color-saturation adjustment 176 to 178 are printed. The image 176 is the image whose color saturation has been Bet low, the image 177 is the original image whose color saturation has not been adjusted, and the image 178 is the image whose color saturation has been set high. It should be noted that, as mentioned above, markings "−," "0," and "+" indicating how the brightness has been adjusted are printed immediately before or at the same time that the images 176 to 178 are printed.

Step S76: The CPU 41 of the control circuit 40 prints check boxes for color-saturation adjustment 185 to 187 below the images for color-saturation adjustment 176 to 178 that are printed in step S75.

Step S77: The CPU 41 of the control circuit 40 prints images for contrast adjustment 179 to 181 below the check boxes 185 to 187. That is, the CPU 41 obtains an image for contrast adjustment from the EEPROM 44 and creates an image whose contrast has been adjusted downward, an original image whose contrast has not been adjusted, and an image whose contrast has been adjusted upward, and prints these on the print paper P in that order from left to right.

In the example of FIG. 13, images for contrast adjustment 179 to 181 are printed. The image 179 is the image whose contrast has been set low, the image 180 is the original image whose contrast has not been adjusted, and the image 181 is the image whose contrast has been set high. It should be noted that, as mentioned above, markings "–," "0," and "+" indicating how the brightness has been adjusted are printed immediately before or at the same time that the images 179 to 181 are printed.

Step S78: The CPU 41 of the control circuit 40 prints check boxes for contrast adjustment 189 to 191 below the images for contrast adjustment 179 to 181 that are printed in step S77.

Step S79: The CPU 41 of the control circuit 40 performs the process for discharging the print paper P, that is, the mark sheet 170, for which printing has been completed.

<Filling in the Mark Sheet>

When printing of the mark sheet 170 is finished as above, the user selects the image with the most suitable brightness from among the images 173 to 175 printed on the mark sheet 170, and uses a writing instrument to fill in the check box that corresponds to the selected image from among the check boxes 182 to 184.

Similarly, the user selects the image with the most suitable color saturation from among the images 176 to 178, and uses a writing instrument to fill in the check box that corresponds to the selected image from among the check boxes 185 to 187. Also, the user selects the image with the most suitable contrast from-among the images 179 to 181, and uses a writing instrument to fill in the check box that corresponds to the selected image from among the check boxes 189 to 191.

<Reading the Mark Sheet>

Figure 14:
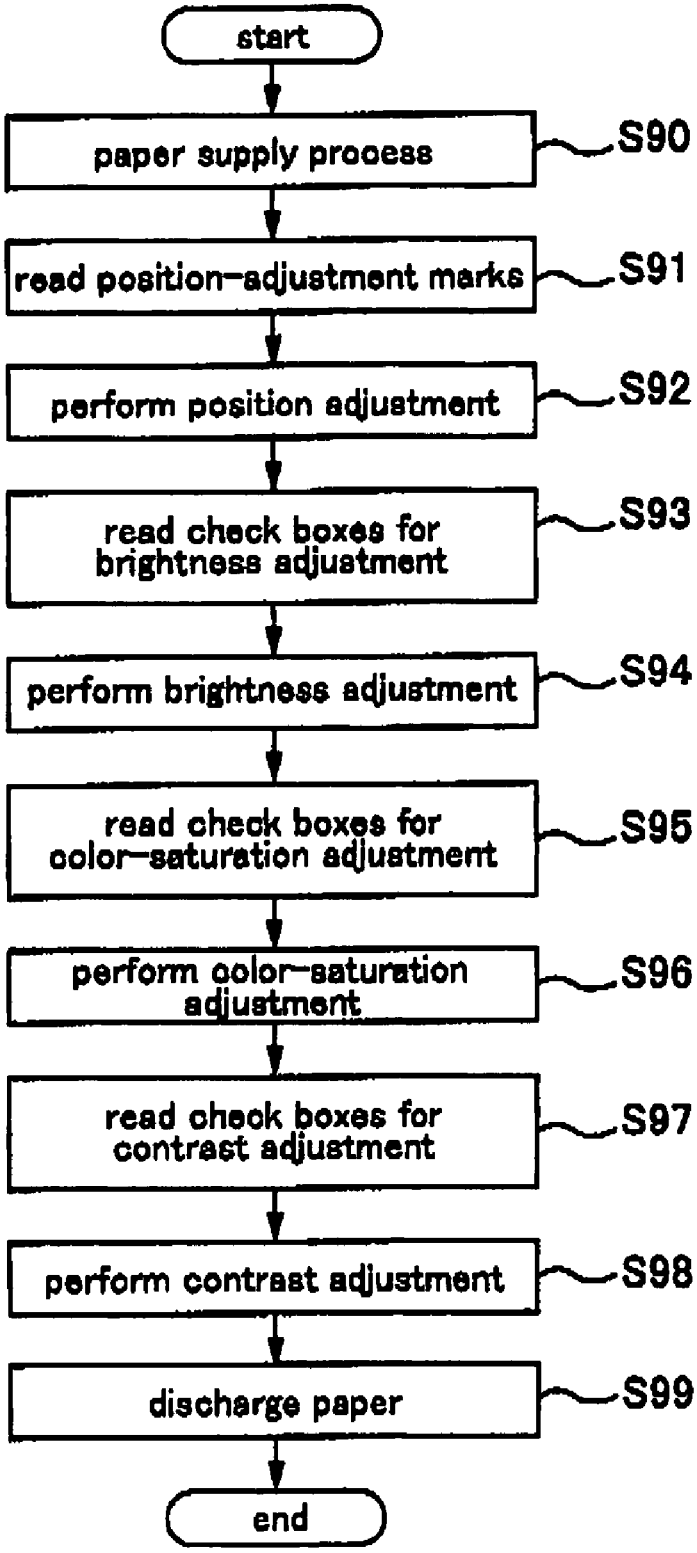
FIG. 14 is a flowchart for describing the process that is executed in a case where the mark sheet shown in FIG. 12 is read by the printing apparatus to set the print properties.

When checking has been completed as above, the user places the mark sheet 170 in the stocker of the paper supply section 132 with its printed face facing upward and the position-adjustment marks 171 and 172 in the direction that is fed first. The user then operates the control section 136 of the printer 22 to execute the process of reading the information written to the mark sheet for image printing 170. As a result, the procedure of the flowchart of FIG. 14 is executed. When the procedure of the flowchart is started, the following steps are executed.

Step S90: The CPU 41 of the control circuit 40 drives the paper feed motor 23 to execute the process of supplying the mark sheet for image printing 170 loaded in the stocker. As a result, the mark sheet 170 is fed to the printer 22 with its printed face facing the optical sensor 39 side of the carriage 31 and its side with the position-adjustment marks 171 and 172 in the front.

Step S91: The CPU 41 of the control circuit 40 drives the paper feed motor 23 by a predetermined amount to carry the mark sheet 170 in the carrying direction by a predetermined carry amount. Thus, the position-adjustment marks 171 and 172 of the mark sheet 170 are set to the same position as the optical sensor 39 as regards their position in the carrying direction, and are in a position where they can oppose the optical sensor 39. The CPU 41 of the control circuit 40 then drives the carriage motor 24 to move the carriage 31 in the scanning direction, and the position-adjustment marks 171 and 172 are detected referencing the output signals from the optical sensor 39.

Step S92: The CPU 41 of the control circuit 40 calibrates the reading position in correspondence with the position of the position-adjustment marks 171 and 172 detected in step S91. That is, the control circuit 40 has data indicating the position of the check boxes that are printed on the mark sheet 170, and corrects the detection position in the movement direction in correspondence with the detected position of the position-adjustment marks 171 and 172. For example, if the position-adjustment marks 171 and 172 are deviated to the right, then the mark sheet 170 has been fed deviated to the right, and thus the detection position is moved to the right by an amount that corresponds to that amount of deviation (that is, the control circuit 40 moves the position for sampling to the right).

Step S93: The CPU 41 of the control circuit 40 executes the process of reading the information written to the check boxes 182 to 184 for brightness adjustment of the mark sheet 170.

Step S94: The CPU 41 of the control circuit 40 adjusts the brightness of the printer driver program according to the information read in step S93. For example, if the check box 182 has been checked, then the settings of the printer driver program are adjusted to lower the brightness.

Step S95: The CPU 41 of the control circuit 40 executes the process of reading the information written to the check boxes 185 to 187 for color saturation adjustment of the mark sheet 170.

Step S96: The CPU 41 of the control circuit 40 adjusts the color saturation of the printer driver program according to the information read in step S95. For example, if the check box 187 has been checked, then the settings of the printer driver program are adjusted so that the color saturation is increased.

Step S97: The CPU 41 of the control circuit 40 executes the process of reading the information written to the check boxes 189 to 191 for contrast adjustment of the mark sheet 170.

Step S98: The CPU 41 of the control circuit 40 adjusts the contrast of the printer driver program according to the information read in step S97. For example, if the check box 190 has been checked, then the settings of the printer driver program are adjusted so that the contrast stays as it is.

Step S99: The CPU 41 of the control circuit 40 executes the process for discharging the mark sheet 170 for which reading is complete.

When adjusting is complete, the images that are printed thereafter are automatically adjusted so that their brightness, color saturation, and contrast match these settings. That is, the printer driver performs conversion processing (more specifically, color conversion processing) for converting the image data into print signals in accordance with the brightness, color saturation, and contrast, for example, that have been set. Thus, when the printer executes printing using these print signals, the printer can print high quality images that correspond to the adjustments that have been made.

It should be noted that if, after adjustments have been made and the images are actually printed, the user feels that it is necessary to readjust the brightness, color saturation, and contrast, then the same processing as in the above case can be performed again to obtain images with even higher quality.

Through the above processing, by filling in the check boxes after referring to images that have actually been printed, it is possible to easily adjust the settings for the conversion processing for converting the image data into print signals (the settings for the print properties related to the "look" of the image), such as the settings for the brightness, color saturation, and contrast.

Adjustment of the picture quality can also be performed through displaying the image on the display device 98 of the personal computer 90, but because the way an image appears on the display device 98 is different from how the printed image appears, the picture quality can be more accurately adjusted by actually printing out the image.

It should be noted that the foregoing embodiment was described using brightness, color saturation, and contrast as examples, but in addition to these it is also possible to adjust the balance of the colors such as C, M, and Y. With such an embodiment, it is possible to correct the color balance by, for example, setting C low if C has been printed strong.

FIRST MODIFIED EXAMPLE OF THE SECOND EMBODIMENT

In the foregoing embodiment, the user operates the control panel 136 of the printer to start the procedure for printing the mark sheet. However, this is not a limitation. It is also possible for the user to start the procedure for printing the mark sheet by operating the input device 99 of the personal computer 60.

Also, in the foregoing embodiment, when printing the images for brightness adjustment, for example, the CPU 41 of the control circuit 40 obtains an image that is stored on the EEPROM 44 in advance. However, this is not a limitation. For example, it is also possible to obtain the image to be printed from the personal computer 90. By doing this, it is possible for the user to confirm the brightness using an image that he/she intends to print.

SECOND MODIFIED EXAMPLE OF THE SECOND EMBODIMENT

In the foregoing embodiment, the settings of the printer driver were adjusted (the brightness during color conversion with the printer driver was adjusted) according to the results of reading the check boxes 182 to 184 of the mark sheet 170. However, this is not a limitation. For example, it is also possible for the settings of the printer to be adjusted in accordance with the results of reading the check boxes 182 to 184 of the mark sheet 170. In this case, the printer converts the image data into print signals in accordance with the brightness etc. that has been set, and executes printing based on these print signals.

Third Embodiment

The process when setting other print properties of the printer 22 is described next.

<Printing the Mark Sheet>

Figure 15:
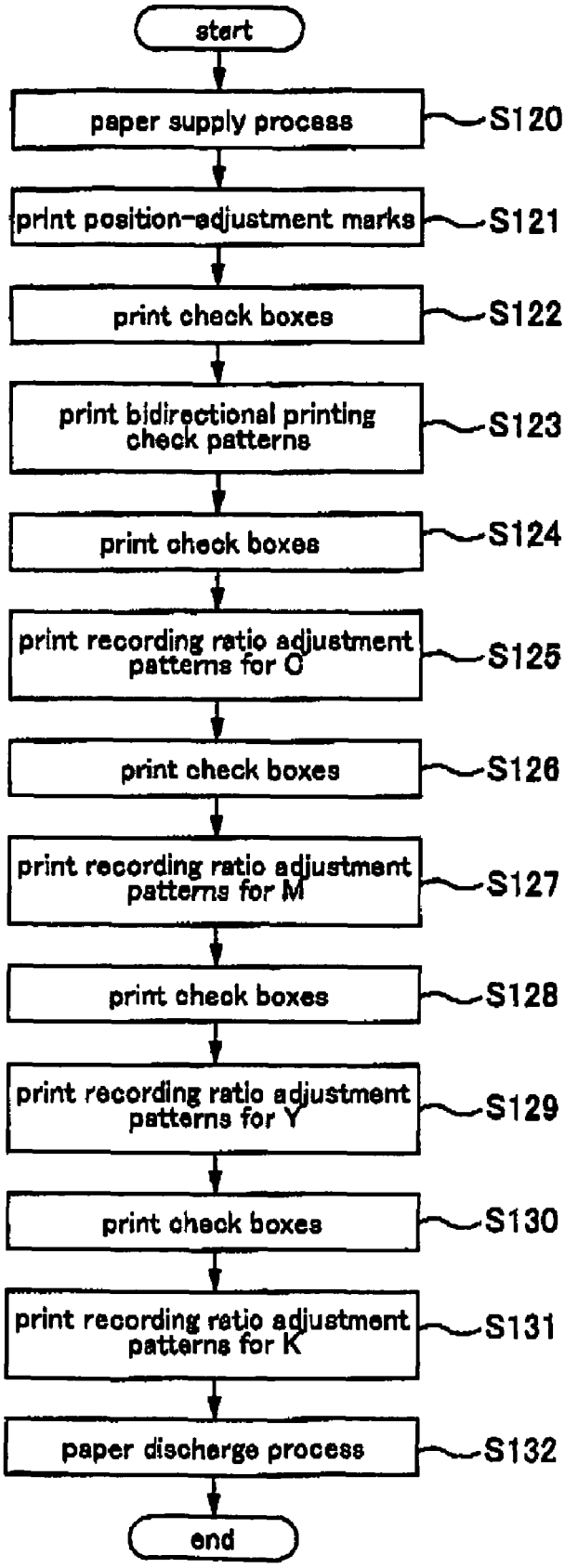
FIG. 15 is a flowchart for describing an example of the process that is executed when adjusting the other print properties.

FIG. 15 is a flowchart for describing an example of the process that is executed when setting other print properties of the printer 22. The procedure of this flowchart is started when an operation for requesting that other print properties of the printer 22 are set is made through the input device 99 of the personal computer 90 or the control section 136 of the printer 22

When the procedure of this flowchart is started, the following steps are performed.

Step S120: The CPU 41 of the control circuit 40 performs the paper supply process of supplying a single sheet of the print paper P stored in the stocker.

Step S121: The CPU 41 of the control circuit 40 prints position-adjustment marks on both edges of the front end portion of the print paper P.

Figure 16:
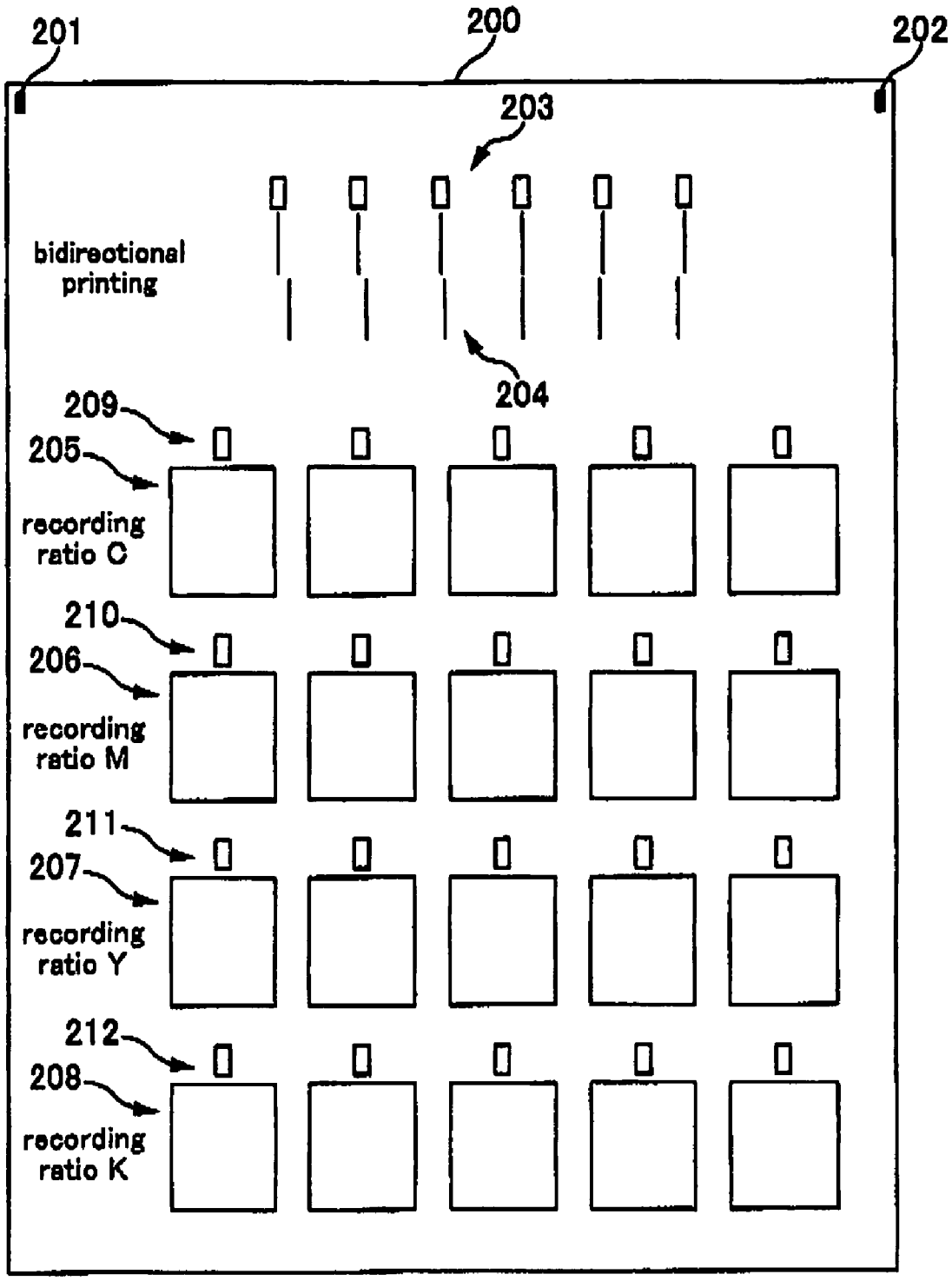
FIG. 16 is an example of the mark sheet that is printed as the result of executing the process of the flowchart shown in FIG. 15.

FIG. 16 shows an example of a mark sheet 200 that is obtained as a result of the process shown in FIG. 15. In the process of step S121, position-adjustment marks 201 and 202 are printed on both edges of the front end portion (portion that is fed to the printer 22 first) of the mark sheet 200.

Step S122: The CPU 41 of the control circuit 40 prints a check box 203 for aligning the print positions during bidirectional printing. It should be noted that bidirectional printing is a method of printing in which ink is ejected in both the forward pass and the return pass of the carriage 31. In bidirectional printing, the resolution of the image drops when the positions where ink droplets land in the forward pass and the return pass are misaligned, and thus it is necessary that this is corrected.

Step S123: The CPU 41 of the control circuit 40 prints a bidirectional print check pattern 204 after performing paper feed control. More specifically, the CPU 41 first draws ruled lines having a predetermined length at a predetermined interval in the forward pass. Then, in the return pass it prints a plurality of ruled lines so that each ruled line forms a pair with a ruled line printed earlier, while correcting their print positions so that each pair is shifted in predetermined increments. The result is that, as shown in FIG. 16, a plurality of ruled line pairs each having a different amount of misalignment are printed.

Step S124: The CPU 41 of the control circuit 40 prints a check box 209 for adjusting the dot recording ratio of C (cyan) ink, as discussed later.

Figure 17A:
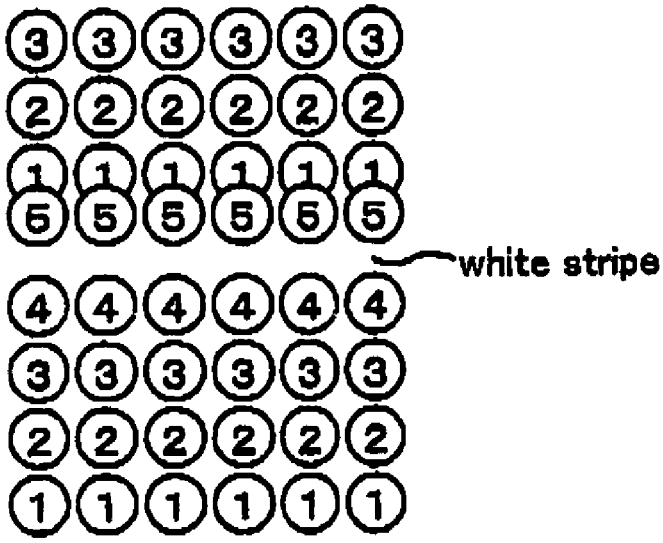
FIG. 17A is an explanatory diagram showing how banding occurs.

Step S125: The CPU 41 of the control circuit 40 prints a dot recording ratio adjustment pattern for C (cyan) after performing paper feed control. Here, the "dot recording ratio" means the proportion of pixels that are formed by dots among the pixels within a uniform region that is reproduced according to a constant graduation value. In general, there are instances in which the ink that is ejected from the nozzles provided in the print head 12 is deviated in the ejection direction due to error when forming the nozzles. In such cases, the result is that banding such as so-called "white stripes" or "black stripes" occurs in the printed image. FIG. 17A is a diagram showing the manner in which the dots are arranged when banding has occurred. In this diagram, the circles indicate the dots that are formed on the print paper P, and the numbers within the circles indicate the nozzle number of the nozzle from which that dot is ejected. In this example, the ink ejected by the fifth nozzle is deviated upward in the drawing, and thus a white stripe occurs between the fifth dot row and the fourth dot row.

Figure 17B:
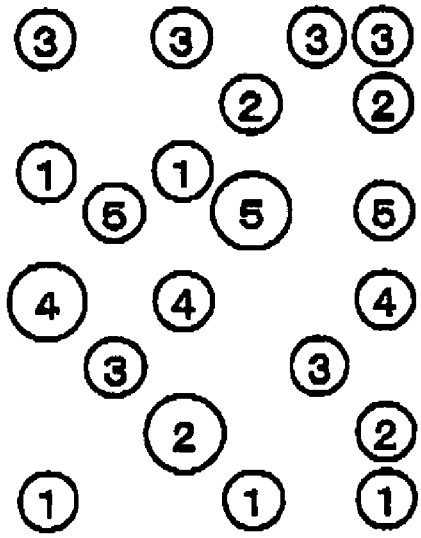
FIG. 17B is an explanatory diagram showing how banding is eliminated in a case where the dot recording ratio of small dots is lowered and the dot recording ratio of medium dots is raised.

This banding becomes conspicuous when performing solid-filled printing using dots of the same size, and thus by randomly changing the size of the dots when printing, this can be kept from standing out. FIG. 17B is shows how the dots are arranged when printing is performed changing the dot size in a case where the ink droplets that are ejected from the fifth nozzle include deviation as in FIG. 17A. In this example, medium sized dots are included in the printing, and thus the white stripe no longer stands out.

Figure 18:
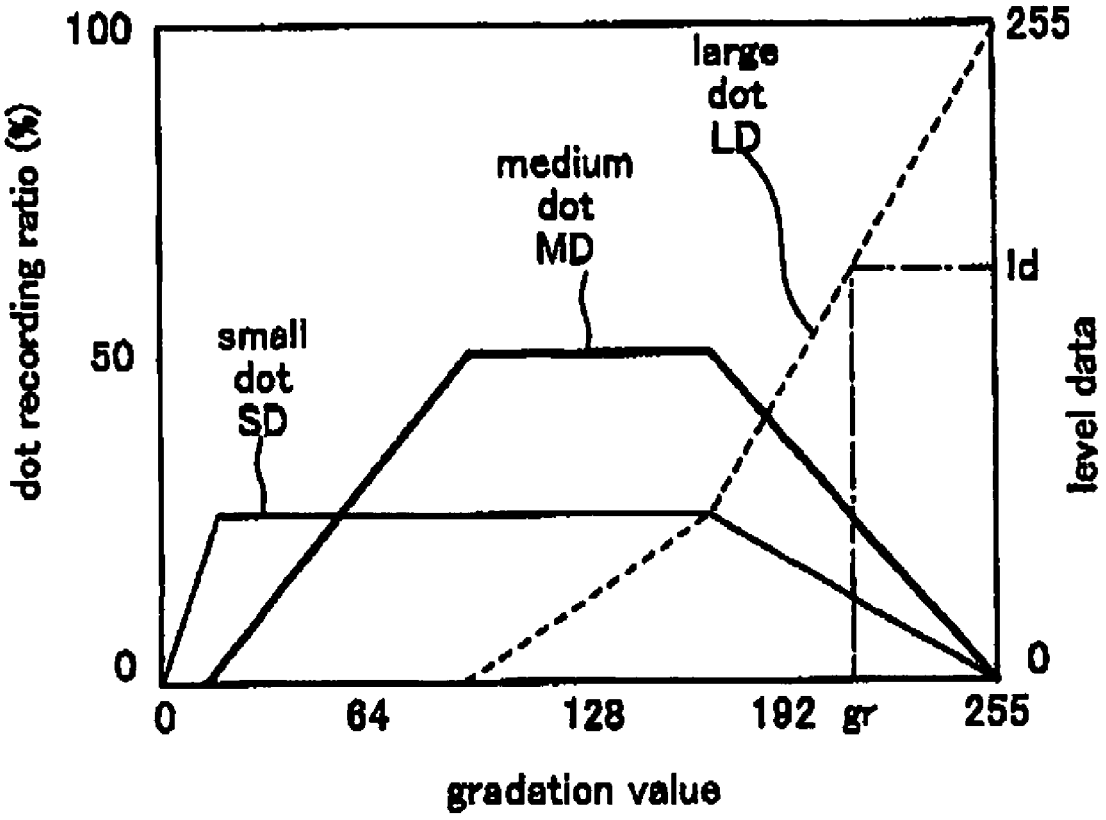
FIG. 18 is a diagram showing the relationship between the gradation value and the dot recording ratio.

In a case where actual printing of the image is performed, printing is executed by randomly selecting large, medium, and small sized dots according to the gradation value of the image so that the dot recording ratio is within a predetermined range. FIG. 18 is a diagram showing a dot recording table that is employed when selecting these large, medium, and small dots. The horizontal axis of FIG. 18 is the gradation value (0 to 255), the vertical axis on the left side is the dot recording ratio (%) and the vertical axis on the right Bide is the level data (0 to 255). The profile SD shown by the thin solid line in FIG. 18 indicates the recording ratio of the small dots, the profile MD shown by the thick solid line indicates the recording ratio of the medium dots, and the profile LD shown by the dashed line indicates the recording ratio of the large dots.

The "level data" means data in which the dot recording ratio has been converted into 256 levels from 0 to 255.

For example, as shown in FIG. 18, if gr is the gradation value of the multi-gradation data, then the large dot recording ratio is found to be ld using the profile LD. The dot recording ratio is determined in the same way for the other dot sizes as well.

Incidentally, if banding becomes conspicuous when the recording ratio has been increased for dots of a particular size, then it is possible to keep banding from occurring by raising the dot recording ratio of the dots of one size larger and lowering the dot recording ratio of the dots of that particular size. For example, when banding is noticeable after the dot recording ratio of the small dots has been raised, then by lowering the dot recording ratio of the small dots and raising the dot recording ratio of the medium dots, it is possible to keep banding from occurring.

Accordingly, in the present embodiment, for example, for a specific ink, the image is printed using small dots while changing the dot recording ratio to specify the dot recording ratio at which banding becomes noticeable, and then, at that dot recording ratio, correction is performed by raising the dot recording ratio of the medium dots and lowering the dot recording ratio of the small dots.

For example, in the example of step S125, five solid-filled pattern images are printed using small dots of C (cyan) while gradually increasing the dot recording ratio, printing the dot recording ratio adjustment patterns 205. Here, the dot recording ratios of the five dot recording ratio adjustment patterns are, in order from the left, 15%, 20%, 25%, 30%, and 35%.

Step S126: The CPU 41 of the control circuit 40 prints check boxes 210 for adjusting the dot recording ratio of M (Magenta) ink.

Step S127: The CPU 41 of the control circuit 40 prints the images 206 for adjusting the dot recording ratio of the M (Magenta) ink.

Step S128: The CPU 41 of the control circuit 40 prints check boxes 211 for adjusting the dot recording ratio of Y (Yellow) ink.

Step S129: The CPU 41 of the control circuit 40 prints the images 207 for adjusting the dot recording ratio of the Y (Yellow) ink.

Step S130: The CPU 41 of the control circuit 40 prints check boxes 212 for adjusting the dot recording ratio of K (Black) ink.

Step S131: The CPU 41 of the control circuit 40 prints the images 208 for adjusting the dot recording ratio of the K (Black) ink.

Step S131: The CPU 41 of the control circuit 40 performs the process of discharging the print paper P for which printing is complete.

A mark sheet 200 such as that shown in FIG. 16 is completed due to the above process.

<Filling in the Mark Sheet>

The user references the bidirectional printing check patterns 204 that are printed on the mark sheet 200 and fills in the check box corresponding to the ruled line pair forming the straightest line. In the example of FIG. 16, the third ruled line pair from the right forms the straightest line, and thus a check is added to the third check box from the right.

It should be noted that in the above example, a single check box is printed for each ruled line pair, but it is possible to print a check box also between the ruled line pairs as well, and in a case where there is no ruled line pair that is closest, to select the check box between ruled line pairs.

Next, the user refers to the dot recording ratio adjustment patterns 205 for C (cyan), and if there is a pattern in which banding has occurred, then the user fills in the check box corresponding to that pattern. It should be noted that a check is not added if banding has not occurred. Here, the check boxes corresponding to the dot recording ratio adjustment patterns 205 where the dot recording ratio is 30% and 35% are to be filled in.

Similarly, whether or not banding has occurred is confirmed for the dot recording adjustment patterns 206 to 208 for M (Magenta), Y (Yellow) and K (Black), and if banding has occurred, a check is added to that check box of the check boxes 210 to 212.

<Reading the Mark Sheets

Figure 19:
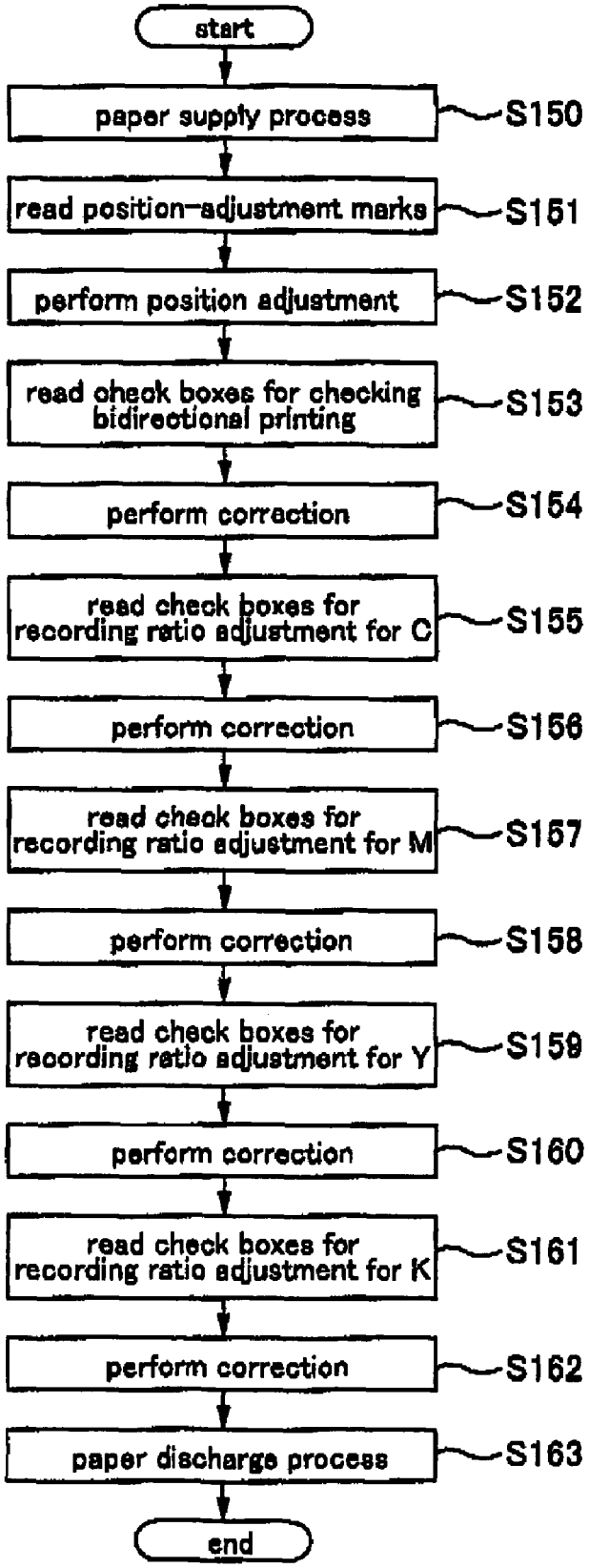
FIG. 19 is a flowchart for describing the process that is executed when the mark sheet shown in FIG. 16 is read by the printing apparatus to set the print properties.

After checks have been added to the mark sheet 200 as above, the user sets the mark sheet 200 in the stocker of the paper supply section 132 with its printed face facing upward and the position-adjustment marks 201 and 202 in the direction that is fed into the printer 22 first. The user then operates the control section 136 of the printer 22 to execute the process of reading the information written to the mark sheet 200 for image printing. As a result, the procedure of the flowchart shown in FIG. 19 is started. When the procedure of this flowchart is started, the following steps are performed.

Step S150: The CPU 41 of the control circuit 40 drives the paper feed motor 23 to execute the process of supplying of the mark sheet 200 stored in the stocker.

Step S151: The CPU 41 of the control circuit 40 reads the position-adjustment marks 201 and 202.

Step S152: The CPU 41 of the control circuit 40 carries out the positioning process in the same manner as the case shown in step S52 of FIG. 8.

Step S153: The CPU 41 of the control circuit 40 reads the checked state of the check boxes for assessing bidirectional printing.

Step S154: The CPU 41 of the control circuit 40 performs correction of the printing positions during bidirectional printing based on the information that is read in step S153. That is, in the example of FIG. 16, a check box has been added to the third check box from the right, and thus the correction amount that is used when printing the third ruled line pair from the right is set as the correction amount for bidirectional printing. As a result, the positions of the dots that are printed in the forward pass and the return pass during bidirectional printing accurately match one another.

Step S155: The CPU 41 of the control circuit 40 reads the checked state of the check boxes 209 for C. Here, a check has been added to the check box furthest right and the check box second from the right, and thus "00011" is obtained as output data.

Step S156: The CPU 41 of the control circuit 40 corrects the recording ratio table according to the results of the reading performed in step S155. From the reading results of output data of "00011" it can be understood that banding occurs when the recording ratio of small dots is 30%, and thus the recording ratio table is corrected such that medium dots start to be printed before the recording ratio of the small dots becomes 30%. That is, the recording ratio table is corrected so that the small dot recording ratio does not become 30%. Consequently, the occurrence of banding can be reduced if the image data are converted to print signals in accordance with the recording ratio table.

Step S157: The CPU 41 of the control circuit 40 reads the checked state of the check boxes 210 for M.

Step S158: The CPU 41 of the control circuit 40 executes the process for correcting the dot recording ratio of the M dots according to the checked state of the check boxes that has been read in step S157.

Step S159: The CPU 41 of the control circuit 40 reads the checked state of the check boxes 211 for Y.

Step S160: The CPU 41 of the control circuit 40 executes the process for correcting the dot recording ratio of the Y dots according to the checked state of the check boxes that has been read in step S159.

Step S161: The CPU 41 of the control circuit 40 reads the checked state of the check boxes 212 for K.

Step S162: The CPU 41 of the control circuit 40 executes the process for correcting the dot recording ratio of the K dots according to the checked state of the check boxes that has been read in step S161.

Step S163: The CPU 41 of the control circuit 40 executes the process for discharging the mark sheet 200 when reading is complete.

According to the above process, the printing positions in the forward pass and the return pass during bidirectional printing can be easily adjusted by filling in the check boxes 203.

Also, as regards the dot recording ratio for each of the colors, by checking the check boxes 209 to 212 while referencing the images 205 to 208 that are actually printed, it is possible to correct the dot recording ratio easily and in correspondence to the actual look.

Also, so-called stand-alone devices with which printing is possible using only a printer 22 without using a personal computer have appeared in recent years, and even in the case of such stand-alone devices, it is possible to appropriately and easily set the various print properties without connecting to a personal computer.

It should be noted that the above embodiment was explained using small dots and medium dots as an example, but the same adjustments can be made for medium dots and large dots as well.

MODIFIED EXAMPLE OF THE THIRD EMBODIMENT

In the foregoing embodiment, the user marked checks to all the check boxes corresponding to the dot recording ratio adjustment patterns in which banding has occurred. However, this is not a limitation. It is also possible for the user to add a check to a single check box only. Also, for example, in step S155 it is possible for the CPU 41 of the control circuit 40 to read the checked state of the check boxes 209 for C to obtain "00100" as output data. Then, in step S156, the CPU 41 of the control circuit 40 executes the correction processing according to the checked state of the check box read in step S155. That is, if there is a check box to which a check has been added, then the recording ratio of the small dots corresponding to that check box is reduced and the recording ratio of the medium dots is increased. For example, if a check has been added to the third check box from the left, then the recording ratio of the small dots when printing the third image from the left is reduced and the recording ratio of the medium dots is increased. As a result, small dots are replaced by medium dots, and thus the occurrence of banding can be reduced.

OTHERS

Embodiments of the present invention are described above, but various modifications other than these can be made to the present invention. For example, in the foregoing embodiments, rectangular check boxes were used, but it is also possible to use oval or circular, for example, check boxes instead. It is also possible to provide the optical head 39 on a reciprocating movement member such as the drive belt 36, instead of on the print head.

It is also possible to print a code (such as a bar code) for identifying the type of the mark sheet on the mark sheets 140, 170, and 200 so as to determine which mark sheet has been inserted. According to such an embodiment, even if an incorrect mark sheet is inadvertently inserted, it is possible to keep that mark sheet from being incorrectly recognized.

Also, in the above embodiments, information indicating the position of the check boxes is stored on the EEPROM 46, but it can also be stored on the P-ROM 43 or the HDD 94 of the personal computer 90, for example.

It is also possible to print a mark or code (such as a bar code) indicating that a check box is present near the check boxes, and only when that mark or code has been detected for the information of the check box that is subsequently detected to be read. According to such an embodiment, the information written in the check boxes can be read reliably.

In the foregoing embodiment, paper size, paper type, picture quality, and borderless printing were described as examples of the print attributes, but it is also possible to set other print attributes (such as the layout of the images if a plurality of images are to be printed on a single print paper P).

In a foregoing embodiment, brightness, color saturation, contrast, the printing positions in the forward pass and the return pass during bidirectional printing, and the recording ratio were described as examples of the print properties, but it is also possible to set other print properties (such as the carry amount (paper feed amount) in the carrying direction) as well.

Also, in the foregoing embodiments, the four colors of CMYK were used for the ink, but in place of these four colors, or in addition to these four colors, it is also possible to use light-colored inks (light cyan (LC), light magenta (LM), dark yellow (DY)).

Also, in the foregoing embodiments, a printer 22 provided with a head for ejecting ink using piezo elements is employed, but it is also possible to adopt various ejection drive elements other than piezo elements. For example, the present invention can also be adopted for printers provided with ejection drive elements of a type that eject ink through bubbles generated within the ink path by passing a current through a heater disposed in the ink path. It is of course also possible to adopt the present invention for so-called laser printers and the like.

Furthermore, in the above embodiments, the process discussed is executed by executing a program stored on the printer 22. However, it is also possible to store a program having similar functions on the HDD 44 of the personal computer 90, and for the above processing to be executed by this program. In this case, the printer 22 is the printing apparatus. It is also possible to execute the above processing split between the personal computer 90 and the printer 22. More specifically, it is possible to store the entire above processing on the P-ROM 43 of the printer 22 or to store only some of that processing on the P-ROM 43 of the printer 22.

It should be noted that the program in which the processing information is written can be stored on a computer-readable storage medium. Examples of a computer-readable storage medium include magnetic recording devices, optical disks, magneto optic recording media, and semiconductor memories. Magnetic recording devices include hard disk drives (HDD), flexible disks (FD), and magnetic tapes. Examples of optical disks include DVDS, DVD-RAMs (Random Access Memory), CD-ROMS, and CD-R (Recordable)/Rw (ReWritable) disks. Magneto optic recording media include MOs.

If the program is to be distributed, then for example transportable recording media such as DVDs or CD-ROMs storing the program will be sold commercially. It is also possible to store the program on the storage device of a server computer and to transfer the program from the server computer to other computers over a network.

A computer for executing the program stores the program that is stored on a transportable recording medium or the program that is transferred from the server computer on its own memory device. Then, the computer reads the program from its own memory device and executes processing in accordance with the program. It should be noted that it is also possible for the computer to read the program directly from the transportable recording medium and to execute processing in accordance with the program. It is also possible for the computer to consecutively execute processing in accordance with the obtained program each time the program is transferred from a server computer.

With the present embodiments it is possible to easily and quickly make various settings of the printing apparatus.

Fourth Embodiment

First, an overview of the printing apparatus according to the fourth embodiment of the present invention is described with reference to FIG. 20 and FIG. 21.

Figure 20:
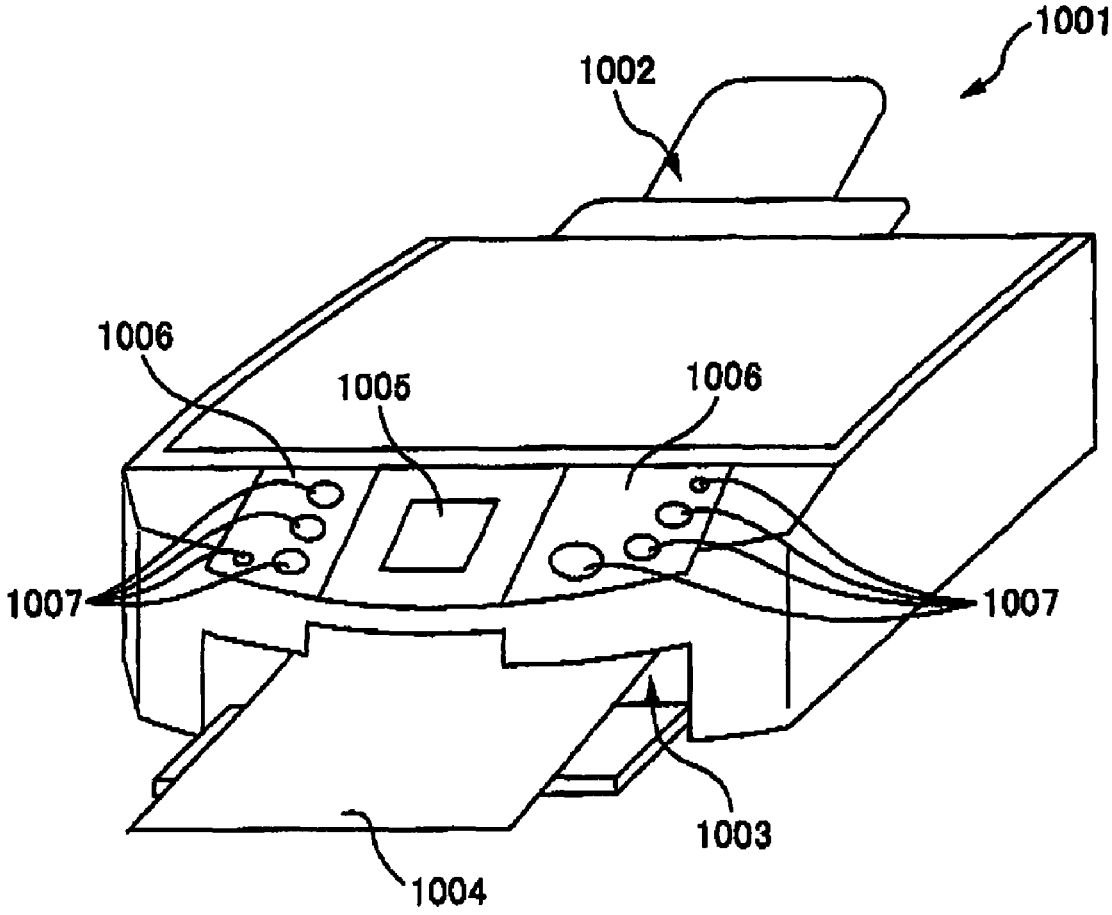
FIG. 20 is a diagram schematically showing the printing apparatus according to a forth embodiment of the present invention.

FIG. 20 is a diagram showing the external appearance of a printer 1001, which is a printing apparatus.

The printer 1001 shown in FIG. 20 is a "stand-alone printer" that is capable of carrying out printing without being connected to a personal computer. A paper supply opening 1002 and a paper discharge opening 1003 are provided on the upper rear side and the lower front surface, respectively, of the printer 1001. A print paper 1004, which is an example of a printing medium, is inserted into the paper supply opening 1002, and when a print command has been made, the print paper 1004 is supplied into the printer 1001 and printed, and then discharged from the paper discharge opening 1003.

A liquid crystal display 1005 is disposed on the front surface of the printer 1001, and control panels 1006 each provided with various control buttons are provided on both sides of the liquid crystal display. Turning the power on and off, setting the print medium type, operations when exchanging ink cartridges, and head cleaning, for example, are performed by operating the various control keys 7 on the control panels 1006. It should be noted that it is possible to adopt a CRT (Cathode Ray Tube) monitor in place of the liquid crystal display 1005.

Figure 21:
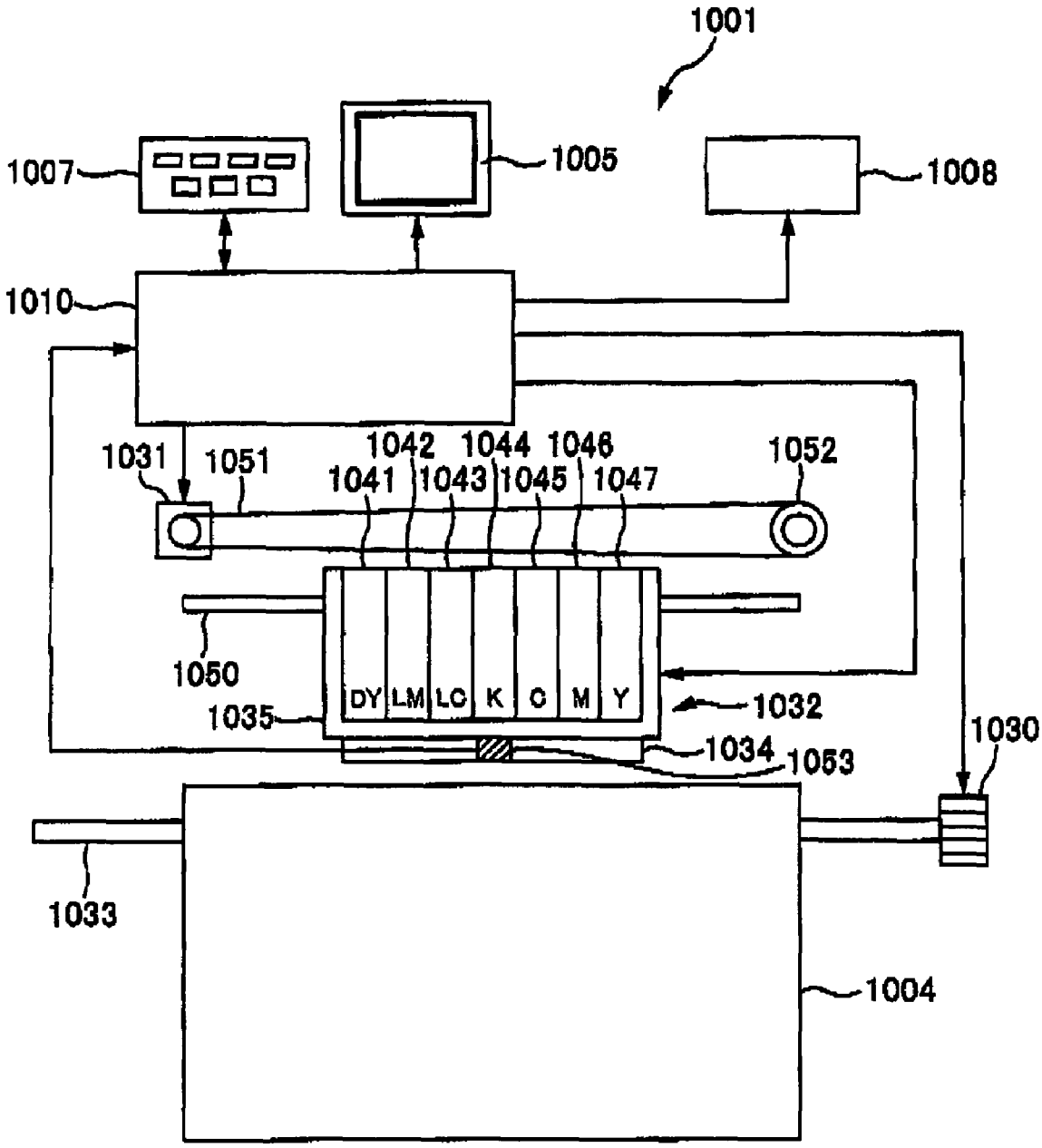
FIG. 21 is a block diagram showing an example of the primary. components of the printing apparatus shown in FIG. 20.

FIG. 21 is a block diagram showing an example of the configuration of the primary components of the printer 1001.

The printer 1001 is provided with a drive unit 1008 for reading data stored on an information recording medium, a representative example thereof being of a memory card, and for storing information on that information recording medium. The printer 1001 is also provided with a control circuit 1010 for governing the sending and receiving of signals between its components and the control panels 1006, the sending of video signals to the liquid crystal display 1005, and the sending and receiving of signals to and from the drive unit 1008.

The printer 1001 also has a carrying mechanism (sub-scan feed mechanism) and a carriage moving mechanism (main-scan feed mechanism). The carrying mechanism carries a print paper 1004 with a paper feed motor 1030. The carriage moving mechanism is for moving a carriage 1032 back and forth in the axial direction of a paper feed roller 1033 using a carriage motor 1031. Here, S the direction in which the print paper 1004 is fed by the carrying mechanism is referred to as the carrying direction (also referred to as the sub-scanning direction), and the direction in which the carriage 1032 is moved by the carriage moving mechanism is referred to as the movement direction (also referred to as the main-scanning direction).

Also, the printer 1001 is provided with a print head unit 1035 that is mounted to the carriage 1032 and that is provided with a print head 1034, and a head drive mechanism for driving the print head unit 1035 and controlling the ejection of ink and dot formation.

As shown in FIG. 20, various ink cartridges 1041 to 1047 are detachably mounted to the carriage 1032. The ink cartridges 1041, 1042, 1043, 1044, 1045, 1046, and 1047 are cartridges containing dark yellow (DY), light magenta (LM), light cyan (LC), black (K), cyan (C), magenta (M), and yellow (Y) ink, respectively.

Nozzles serving as ink ejection locations are disposed in the print head 1034 in rows in the carrying direction of the print paper 1004, and each nozzle row respectively corresponds to a particular color of ink.

Further, piezo elements, which are a type of electrostrictive element with excellent responsiveness, are provided in a lower section of the carriage 1032 and disposed for each nozzle in the nozzle rows corresponding to the respective inks. The piezo elements are arranged at positions in contact with a member forming the ink path over which ink is guided to the nozzles. When voltage is applied to the piezo elements, their crystalline structure is deformed and they very quickly convert this electrical energy into mechanical energy.

In this embodiment, voltage of a predetermined duration is applied between electrodes provided on both sides of the piezo element, and the piezo element is elongated during application of the voltage and deforms one lateral wall of the ink path. As a result, the volume of the ink path is constricted by an amount corresponding to the elongation of the piezo element, and ink corresponding to this amount of constriction becomes an ink droplet and is quickly ejected from the tip of the nozzle. The ink droplet soaks into the print paper P, which is guided along the paper feed roller 1033, thereby forming a dot and carrying out printing. The size of the ink droplets can be changed depending on the method for applying voltage to the piezo elements. It is thus possible to form dots at, for example, three different sizes, these being large, medium, and small.

The carrying mechanism for carrying the print paper 1004 is provided with a gear train (not shown) that transmits the rotation of the paper feed motor 1030 to the paper feed roller 1033 and a paper carry roller (not shown). Also, the carriage moving mechanism for moving the carriage 1032 back and forth is provided with a slide shaft 1050 which runs parallel to the axis of the paper feed roller 1033 and which slidably retains the carriage 1032, a pulley 1052, with an endless drive belt 1051 being provided spanning between the pulley

1052 and the carriage motor 1031, and an optical sensor 1053 for detecting the position of origin of the carriage 1032 and for detecting marks on a mark sheet that is discussed later. It should be noted that the optical sensor 1053 is made of a light source for emitting light onto the paper 1004 and the mark sheet, and a photodiode (or a CCD (charge coupled device) element), for example, for converting light that is reflected by the print paper 1004 and the mark sheet into corresponding image signals. The optical sensor 1053 is mounted to the carriage 1032, and thus can move in the movement direction of the carriage 1032. The optical sensor 1053 can also detect whether or not the paper is present, and thus can detect the paper width by detecting the end portions of the paper during movement of the carriage 1032, and can detect the upper end and the lower end of the paper by detecting the end portions of the paper during carrying.

At should be noted that the "mark sheet" is a sheet on which marks such as check boxes have been printed. The user selectively fills in the marks using a pencil, and the optical sensor 1053 detects whether or not the marks have been filled in. Thus, the printer can receive commands from the user through the mark sheet.

Figure 22:
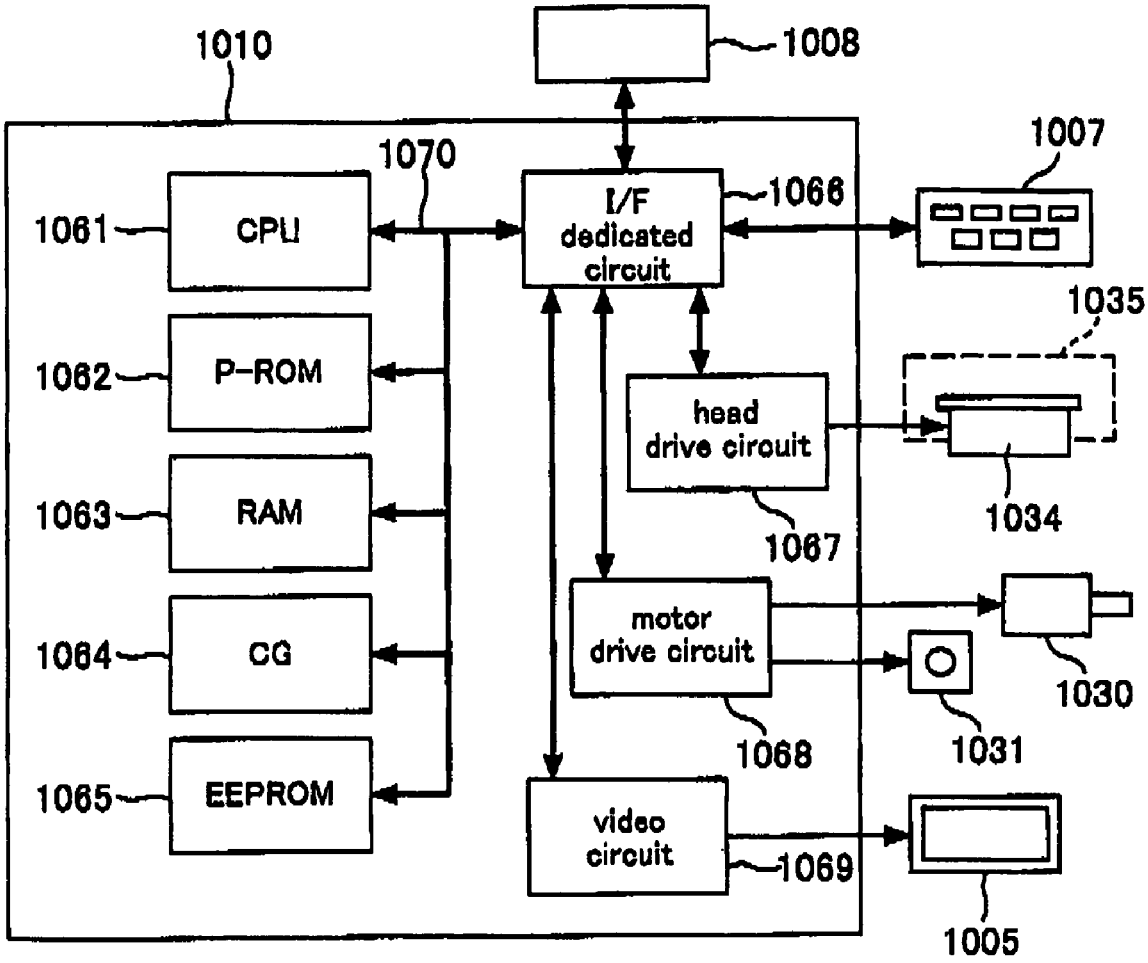
FIG. 22 is a diagram showing an example of the internal structure of the control circuit in the printing apparatus shown in FIG. 20.

FIG. 22 is a diagram showing an example of the internal structure of the control circuit 1010 shown in FIG. 21.

As shown in FIG. 22, the control circuit 1010 is provided with a CPU (Central Processing Unit) 1061, a programmable ROM (P-ROM (Read Only Memory)) 1062,a RAM (Random Access Memory) 1063, a character generator (CG) 1064 storing character dot matrix, and an EEPROM (Electronically Erasable and Programmable ROM) 1065. Here, the CPU 1061 of the control circuit 1010 performs various computer processing in accordance with programs stored on the P-ROM 1062. The CPU 1061 functions as a controller (controlling section) for controlling the various sections in the printer. For example, the CPU 1061 controls the carriage moving mechanism to move the carriage (and print head) and controls the carrying mechanism to carry the print paper in the carrying direction, and controls the head driving mechanism to cause the print head to eject ink. The CPU 1061 can also control the various sections in the printer based on the results of detection by the optical sensor 1053.

The control circuit 1010 is further provided with an I/F dedicated circuit 1066, which is an interface (I/F) between the control circuit 1010 and the external control panels 7, the drive unit 1008, the motors, etc., a head drive circuit 1067 that is connected to the I/F dedicated circuit 1066 and that is for driving the print head unit 1035 and causing it to eject ink, a motor drive circuit 1068 for driving the paper feed motor 1030 and the carriage motor 1031, and a video circuit 1069 that executes rendering processes in accordance with picture commands supplied by the CPU 1061 to convert obtained image data into video signals and outputs these to the liquid crystal display 1005. The structural components in the control circuit 1010 are connected by a bus 1070, allowing various types of signals to be sent and received between them.

A memory card, which is the storage medium of a digital camera that is not shown, is inserted into the drive unit 1008, and the information recorded on the memory card is read out and printed. It should be noted that in place of the drive unit 1008 it is also possible to provide a predetermined interface circuit and to send and receive image information to and from the digital camera via wire or wirelessly. The memory card is made of a semiconductor memory device, is detachably mounted to a digital camera that is not shown, and is designed so as to store images that have been captured.

The method for adjusting the print properties of the printer 1001 is described next with reference to FIGS. 23 to 32.

Figure 23:
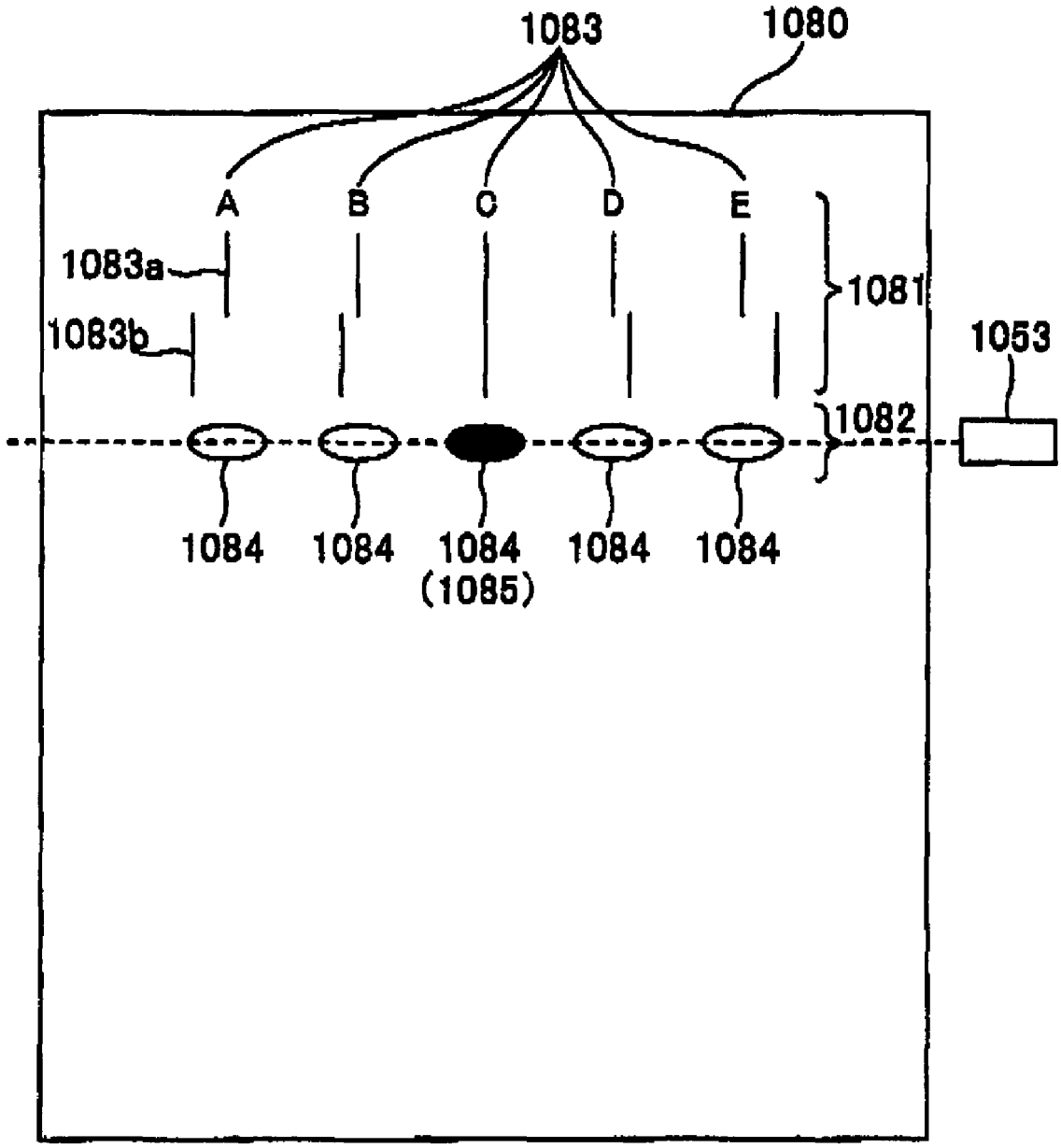
FIG. 23 is a diagram showing an example of the mark sheet that is used to adjust the print properties in the printing apparatus shown in FIG. 20.

FIG. 23 is a diagram showing an example of a mark sheet 1080 for the user to designate print properties thought to be appropriate using a writing instrument.

The mark sheet 1080 has a Bi-D adjustment pattern print region 1081 in which patterns for ink ejection timing adjustment (Bi-D adjustment) for the forward and return passes during. bidirectional printing are printed, and a check box print region 1082 disposed below these patterns. A black mark 1084 has been added to the mark sheet 1080 shown in FIG. 23, but the mark sheet 1080 that is initially printed is a mark sheet in a state prior to the user filling in the mark 1085.

Five types of Bi-D adjustment patterns 1083 shown by A to E are drawn in the Bi-D adjustment pattern print region 1081 as examples of the print property patterns. These five Bi-D adjustment patterns 1083 are printed on the mark sheet 1080 prior to Bi-D adjustment. Each Bi-D adjustment pattern 1083 is made of a vertical line 1083*a* printed while moving the print head 1034 from left to right (moving in the forward direction) over the mark sheet 1080 shown in FIG. 23, and a vertical line 1083*b* printed while moving the print head 1034 from right to left (moving in the return direction) over the mark sheet 1080. The ink ejection timing of the return pass with respect to the forward pass when forming the Bi-D patterns is different for each pattern. Thus, the position of the vertical line 1083*b* with respect to the vertical line 1083*a* in each Bi-D pattern is different.

On the other hand, check boxes 1084 for the user to mark are drawn in the check box print region 1082. The user looks at the mark sheet 1080 printed by the printer 1001 and selects the most suitable Bi-D adjustment pattern, fills in the check box 1084 below this pattern, and supplies the mark sheet 1080 into the printer 1001. Here, the most suitable Bi-D adjustment pattern 1083 is the pattern in which the vertical line 1083*a* and the vertical line 1083*b* form a straight line. When a specific check box 1084 has been filled in and the mark sheet 1080 is fed into the printer 1001, the optical sensor 1053 moves over the dotted line in the movement direction in FIG. 23 to detect the mark 1085 that has been filled in.

Figure 24:
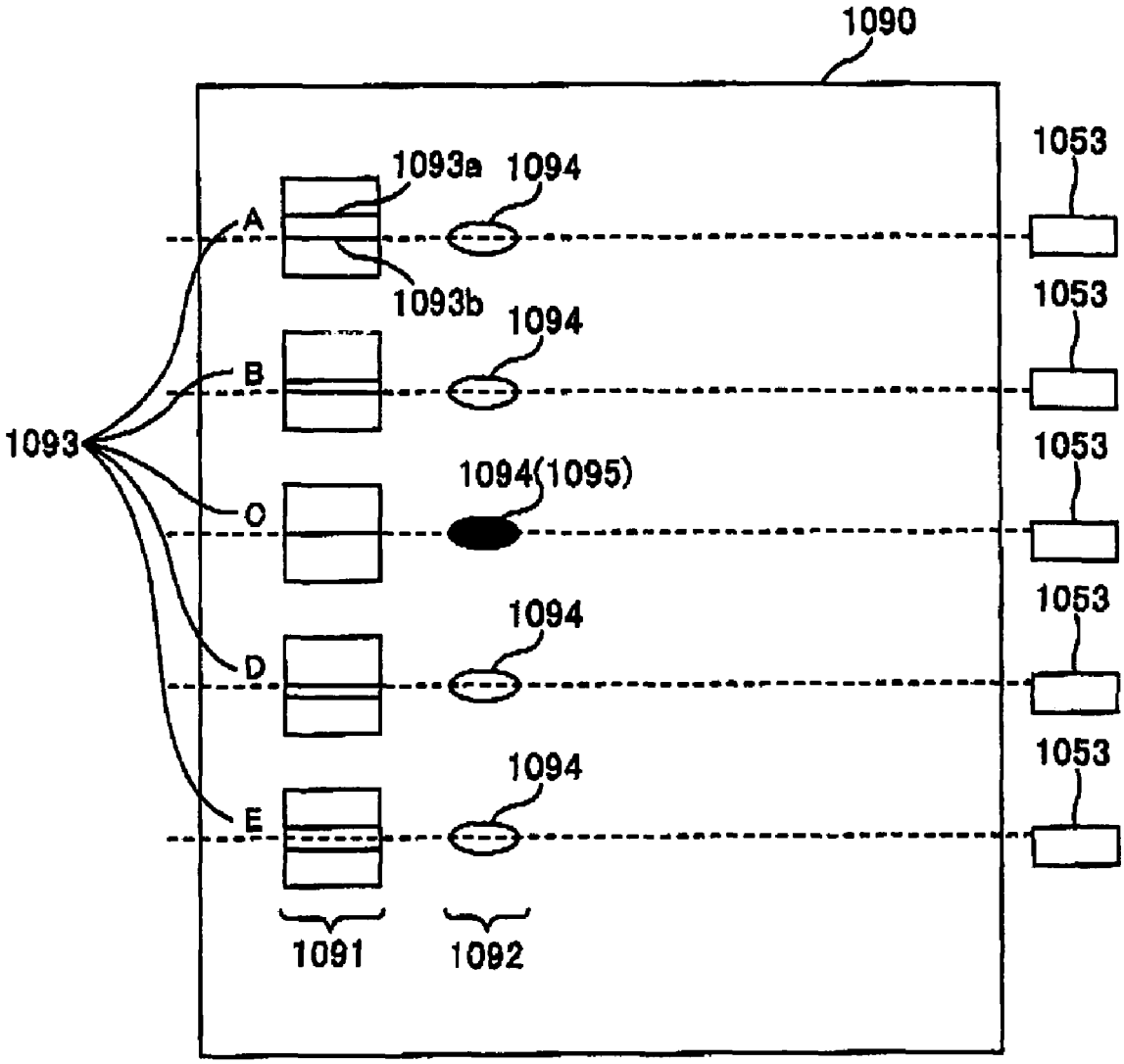
FIG. 24 is a diagram showing an example of a mark sheet whose layout is different from that of the mark sheet shown in FIG. 23.

FIG. 24 is a diagram showing an example of a mark sheet 1090 for the user to designate print properties thought to be appropriate using a writing instrument.

The mark sheet 1090 has a PF correction pattern print region 1091 in which patterns for carry amount adjustment (PF adjustment) during printing are printed, and a check box print region 1092 disposed to the right of the patterns. The mark sheet 1090 shown in FIG. 24, like the mark sheet 1080 shown in FIG. 23, is initially printed in a state in which the user has not yet added a mark 1095.

Five types of PF adjustment patterns 1093 shown by A to E are drawn in the PF adjustment pattern print region 1091 as examples of print property patterns. These five PF adjustment patterns 1093 are printed on the mark sheet 1090 prior to PF adjustment. Each PF adjustment pattern 1093 is made of an upper horizontal line 1093*a* and a lower horizontal line 1093*b*. After one of these two horizontal lines has been printed, the print paper is carried by a predetermined carried amount, and then after this carrying, the other horizontal line is printed. The carry amount of the carry that is performed between printing the one line and printing the other line is different for each of the five PF adjustment patterns.

On the other hand, check boxes 1094 for the user to mark are drawn in the check box print region 1092. The user looks at the mark sheet 1090 printed by the printer 1001 and selects the most suitable PF adjustment pattern, fills in the check box 1094 to the right of this pattern, and then supplies the mark sheet 1090 into the printer 1001. Here,the most suitable PF adjustment pattern 1093 is the pattern in which the horizontal line 1093*a* and the horizontal line 1093*b* form a straight line. When a specific check box 1094 has been filled in and that mark sheet 1090 is fed into the printer 1001, the optical sensor 1053 moves over each dotted line in the movement direction in FIG. 24 in order and detects the mark 1095 that has been filled in. It should be noted that it is also possible for the optical sensor 1053 to move over only the check box print region 1092 instead of moving over the entire width of the mark sheet 1090 in the movement direction.

Figure 25:
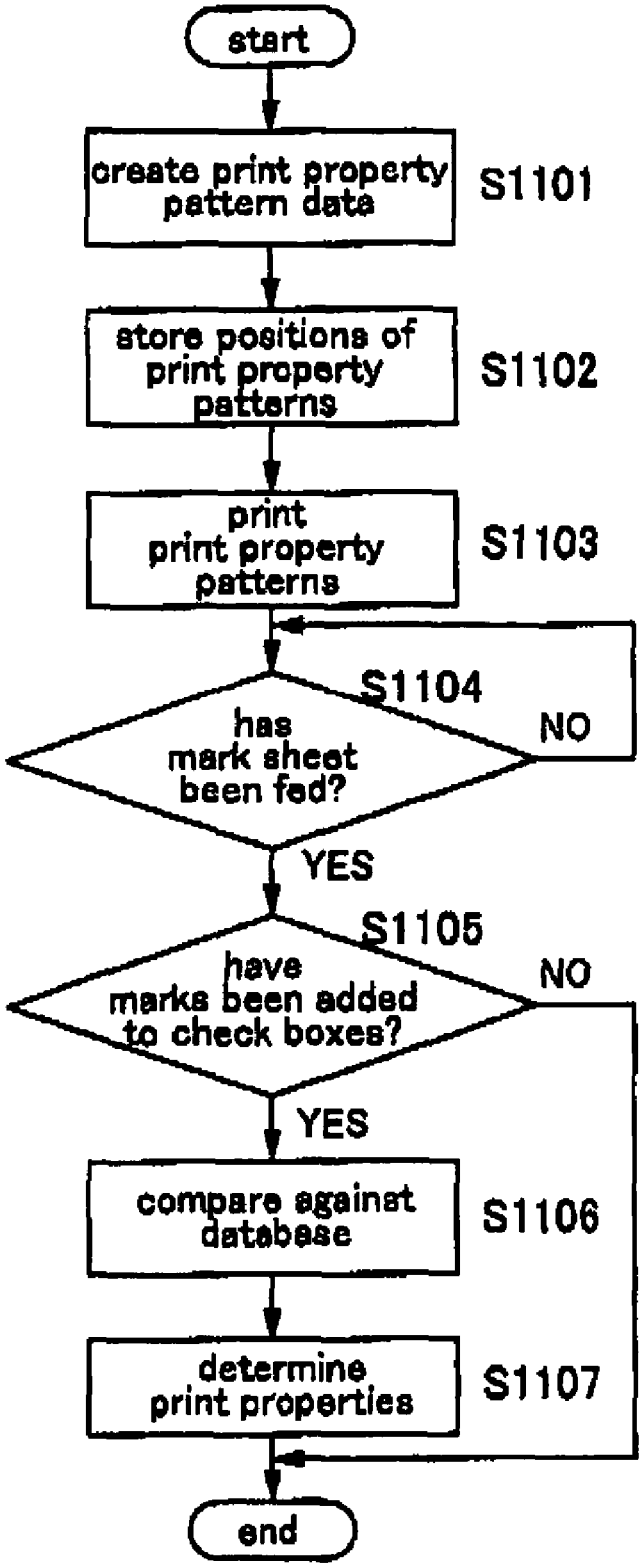
FIG. 25 is a flowchart showing the procedure for adjusting the print properties using the mark sheets shown in FIG. 23 and FIG. 24.

FIG. 25 is a flowchart showing the procedure for adjusting the print properties using the mark sheets 1080 and 1090 shown in FIG. 23 and FIG. 24.

When the user has inserted the print paper 1004 into the printer 1001 and performs a command to adjust the print properties, such as Bi-D adjustment or PF adjustment, using the control keys 7, the printer 1001 creates print property pattern data such as the Bi-D adjustment patterns 1083 or the PF adjustment patterns 1093 (step S1101).

Next, the printer 1001 stores the print positions of those print property patterns (step S1102), and prints the print property patterns while feeding the print paper 1004 that has been inserted (step S1103). The user then looks at the mark sheet 1080 or 1090 and selects the Bi-D adjustment pattern 1083 or the PF adjustment pattern 1093 that he/she thinks is most suitable, fills in the check box 1084 or 1094 below or to the right of that pattern, and then inserts that mark sheet 1080 or 1090 in which a check box 1084 or 1094 has been filled in into the paper supply opening 1002 of the printer 1001.

The printer 1001 then determines whether or not the mark sheet 1080 or 1090 has been supplied (step S1104), and if the paper has not been fed due to reasons such as paper feeding having failed or the mark sheet 1080 or 1090 not being present, then the printer 1001 enters a standby state and the determination of step S1104 is performed again. On the other hand, if the mark sheet 1080 or 1090 has been supplied, the printer 1001 then determines whether or not a check box 1084 or 1094 has been marked (step S1105).

If the result of the determination of step S1105 is that there is a mark 1085 or 1095 in a check box 1084 or 1094, then the printer 1001 compares the position of the mark 1085 or 1095 that has been filled in against the database stored in step s1102 (step S1106), and determines the print property, such as Bi-D adjustment or PF adjustment, corresponding to the position of that mark 1085 or 1095 (step S1107). On the other hand, if in step S1105 it is determined that there is no mark 1085 or 1095 among the check boxes 1084 or 1094, then the printer 1001 does not adjust the print properties using the mark sheet 1080 or 1090, and maintains the current print properties. After this series of processes, the process of adjusting the print properties is finished.

Figure 26:
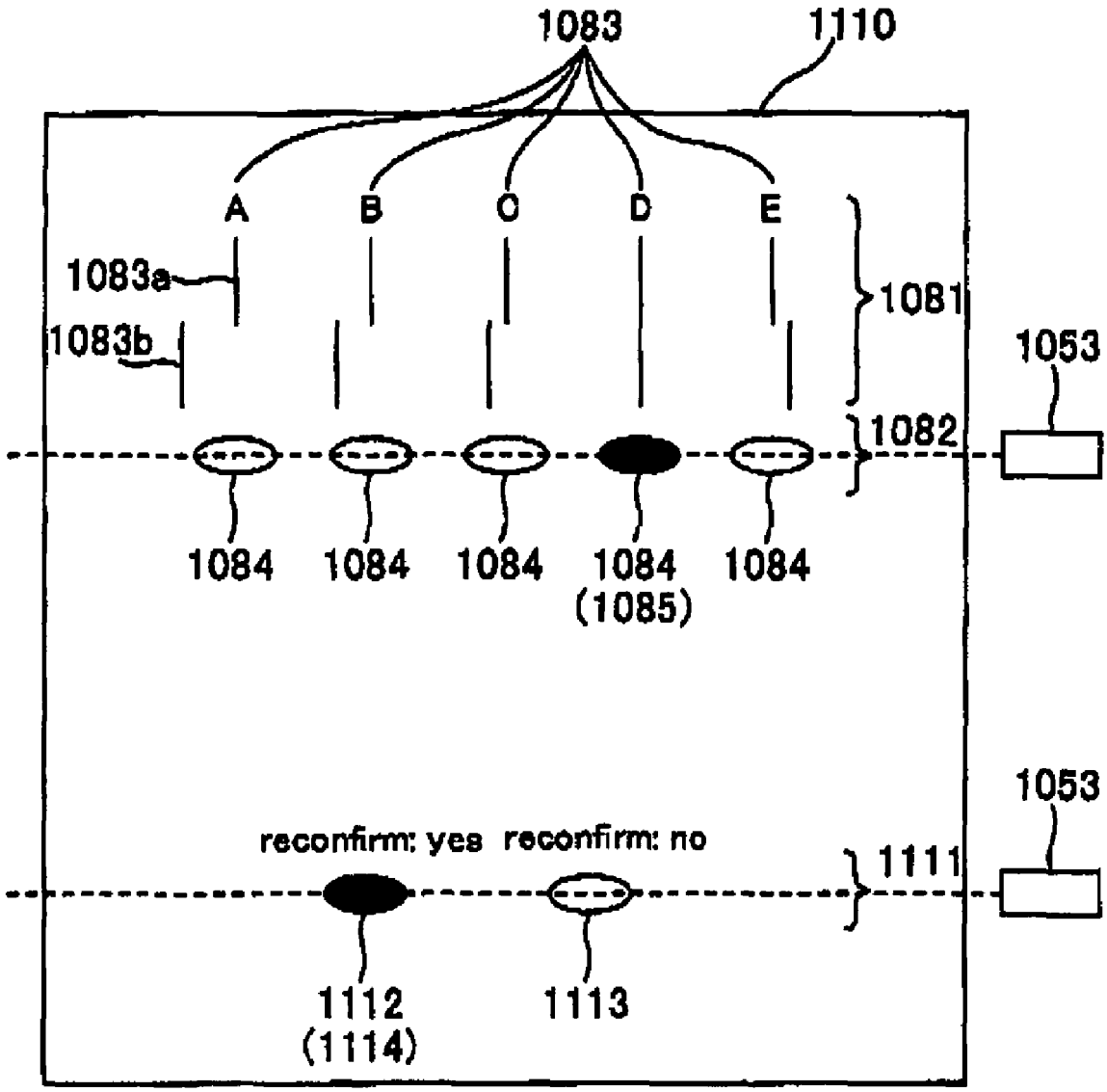
FIG. 26 is a diagram showing an example of a mark sheet in which the confirmation check boxes have been added to the mark sheet shown in FIG. 23.
Figure 27:
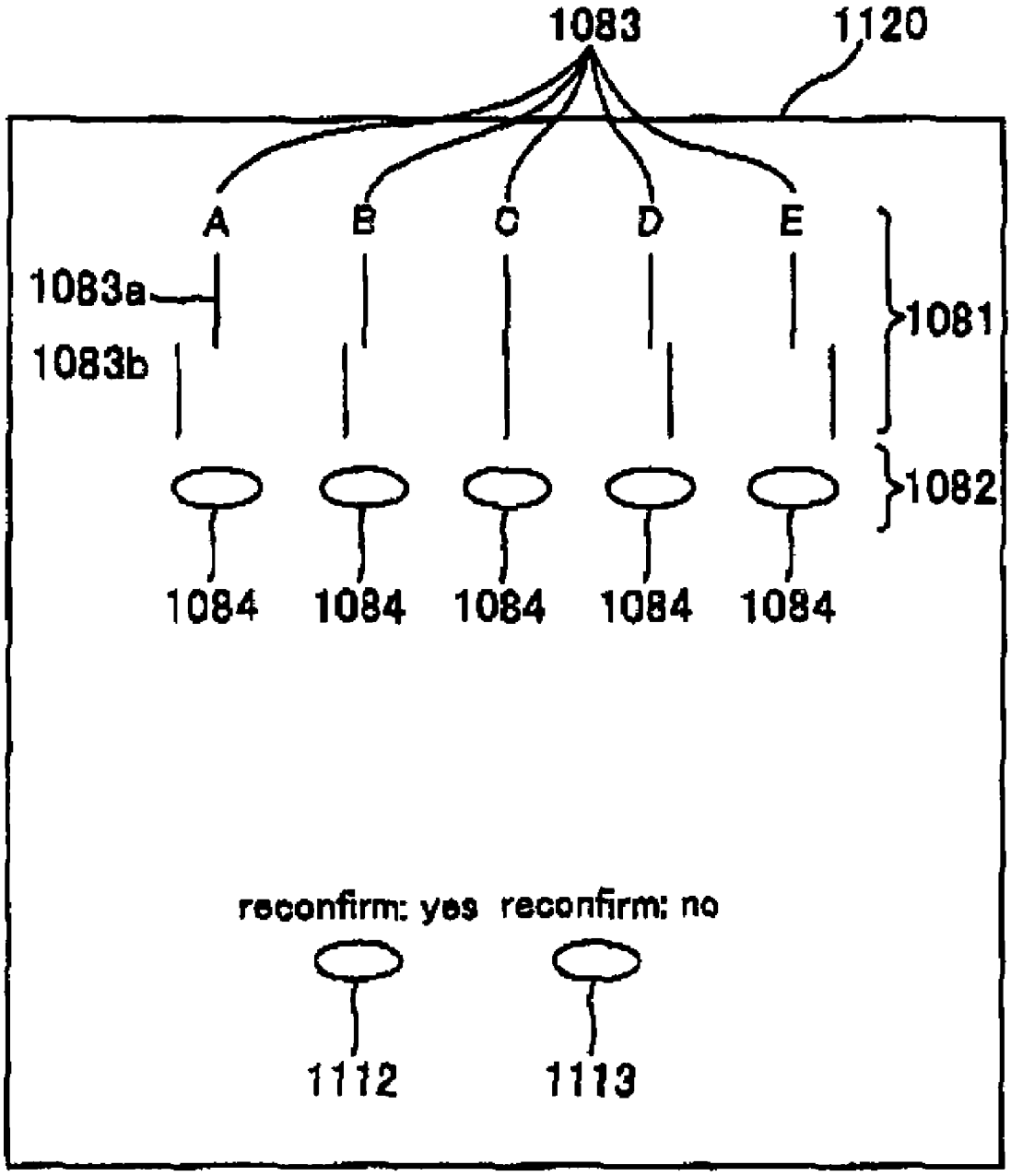
FIG. 27 is a diagram showing an example of a mark sheet on which print property patterns have been printed again on a new print paper that is fed after the mark sheet shown in FIG. 26 has been fed.

FIG. 26 is a diagram showing an example of a mark sheet 1110, in which confirmation check boxes 1112 and 1113 to which a mark 1114 for confirmation can be written have been added to the mark sheet 1080 shown in FIG. 23. Further, FIG. 27 is a diagram showing an example of a mark sheet 1120 in which Bi-D adjustment patterns are printed again on a new sheet of print paper 1004 that has been supplied after supplying the mark sheet 1110 shown in FIG. 26.

Features that are shared between the mark sheet 1110 shown in FIG. 26 and the mark sheet 1060 shown in FIG. 23 are not described below. There is a print region 1111 for confirmation check boxes on the lower part of the mark sheet 1110. In this confirmation check box print region 1111 are printed: a confirmation check box 1112 that is bubbled in by the user if he/she would like to reconfirm whether or not Bi-D adjustment has been performed at the pattern of the mark 1085 that he/she has filled in, and a confirmation check box 1113 that is bubbled in when reconfirmation is not necessary.

In the mark sheet 1110, the most suitable Bi-D adjustment pattern is the Bi-D adjustment pattern 1083 indicated by the letter D. In the case here, the user may wish to perform Bi-D adjustment again to confirm that the most suitable Bi-D adjustment pattern has been printed in the center. In this case, the user fills in the check box 1084 below the Bi-D adjustment pattern 1083 indicated by the letter D and the confirmation check box 1112, and feeds the mark sheet 1110 into the printer 1001. Then, the optical sensor 1053 moves in the movement direction across the two regions, these being the check box print region 1082 and the confirmation check box print region 1111, as indicated by the two dotted lines in FIG. 26, and detects the position of the mark 1085 and the confirmation mark 1114. After Bi-D adjustment is performed in accordance with this detection, it becomes possible to again print the Bi-D adjustment pattern 1083 on the print paper 1004.

More specifically, by supplying a separate, new print paper 1004 into the printer 1001 after-supplying the mark sheet 1110, it is possible to print a new mark sheet 1120 on which the Bi-D adjustment patterns after Bi-D adjustment are printed. The user looks at the new mark sheet 1120 on which the Bi-D adjustment patterns after Bi-D adjustment are printed, and if a single vertical line can be confirmed in the center of the Bi-D adjustment pattern print region 1081, then it can be understood that suitable Bi-D adjustment has been performed.

It should be noted that the confirmation check box 1113 is not essential, and it is also possible to provide only the confirmation check box 1112 and to determine whether or not it is necessary to print the Bi-D adjustment patterns after Bi-D adjustment based only on whether or not there is a confirmation mark 1114 in the confirmation check box 1112.

Figure 28:
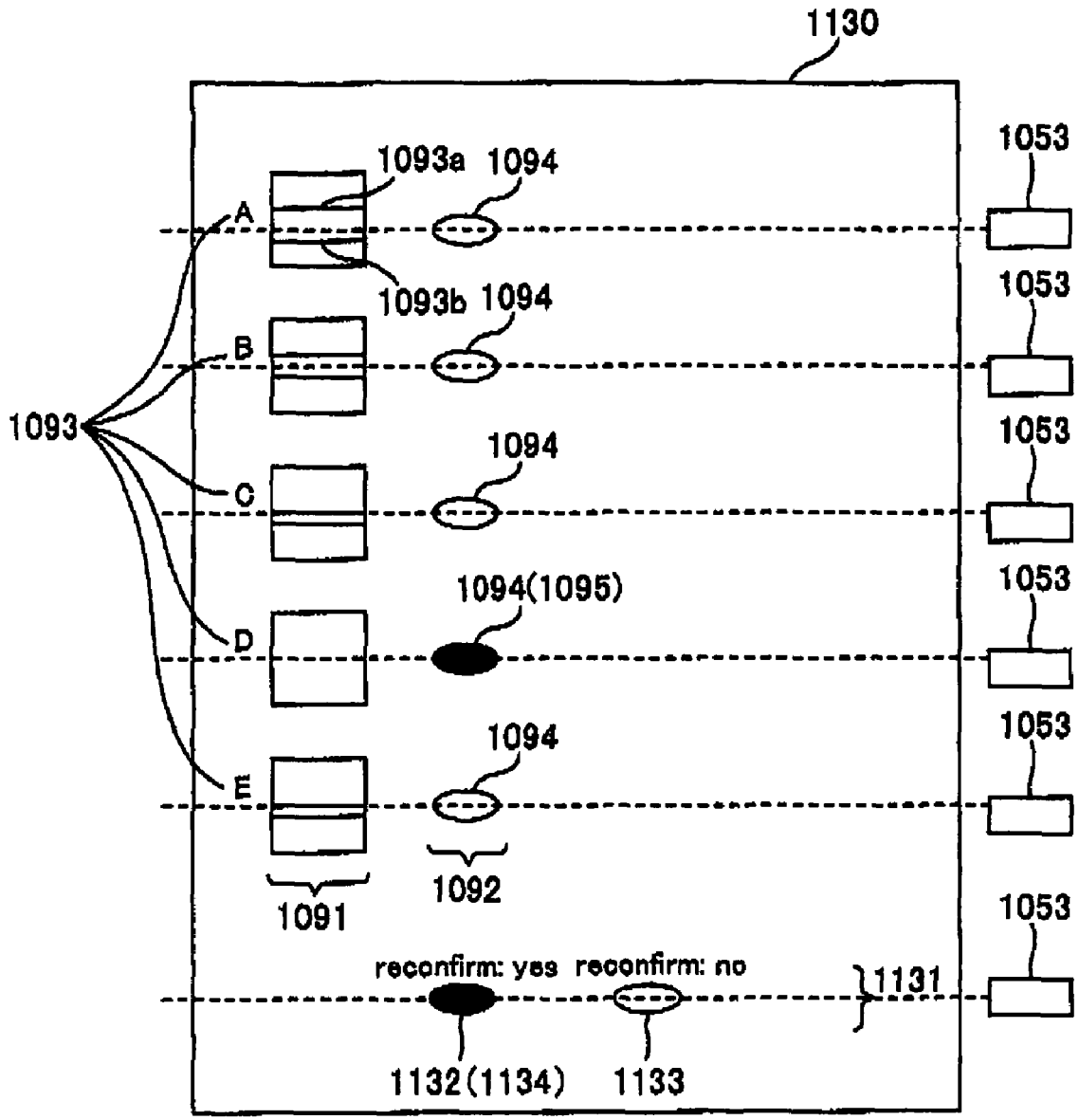
FIG. 28 is a diagram showing an example of a mark sheet in which confirmation check boxes have been added to the mark sheet shown in FIG. 24.
Figure 29:
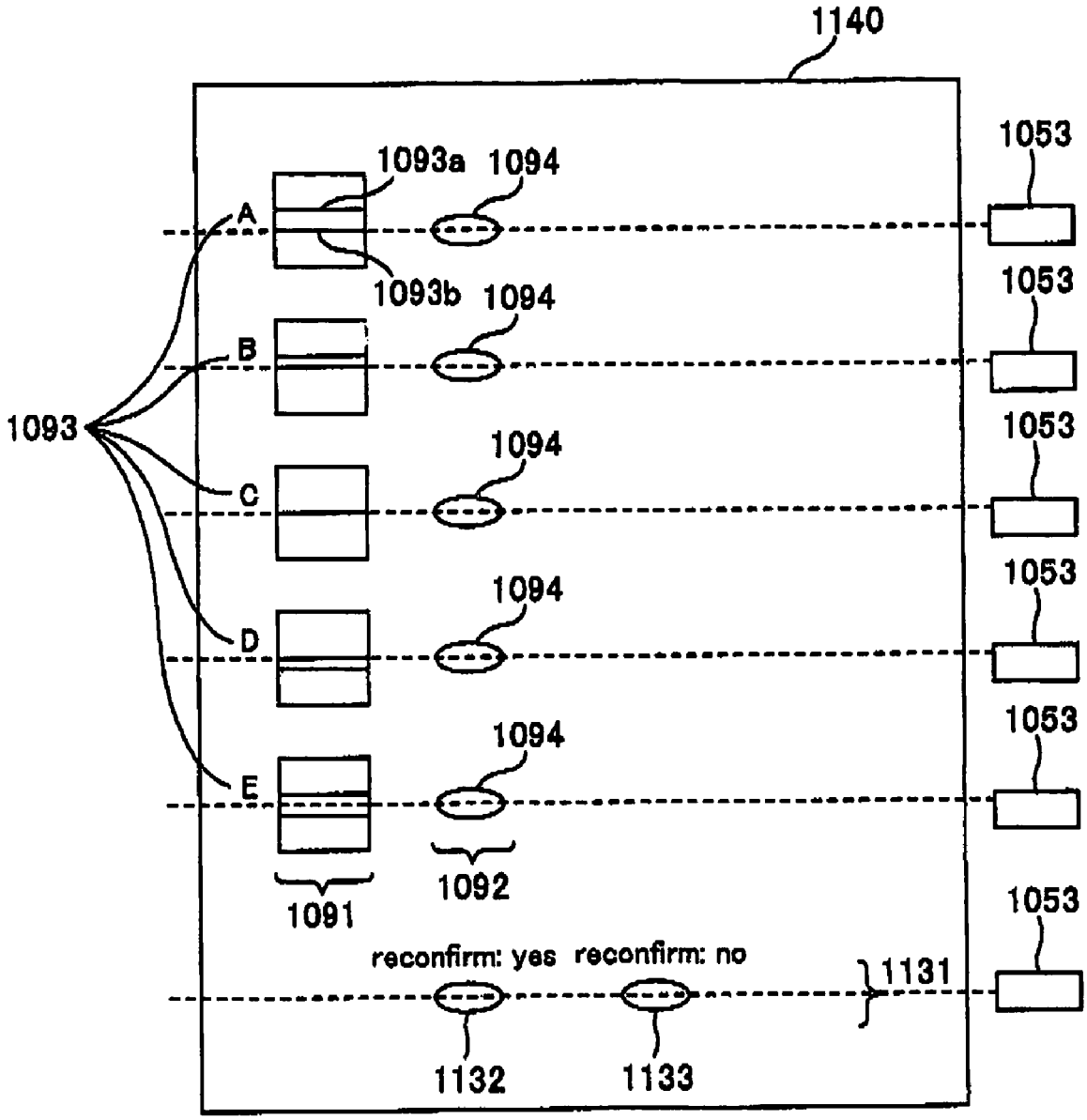
FIG. 29 is a diagram showing an example of a mark sheet in which print property patterns have been printed again on a new print paper that is fed after the mark sheet shown in FIG. 28 has been fed.

FIG. 28 is a diagram showing an example of a mark sheet 1130, in which confirmation check boxes 1132 and 1133 to which a mark 1134 for confirmation can be written have been added to the mark sheet 1090 shown in FIG. 24. Further, FIG. 29 is a diagram showing an example of a mark sheet 1140 on which the PF adjustment patterns are again printed on a new print paper 1004 that is supplied after supplying the mark sheet 1130 shown in FIG. 28.

Features that are shared between the mark sheet 1130 shown in FIG. 28 and the mark sheet 1090 shown in FIG. 24 are not described below. There is a print region 1131 for confirmation check boxes on the lower part of the mark sheet 1130. In this confirmation check box print region 1131 are printed: a confirmation check box 1132 that is bubbled in by the user if he/she would like to reconfirm whether or not PF adjustment has been performed at the pattern with the mark 1095 that he/she has filled in, and a confirmation check box 1133 that is bubbled in when reconfirmation is not necessary.

In the mark sheet 1130, the most suitable PF adjustment pattern is the PF adjustment pattern 1093 indicated by the letter D. In this case, the user fills in the check box 1094 to the right of the PF adjustment pattern 1093 indicated by the letter D and the confirmation check box 1132, and feeds the mark sheet 1130 into the printer 1001. Then, the optical sensor 1053 moves in the movement direction across the check box print region 1092 and the confirmation check box print region 1131 as indicated by the six dotted lines in FIG. 28, and detects the position of the mark 1095 and the confirmation mark 1134. After PF adjustment is performed in accordance with this detection, it becomes possible to again print the PF adjustment pattern 1093 on the print paper 1004.

More specifically, by supplying a separate, new print paper 1004 into the printer 1001 after supplying the mark sheet 1130, it is possible to print a new mark sheet 1140 on which the PF adjustment patterns after PF adjustment are printed. The user looks at the new mark sheet 1140 on which the PF adjustment patterns after PF adjustment are printed, and if a single horizontal line can be confirmed in the center of the PF adjustment pattern print region 1091, then it can be understood that suitable PF adjustment has been performed.

It should be noted that the confirmation check box 1133 is not essential, and it is also possible to provide only the confirmation check box 1132 and to determine whether or not it is necessary to print the PF adjustment patterns after PF adjustment based only on whether or not there is a confirmation mark 1132 in the confirmation check box 1132.

Figure 30:
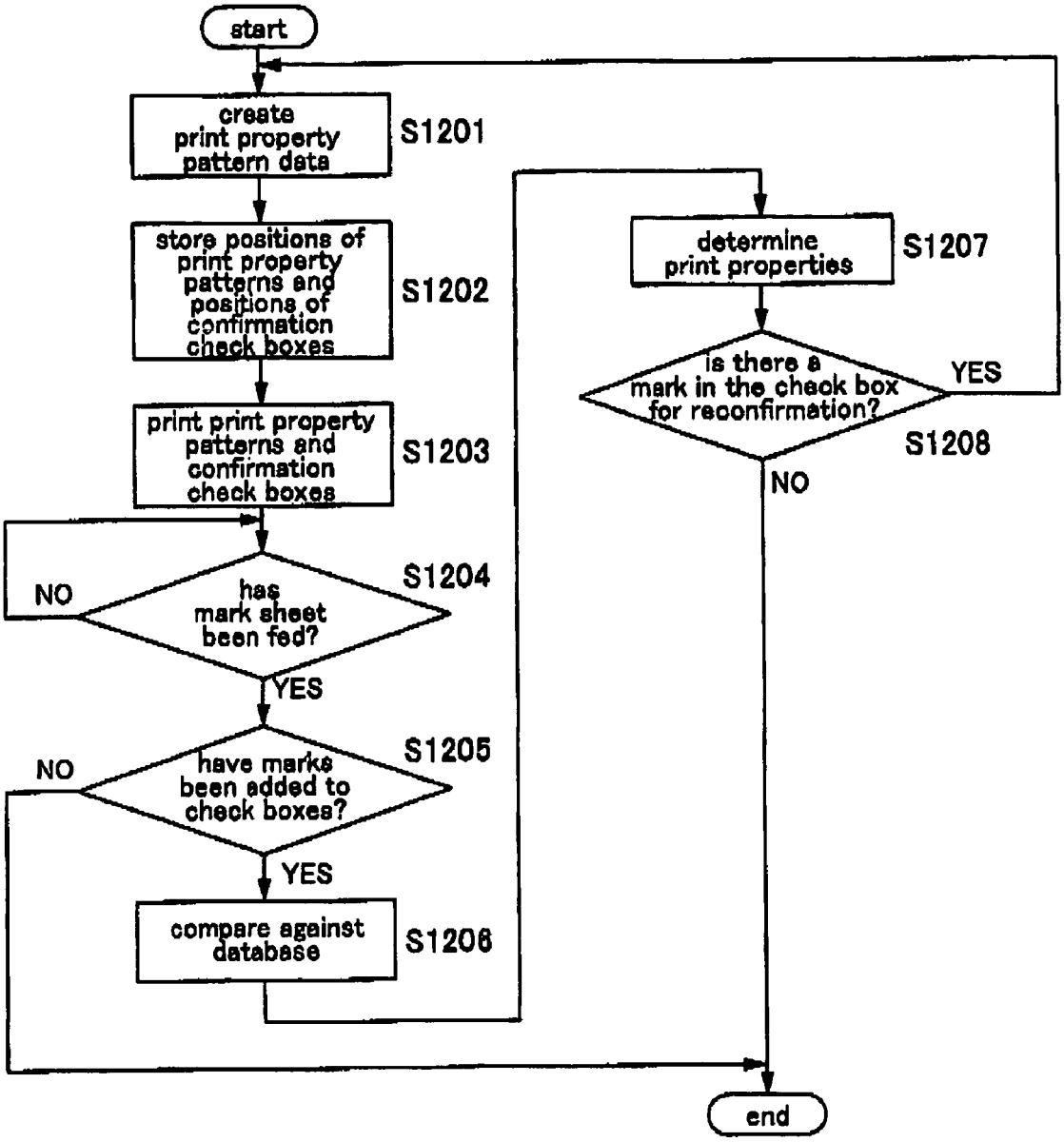
FIG. 30 is a flowchart showing the procedure for adjusting the print properties using the mark sheets shown in FIG. 26 and FIG. 28.

FIG. 30 is a flowchart showing the procedure for adjusting the print properties using the mark sheets 1110 and 1130 of FIG. 26 and FIG. 28.

When the user has inserted the print paper 1004 into the printer 1001 and performs a command to adjust the print properties, such as Bi-D adjustment or PF adjustment, using the control keys 7, the printer 1001 creates print property pattern data such as the Bi-D adjustment patterns 1083 or the PF adjustment patterns 1093 (step S1201).

Next, the printer 1001 stores the print positions of those print property patterns and the confirmation check boxes 1112, 1113, 1132, and 1133 (step S1202), and prints the print property patterns and the confirmation check boxes 1112, 1113, 1132, and 1133 while feeding the print paper 1004 that has been inserted (step S1203). The user then looks at the mark sheet 1110 or 1130 and selects the Bi-D adjustment pattern 1083 or the PF adjustment pattern 1093 that he/she thinks is most suitable, fills in the check box 1084 or 1094 below or to the right of that pattern and one of the confirmation check boxes 1112 and 1132, or 1113 and 1133, and then inserts that mark sheet 1110 or 1130 into the paper supply opening 1002 of the printer 1001.

The printer 1001 then determines whether or not the mark sheet 1110 or 1130 has been fed (step S1204), and if the paper has not been fed due to reasons such as paper feeding having failed or the mark sheet 1110 or 1130 not being present, then the printer 1001 enters a standby state and the determination of step S1204 is performed again. On the other hand, if the mark sheet 1110 or 1130 has been fed, then the printer 1001 determines whether or not a mark has been added to a check box 1084 or 1094 (step S1205).

If the result of the determination of step S1205 is that there is a mark 1085 or 1095 in a check box 1084 or 1094, then the printer 1001 compares the position of the mark 1085 or 1095 that has been filled in against the database stored in step S1202 (step S1206), and determines the print property, such as Bi-D adjustment or PF adjustment, corresponding to the position of that mark 1065 or 1095 (step S1207). On the other hand, if in step S1205 it is determined that there is no mark 1085 or 1095 in the check boxes 1084 or 1094, then the printer 1001 does not adjust the print properties using the mark sheet 1110 or 1130 and maintains the current print properties.

After step S1207, the printer 1001 determines whether or not a confirmation mark 1114 or 1134 has been made in the confirmation check box 1112 or 1132 on the mark sheet 1110 or 1130 (step S1208). If the result is that there is a confirmation mark 1114 or 1134, then the printer returns to step S1201 of the procedure, once again creates print property pattern data and performs the subsequent processes. On the other hand, if there is no confirmation mark 1114 or 1134, then the adjustment processing for the print properties is ended.

Figure 31:
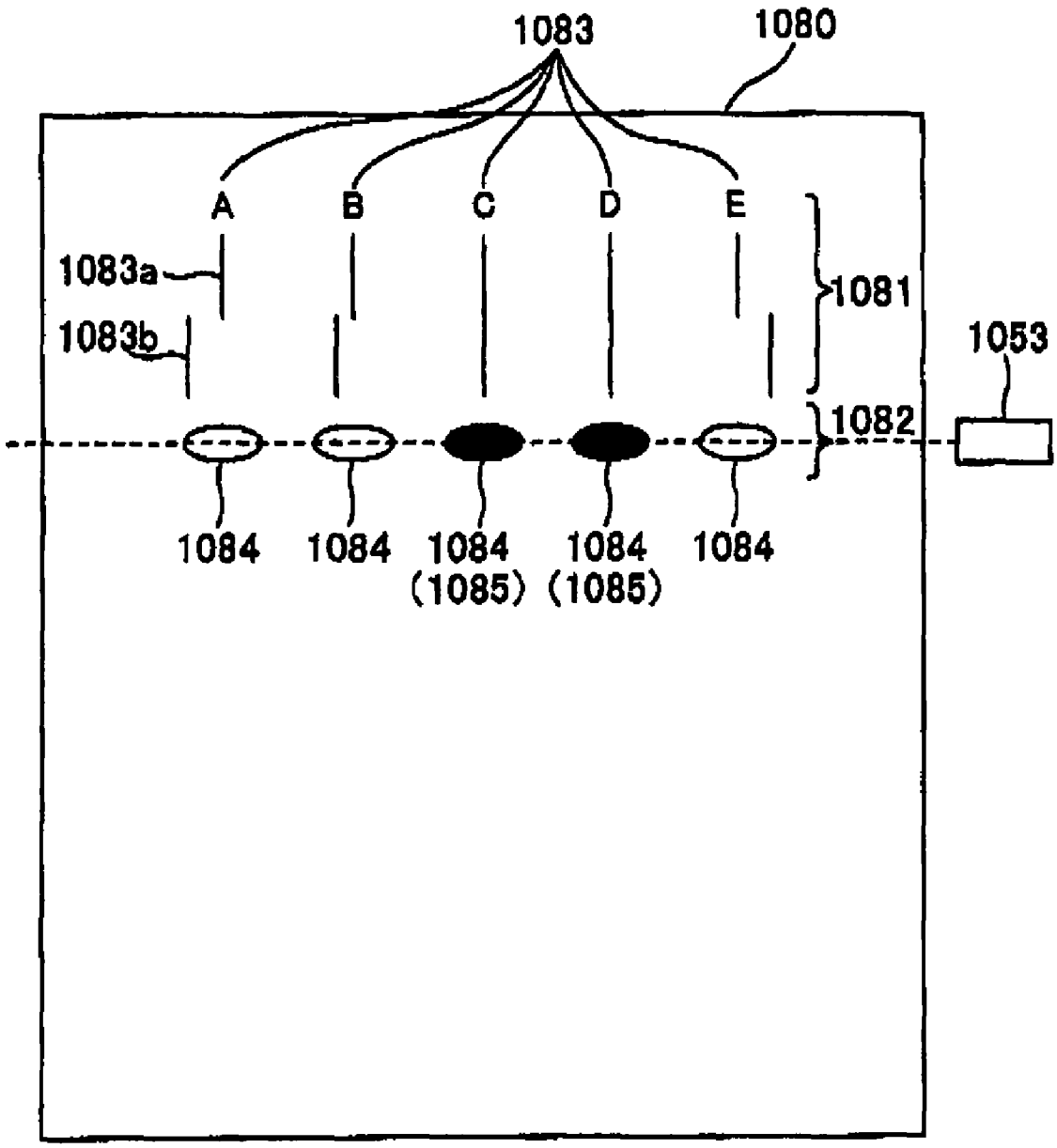
FIG. 31 is a diagram showing a mark sheet that is used to adjust the print properties of the printing apparatus shown in FIG. 20, in a state in which the user has designated two print properties.

FIG. 31 is a diagram showing an example of the mark sheet 1080 in which the user has used a writing instrument to designate two print properties that are conceivably suitable.

As shown in FIG. 31, there are two Bi-D adjustment patterns 1083 (the patterns indicated by the letters C and D) that the user has determined suitable. This may occur because the printed state of the plurality of Bi-D adjustment patterns 1083 is not good or because the printer 1001 has low resolution. Assuming such a case, if there are marks 1085 and 1085 in the check boxes 1084 and 1084 below the two Bi-D adjustment patterns 1083 and 1083 that the user thinks are suitable, then it is possible to adjust the print properties to a print property between the Bi-D adjustment patterns 1083 and 1083.

Figure 32:
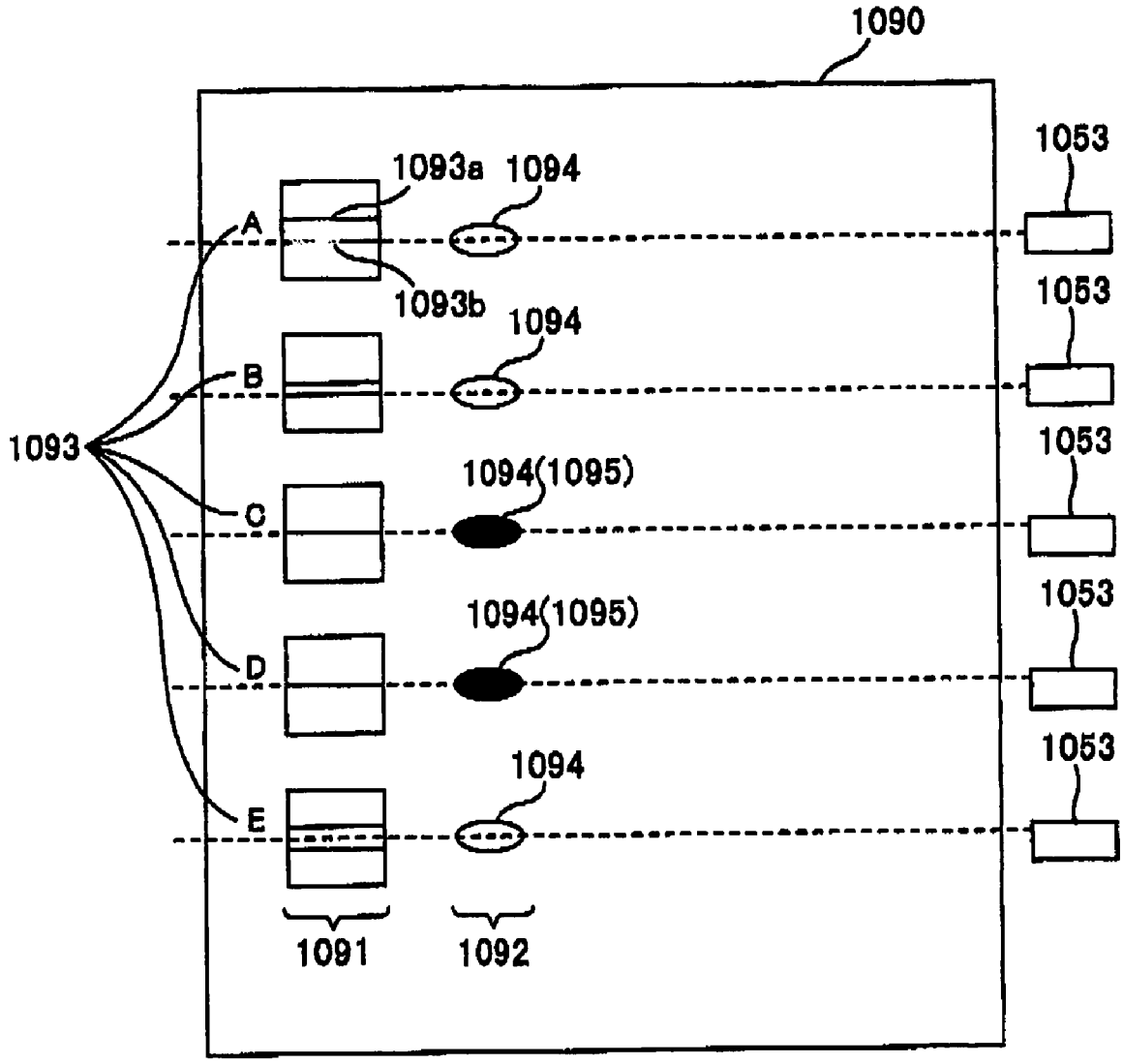
FIG. 32 is a diagram showing a separate implementation of the mark sheet shown in FIG. 31, in a state in which the user has designated two print properties.

FIG. 32 is a diagram showing an example of the mark sheet 1090 in which the user has used a writing instrument to designate two print properties that are conceivably suitable.

In this mark sheet 1090, like in the above mark sheet 1080, there are two PF adjustment patterns 1093 (the patterns indicated by the letters C and D) that the user has determined suitable. Assuming such a case, if there are marks 1095 and 1095 in the check boxes 1094 and 1094 to the right of the two PF adjustment patterns 1093 and 1093 that the user thinks are suitable, then it is possible to adjust the print property to a print property between the PF adjustment patterns 1093 and 1093.

As shown in FIG. 31 and FIG. 32, if there are marks 1065 and 1085, or 1095 and 1095, in two check boxes 1084 and 1064 or 1094 and 1094, then in step S1107 of the flowchart shown in FIG. 25, adjustment is performed to a print property between the two Bi-D adjustment patterns 1083 and 1083 or between the two PF adjustment patterns 1093 and 1093.

It should be noted that if confirmation check boxes 1112 and 1132 or 1132 and 1133 have been added to the mark sheet 1110 shown in FIG. 26 or the mark sheet 1130 shown in FIG. 28, then there may occur a situation in which two check boxes 1084 and 1084 or 1094 and 1094 are filled in. Here as well, in step S1207 of the flowchart shown in FIG. 30, it is possible to adjust the print property to between the two Bi-D adjustment patterns 1083 and 1083 or the two PF adjustment patterns 1093 and 1093.

Fifth Embodiment

Next, an embodiment of a printing apparatus made of a printer and a computer is described with reference to FIG. 33 to FIG. 36.

Figure 33:
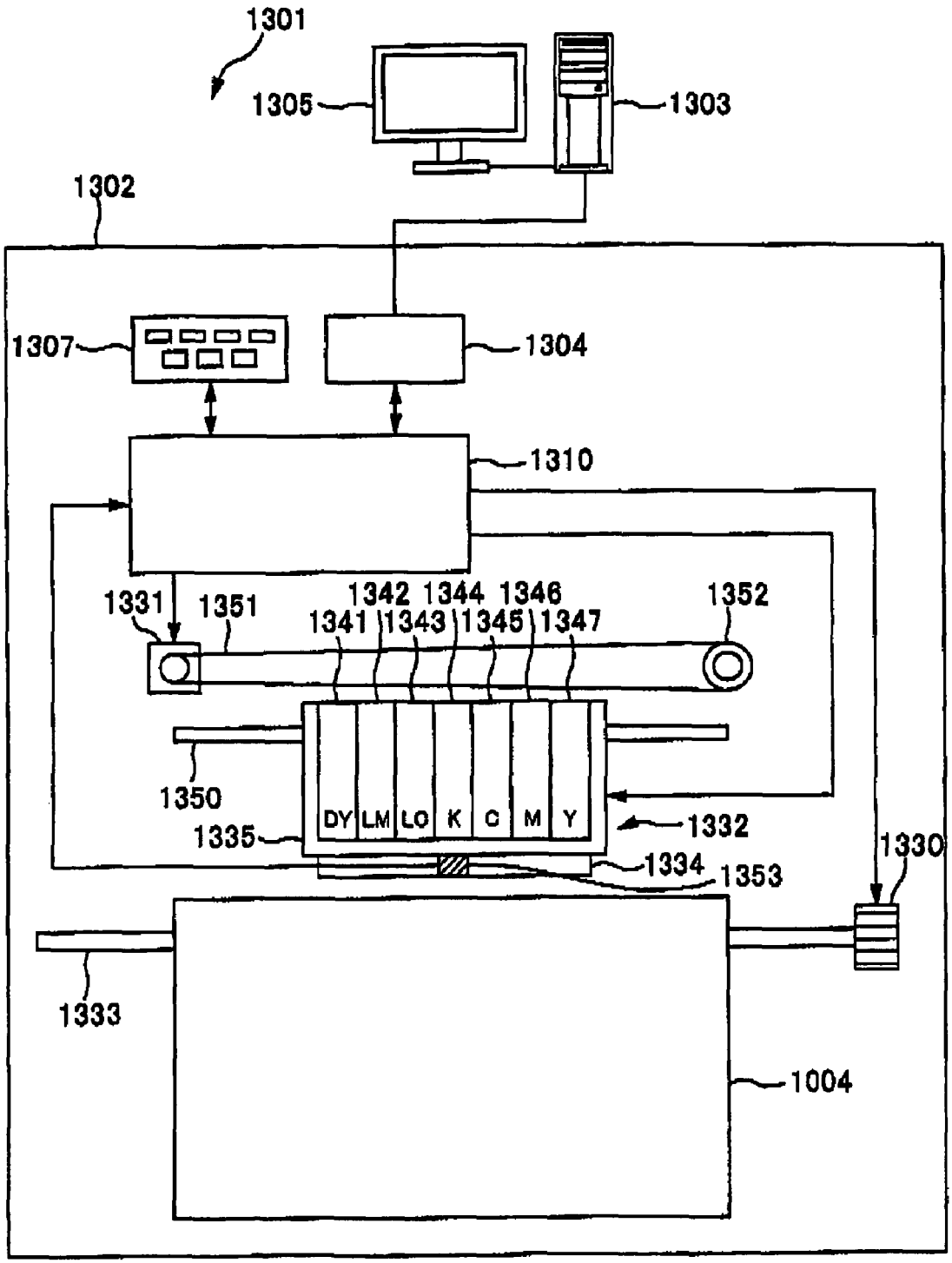
FIG. 33 is a diagram schematically showing the structure of the printing apparatus according to a fifth embodiment of the present invention.
Figure 34:
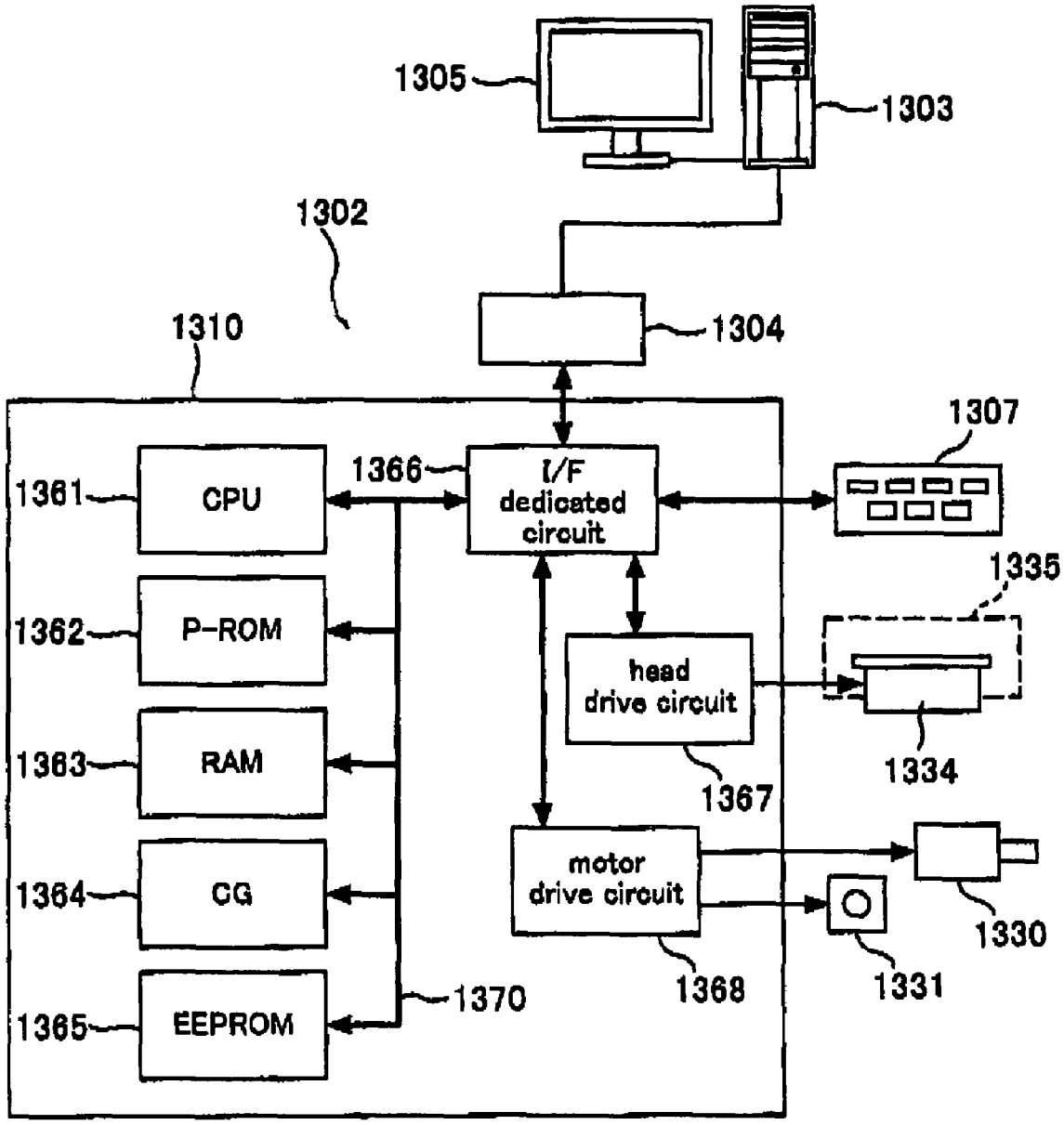
FIG. 34 is a diagram showing the configuration of the printer in the printing apparatus shown in FIG. 33.
Figure 35:
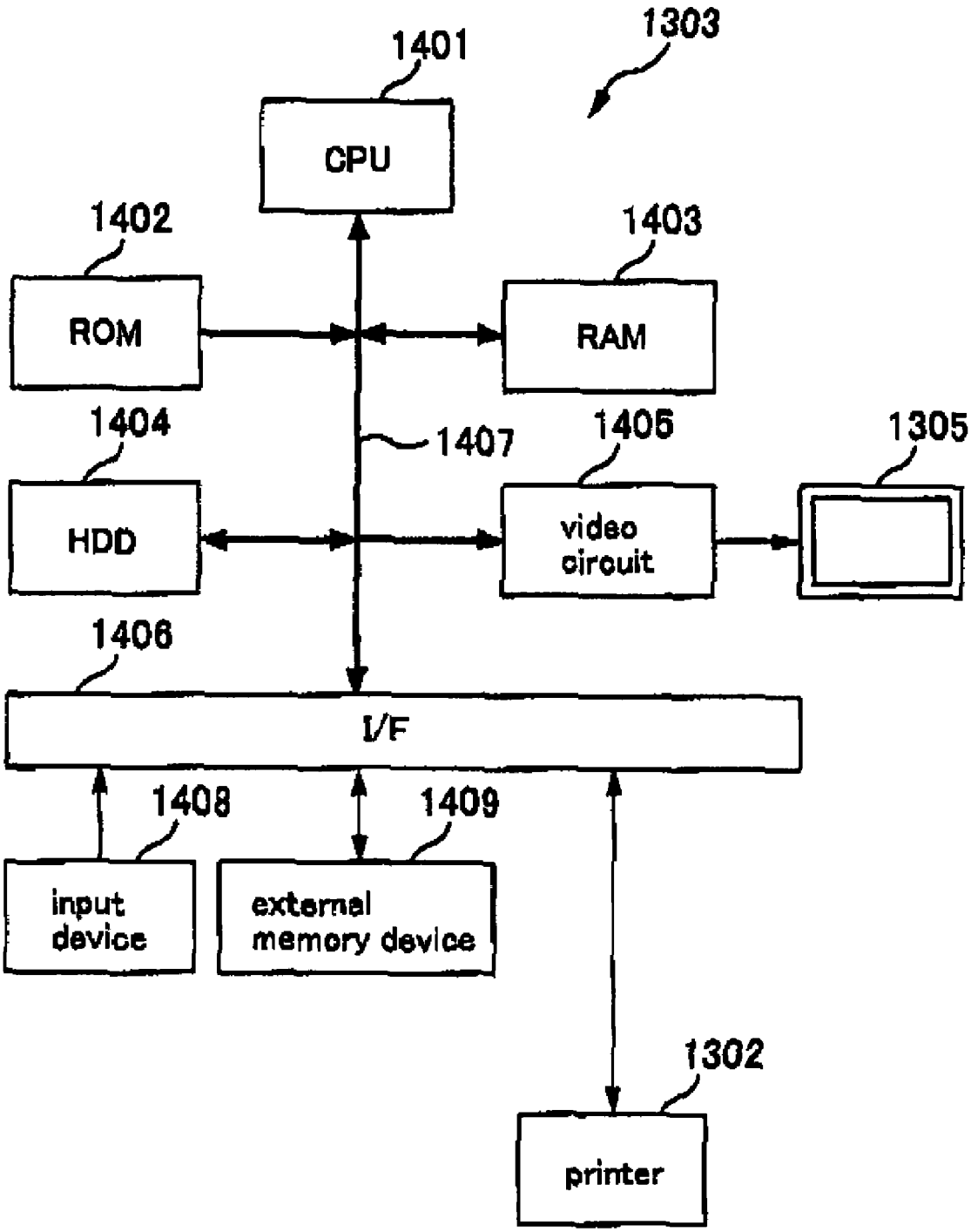
FIG. 35 is a diagram showing the configuration of the computer in the printing apparatus shown in FIG. 33.
Figure 36:
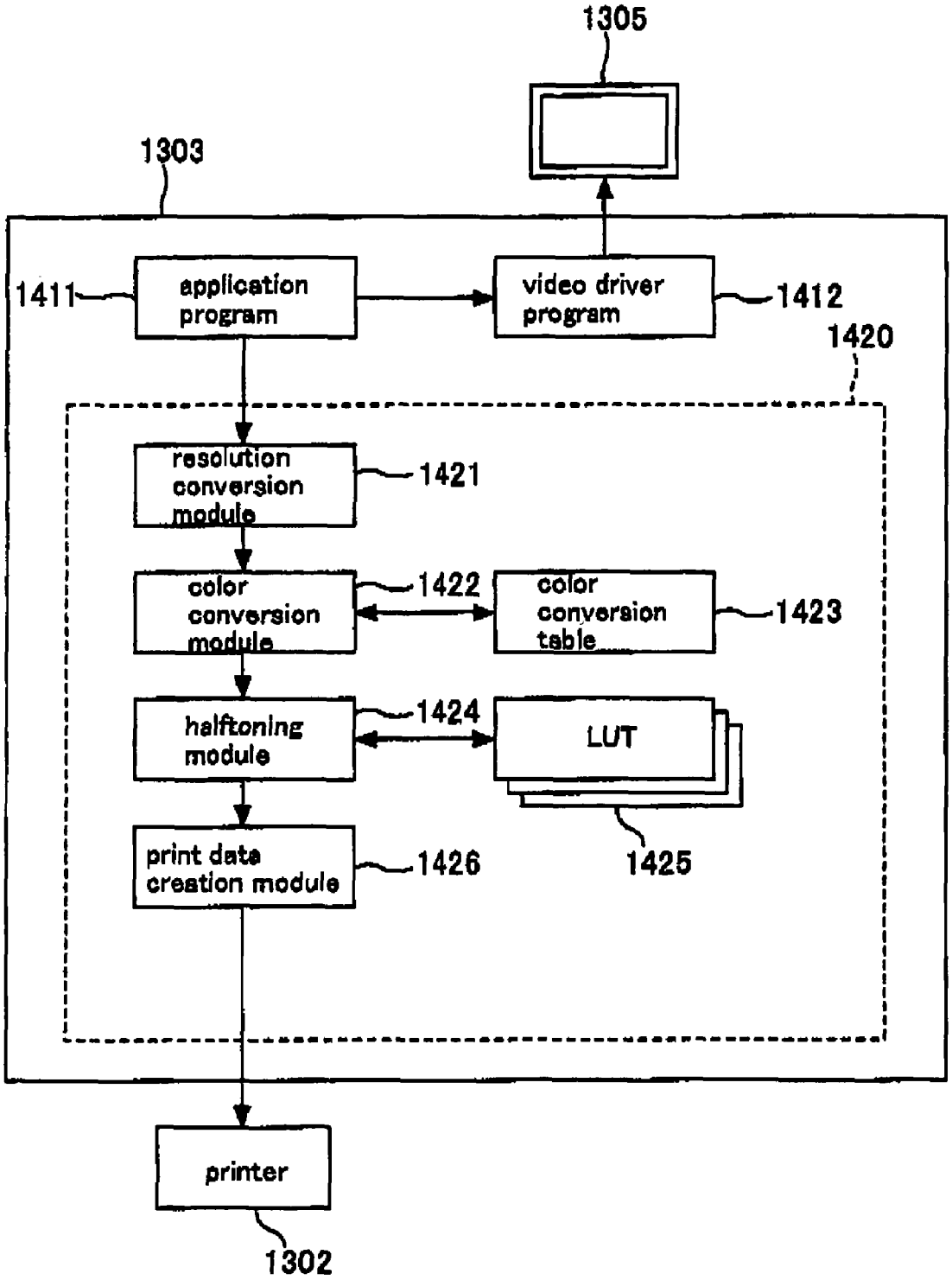
FIG. 36 is a diagram for describing the functions of the program and printer driver installed on the computer in the printing apparatus shown in FIG. 33.

FIG. 33 is a structural diagram schematically showing a printing apparatus 1301 made of a printer 1302 and a computer 1303. FIG. 34 is a block diagram showing an example of the structure of the printer 1302. FIG. 35 is a diagram showing an example of the structure of the computer 1303. FIG. 36 is a diagram for describing the functions of the programs and drivers installed on the computer 1303.

As shown in FIG. 33, the printer 1302 has a carrying mechanism that carries a print paper 1004 using a paper feed motor 1330 and a carriage moving mechanism for moving a carriage 1332 back and forth in the axial direction of a paper feed roller 1333 using a carriage motor 1331. The definitions of the movement direction and the carrying direction are the same as the definitions provided in the fourth embodiment.

Also, the printer 1302 is provided with a print head unit 1335 that is mounted to the carriage 1332 and that is provided with a print head 1334, a head drive mechanism for driving the print head unit 1335 to control the ejection of ink and dot formation, and a control circuit 1310 for governing the sending and receiving of signals to and from the paper feed motor 1330, the carriage motor 1331, the print head unit 1335, and a control panel 1307.

The control circuit 1310 is connected to the computer 1303 via a connector 1304. The computer 1303 is provided with a driver for the printer 1302, and constitutes a user interface for receiving commands made by a user operating an input device such as a keyboard or a mouse and for presenting various types of information in the printer 1302 through a screen display on a display device.

As shown in FIG. 33, various ink cartridges 1341 to 1347 are detachably mounted to the carriage 1332. The ink cartridges 1341, 1342, 1343, 1344, 1345, 1346, and 1347 are cartridges containing dark yellow (DY), light magenta (LM), light cyan (LC), black (K), cyan (C), magenta (M), and yellow (Y) ink, respectively.

The print head 1334 is provided in a lower section of the carriage 1332. Nozzles serving as ink ejection locations are disposed in the print head 1334 in rows in the carrying direction of the print paper 1004, and each nozzle row respectively corresponds to a particular color of ink.

Further, piezo elements, which are a type of electrostrictive element with excellent responsiveness, are provided in a lower section of the carriage 1332 and disposed for each nozzle in the nozzle rows corresponding to the respective inks. The piezo elements are arranged at positions in contact with a member forming the ink path over which ink is guided to the nozzles. When voltage is applied to the piezo elements, their crystalline structure is deformed and they very quickly convert this electrical energy into mechanical energy.

In this embodiment, voltage of a predetermined duration is applied between electrodes provided on both sides of the piezo element, and the piezo element is elongated during application of the voltage and deforms one lateral wall of the ink path. As a result, the volume of the ink path is constricted by an amount corresponding to the elongation of the piezo element, and ink corresponding to this amount of constriction becomes an ink droplet and is quickly ejected from the tip of the nozzle. The ink droplet soaks into the print paper 1004, which is guided along the paper feed roller 1333, thereby forming a dot and carrying out printing. The size of the ink droplets can be changed depending on the method for applying voltage to the piezo elements. It is thus possible to form dots at, for example, three different sizes, these being large, medium, and small.

The carrying mechanism for carrying the print paper 1004 is provided with a gear train (not shown) that transmits the rotation of the paper feed motor 1330 to the paper feed roller 1333 and a paper carry roller (not shown). Further, the carriage moving mechanism for moving the carriage 1332 back and forth is provided with a slide shaft 1350 which runs parallel to the axis of the paper feed roller 1333 and which slidably retains the carriage 1332, a pulley 1352, with an endless drive belt 1351 being provided spanning between the pulley 1352 and the carriage motor 1331, and an optical sensor 1353 for detecting the print start position of the print paper 1004 and marks 1085, for example, on the mark sheet 1080 described above, for example.

The optical sensor 1353 is made of a light source (such as a LED (Light Emitting Diode)) for emitting light to the print paper 1004, and a detection section (such as a photodiode) for converting light that is reflected by the print paper 1004 into corresponding electrical signals. The optical sensor 1353 is mounted to the carriage 1332, and thus can move in the movement direction of the carriage 1332. The optical sensor 1353 can also detect whether or not the paper is present, and thus can detect the paper width by detecting the end portions of the paper during movement of the carriage 1332, and can detect the upper end or the lower end of the paper by detecting an end portion of the paper during carrying.

As shown in FIG. 34, the control circuit 1310 is constituted by an arithmetic and logic circuit that is provided with a CPU (central Processing Unit) 1361, a programmable ROM (P-ROM (Read Only Memory)) 1362, a RAM (Random Access Memory) 1363, a character generator (CG) 1364 storing character dot matrix, and an EEPROM (Electronically Erasable and Programmable ROM) 1365, and that is capable of sending and receiving signals among these through a bus 1370. The EEPROM 1365 is a memory means for storing a database correlating print properties with information on the position of the marks 1085 etc. on the mark sheet 1080, for example.

The control circuit 1310 is further provided with an I/F dedicated circuit 1366, which is an interface (I/F) between the control circuit 1310 and external motors etc., a head drive circuit 1367 that is connected to the I/F dedicated circuit 1366 and that is for driving the print head unit 1335 and causing it to eject ink, and a motor drive circuit 1368 for driving the paper feed motor 1330 and the carriage motor 1331.

The I/F dedicated circuit 1366 is internally provided with a parallel interface circuit, and via the connector 1304 is capable of receiving print signals PS that are supplied from the computer 1303.

As shown in FIG. 35, the computer 1303 is constituted by a CPU 1401, a ROM 1402, a RAM 1403, a HDD (Hard Disk Drive) 1404, a video circuit 1405, an I/F 1406, a bus 1407, the display device 1305, an input device 1408, and an external memory device 1409.

Here, the CPU 1401 is a controller (controlling section) that performs various computer processing in accordance with the programs stored on the ROM 1402 and the HDD 1404, and controls the various sections of the apparatus. The CPU 1401 sends, to the printer, control codes for controlling the various sections in the printer to control the carriage moving mechanism to move the carriage (and print head) and to control the carrying mechanism to carry the print paper in the carrying direction, and can control the head drive mechanism to cause the print head to eject ink. The CPU 1401 also receives the results of detection by the optical sensor 1353, analyzes these detection results, and sends control codes based on the results of this analysis to the printer.

The ROM 1402 is a memory storing basic programs and data executed by the CPU 1401. The RAM 1403 is a memory for temporarily storing programs being executed by the CPU 1401 and data being computed, for example.

The HDD 1404 is a storage device for reading out data or programs stored on a hard disk, which is a storage medium, in accordance with requests from the CPU 1401, and for storing data generated as the outcome of computer processing by the CPU 1401 on that hard disk.

The video circuit 1405 is a circuit for executing rendering processes in accordance with picture commands supplied from the CPU 1401 to convert obtained image data into a video signal, and outputting this signal to the display device 1305. The I/F 1406 is a circuit for suitably converting the expression format of signals that are output from the input device 1408 and the external memory device 1409 and outputting print signals PS to the printer 1302.

The bus 1407 is a signal line that connects the CPU 1401, the ROM 1402, the RAM 1403, the HDD 1404, the video circuit 1405, and the I/F 1406 to one another, allowing data to be sent and received between them.

The display device 1305 is a device such as a LCD (Liquid Crystal Display) monitor or a CRT (Cathode Ray Tube) monitor, and displays images corresponding to video signals output from the video circuit 1405. The input device 1408 is a device such as a keyboard or a mouse, and is for generating signals corresponding to operations performed by a user and supplying these to the I/F 1406.

The external memory device 1409 is a device such as a CD-ROM (Compact Disk-ROM) drive unit, a MO (Magneto Optic) drive unit, or a FDD (Flexible Disk Drive) unit, and is for reading data and programs stored on CD-ROM disks, MO disks, or FDs and supplying these to the CPU 1401. If the external memory device 1409 is a MO drive unit or a FDD unit, then it also functions as a device for storing data supplied from the CPU 1401 on a MO disk or a FD.

FIG. 36 is a diagram for describing the functions of the programs and the drivers installed on the computer 1303. It should be noted that these functions can be achieved through cooperation between the hardware of the computer 1303 and software stored on the HDD 1404. As shown in the drawing, an application program 1411, a video driver program 1412, and a printer driver program 1420 are installed on the computer 1303. These operate under a predetermined operating system (OS).

The application program 1411 is an image processing program, for example, and outputs data that have been subjected to image processing to the printer driver program 1420 and the video driver program 1412.

The video driver program 1412 is a program for driving the video circuit 1405, and for example performs gamma processing or adjusts the white balance of data supplied from the application program 1411, and then creates video signals and supplies these to and displays them on the display device 1305.

The printer driver program 1420 is made of a resolution conversion module 1421, a color conversion module 1422, a color conversion table 1423, a halftoning module 1424, a LUT (Look Up Table) 1425, and a print data creation module 1426, and subjects the data created by the application program 1411 to various processes described later to produce print data that it supplies to the printer 1302. The printer driver program 1420 also executes processing to update the LUT 1425 in accordance with the type of the print medium on which the image(s) is to be printed.

Here, the resolution conversion module 1421 performs processing for converting the resolution of the data supplied form the application program 1411 in accordance with the resolution of the print head 1334.

The color conversion module 1422 performs processing for converting image data expressed in the RGB (Red, Green, Blue) color system into image data of a C, M, Y, K, LC, LM, and DY (Cyan, Magenta, Yellow, Black, Light Cyan, Light Magenta, Dark Yellow) color system with reference to the color conversion table 1423.

The halftoning module 1424 converts, through dithering, image data expressed in the C, M, Y, K, LC, LM, and DY color system to bitmap data made of combinations of three types of dots, these being large, medium, and small dots, with reference to the LUT 1425.

The print data creation module 1426 creates print data including raster data indicating the manner in which dots are recorded and data indicating the carry amount (sub-scan feed amount) from the bitmap data output from the halftoning module 1424, and supplies these to the printer 1302.

It should be noted that the process of the fifth embodiment is the same as that of the fourth embodiment described with reference to FIGS. 23 to 32, and thus description thereof is omitted.

Embodiments of the present invention have, been described above, but various modifications other than these can be made to the present invention. For example, in the foregoing embodiments, oval check boxes were used, but it is also possible to instead use, for example, rectangular or circular check boxes. It is also possible to dispose the optical sensor 1053, 1353 on another reciprocating movement member such as the drive belt 1051, 1351, instead of on the print head 1034, 1334.

It is also possible to print, on the mark sheet 1080 etc., a code (such as a bar code) for identifying the type of mark sheet 1080 etc. so as to determine which mark sheet 1080 etc. has been inserted. With such an embodiment, even if an incorrect mark sheet 1080 etc. is inadvertently inserted, it is possible to keep that mark sheet from being incorrectly recognized.

When printing the mark sheet 1080 etc. it is also possible to print only the plurality of the print property patterns 1083 etc. when a print paper 1004 on which the check box print region 1082, for example, has been printed in advance is inserted through the paper supply opening 1002. Moreover, it is also possible for the optical sensor 1053, 1353 to detect whether or not there is a hole (subordinate concept of a "mark") provided in a check box 1084 etc., instead of detecting a mark 1085 etc. on the mark sheet 1080 etc. Moreover, in place of the optical sensor 1053, it is also possible to adopt a sensor made of a light source and a light-receiving element disposed on the rear side of the light source, sandwiching the print paper 1004 and the mark sheet 1080 between them, and to detect the position of the end portions of the print paper 1004 and the marks 1085 etc. on the mark sheet 1080 etc. based on the transmissivity of the light. It is further possible to employ a magnetic sensor as the sensor to detect whether or not magnetic particles included in the marks 1085 etc. are present.

Also, in the above embodiments, information on the position of the check boxes 1084 etc. is stored on the EEPROM 1065, 1365, but this information can also be stored on the P-ROM 1062, 1362 or the HDD 1404 of the personal computer 1303, for example.

In the foregoing embodiments, Bi-D adjustment and PF adjustment were described as examples of print properties, but as the print properties it is also possible to use brightness, color saturation, contrast, paper feed amount, paper size, paper type, picture quality, borderless printing, and image layout if a plurality of images are to be printed on a single sheet of print paper, for example.

Also, in the foregoing embodiments, the four colors of CMYK were used for the ink, but in place of these four colors, or in addition to these four colors, it is also possible to use light-colored ink (light cyan (LC), light magenta (LM), dark yellow (DY)). Also, in the foregoing embodiments, a printer provided with a head for ejecting ink using piezo elements is employed, but it is also possible to adopt various ejection drive elements other than piezo elements. For example, the present invention can also be adopted for printers provided with ejection drive elements of a type that eject ink through bubbles generated within the ink path by passing a current through a heater disposed in the ink path. It is of course also possible to adopt the present invention for so-called laser printers or the like.

It should be noted that the program in which the above processes and functions are written can be stored on a computer-readable storage medium. Examples of a computer-readable storage medium include magnetic recording devices, optical disks, magneto optic recording media, and semiconductor memories. Magnetic recording devices include hard disk drives (HDD), flexible disks (FD), and magnetic tapes. Examples of optical disks include DVDs, DVD-RAMs (Random Access Memory), CD-ROMs, and CD-R (Recordable)/RW (ReWritable) disks. Magneto optic recording media include MOs.

If the program is to be distributed, then for example transportable recording media such as DVDs or CD-ROMs storing the program will be sold commercially. It is also possible to store the program on a storage device of a server computer and to transfer the program from the server computer to other computers over a network.

A computer for executing the program, for example, stores the program that is stored on a transportable recording medium or the program that is transferred from the server computer on its own memory device. Then, the computer reads the program from its own memory device and executes processing in accordance with the program. It should be noted that it is also possible for the computer to read the program directly from the transportable recording medium and to execute processing in accordance with the program. It is also possible for the computer to consecutively execute processing in accordance with the obtained program each time the program is transferred from a server computer.

Sixth Embodiment

<Regarding the Mark Sheet for Image Printing>

The structure of the printer of the sixth embodiment is the same as that of the fourth embodiment, and thus description thereof is omitted.

Figure 37:
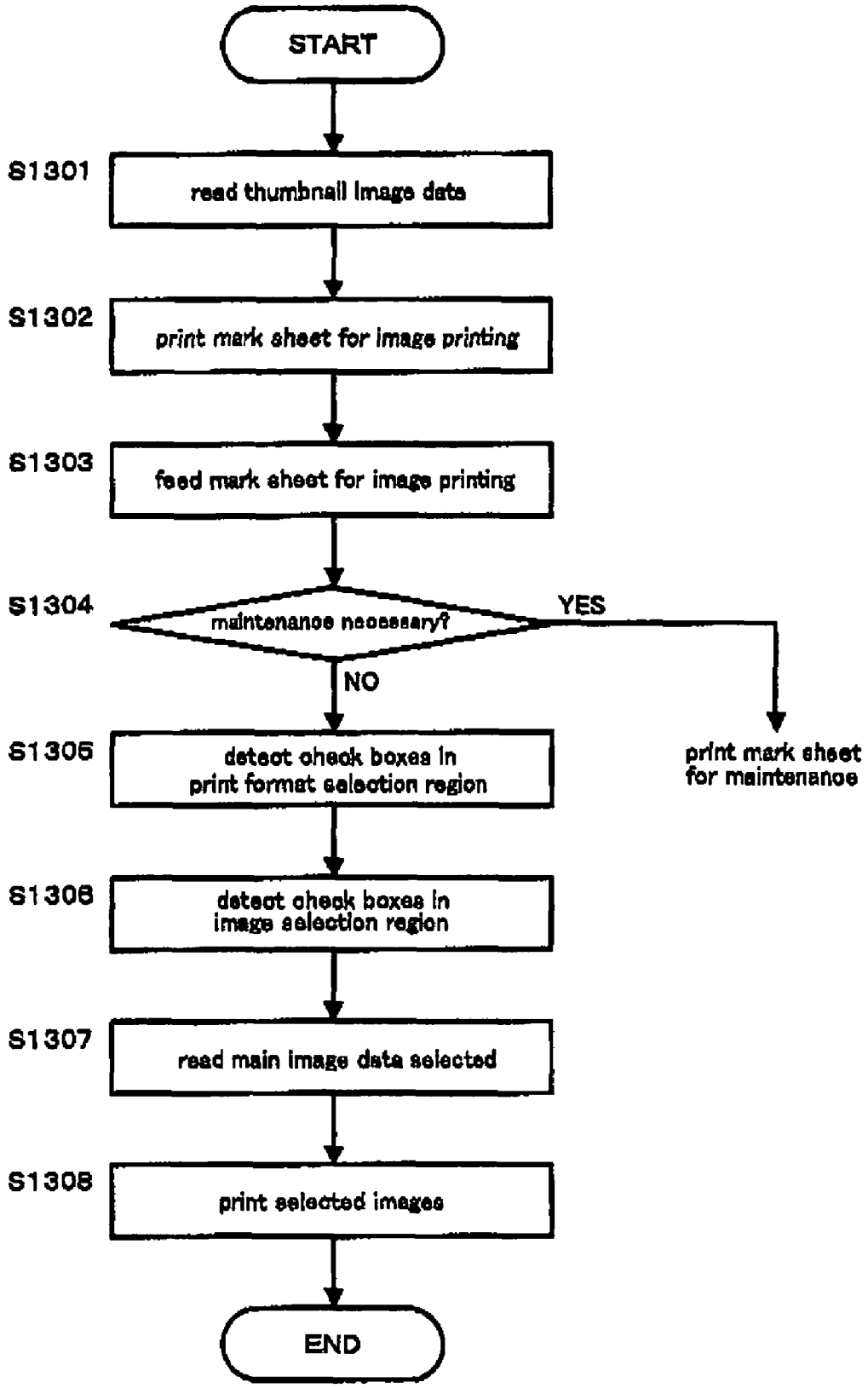
FIG. 37 is a flowchart for a sixth embodiment.

FIG. 37 is a flowchart of procedure of the Sixth embodiment. The CPU 1061 of the printer controls the various sections in the printer in accordance with the program stored on the P-ROM 1062 and executes the procedure of this flowchart. It should be noted that this procedure is started when the memory card has been inserted into the drive unit 1008 or when a digital camera (with a memory card inserted in the digital camera) has been connected to the printer.

The memory card stores a plurality of image data sets recorded with the digital camera. When the user has captured natural scenery or the like with the digital camera, the digital camera creates main data using set conditions and also creates thumbnail image data based on this main image data, and stores the main image data and the thumbnail image data on the memory card as an image data set. Thus, each image data set on the memory card contains a main image data at high resolution and a thumbnail image data created from the main image data.

First, the CPU 1061 of the printer reads the thumbnail image data of all the image data sets from the memory card (step S1301). The CPU 1061 develops the thumbnail image data that have been read on the RAM 1063 and creates print signals for printing a mark sheet for image printing. The CPU 1061 controls various sections in the printer (the carriage moving mechanism, the carrying mechanism, the head drive mechanism, etc.) based on the print signals that are created to print a mark sheet for image printing (step S1302).

Figure 38:
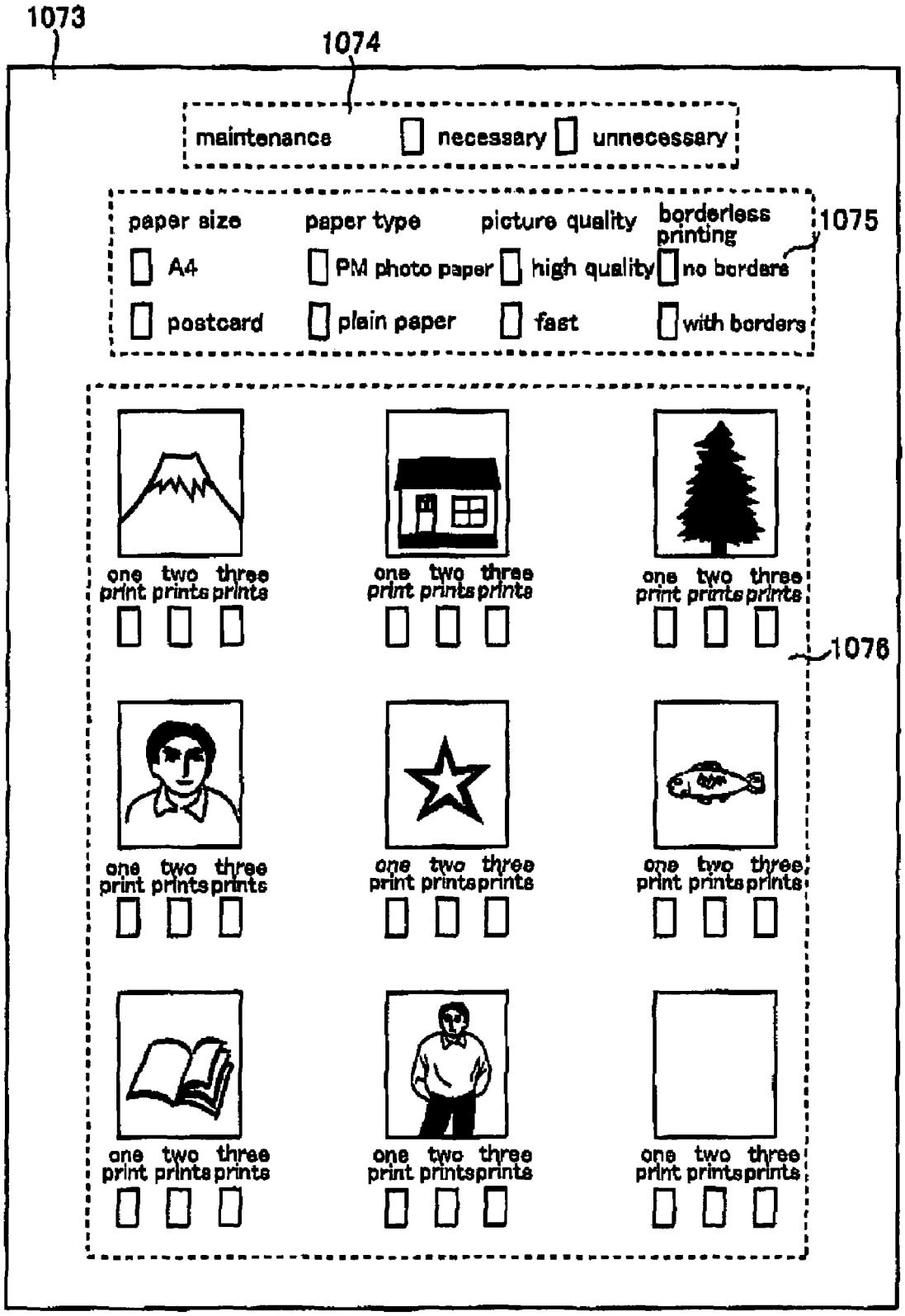
FIG. 38 is an explanatory diagram of a mark sheet 1073 for image printing.

FIG. 38 is an explanatory diagram of a mark sheet 1073 for image printing. This mark sheet 1073 includes a maintenance command region 1074 for selecting whether or not maintenance is necessary, a print format selection region 1075, and an image selection region 1076. The print format selection region 1075 includes check boxes that have been printed to correspond to various headings such as "paper size." The image selection region 1076 includes thumbnail images printed based on the thumbnail image data and check boxes printed to correspond to the thumbnail images.

Figure 39:
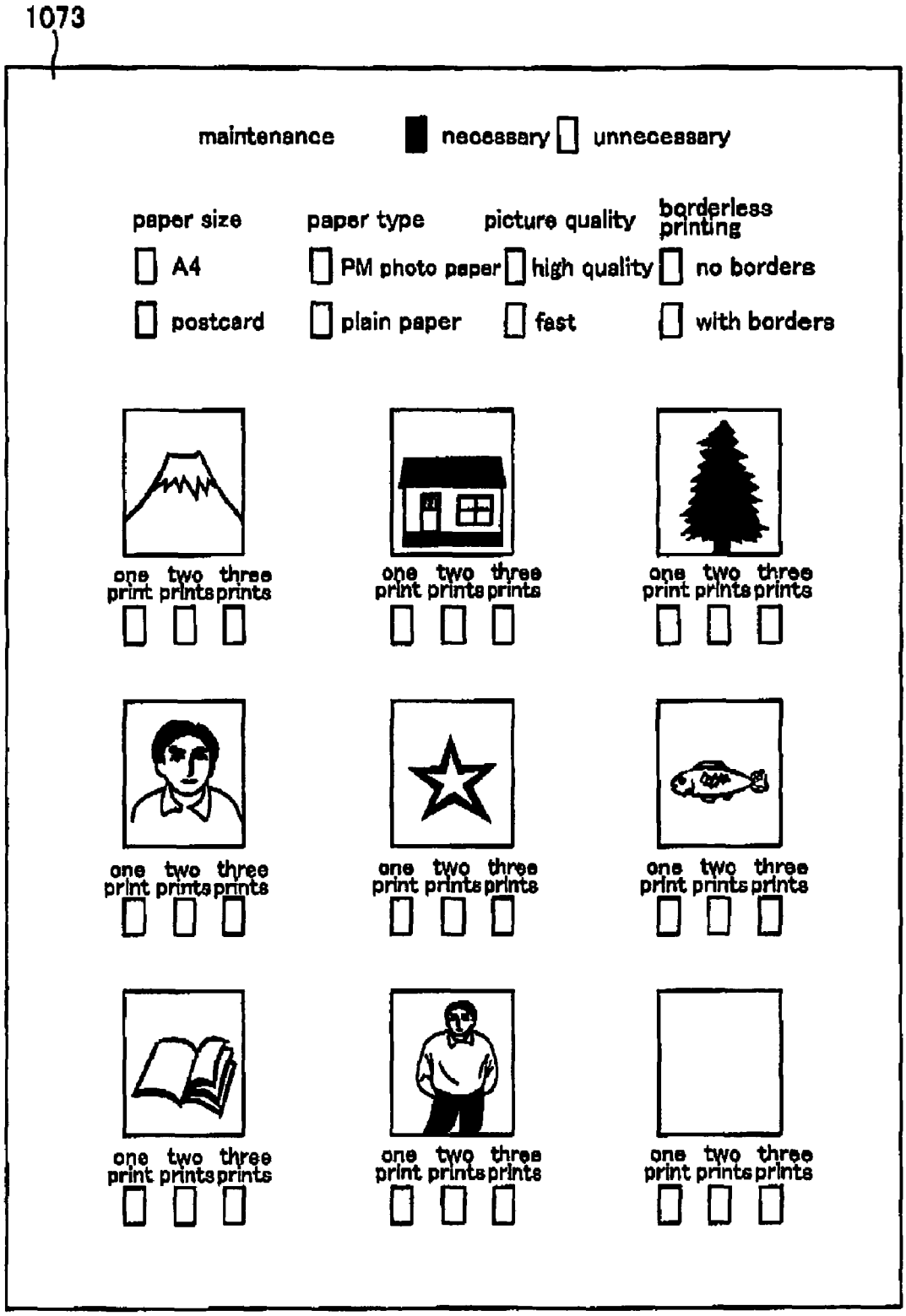
FIG. 39 is an explanatory diagram of the mark sheet when maintenance is necessary.
Figure 40:
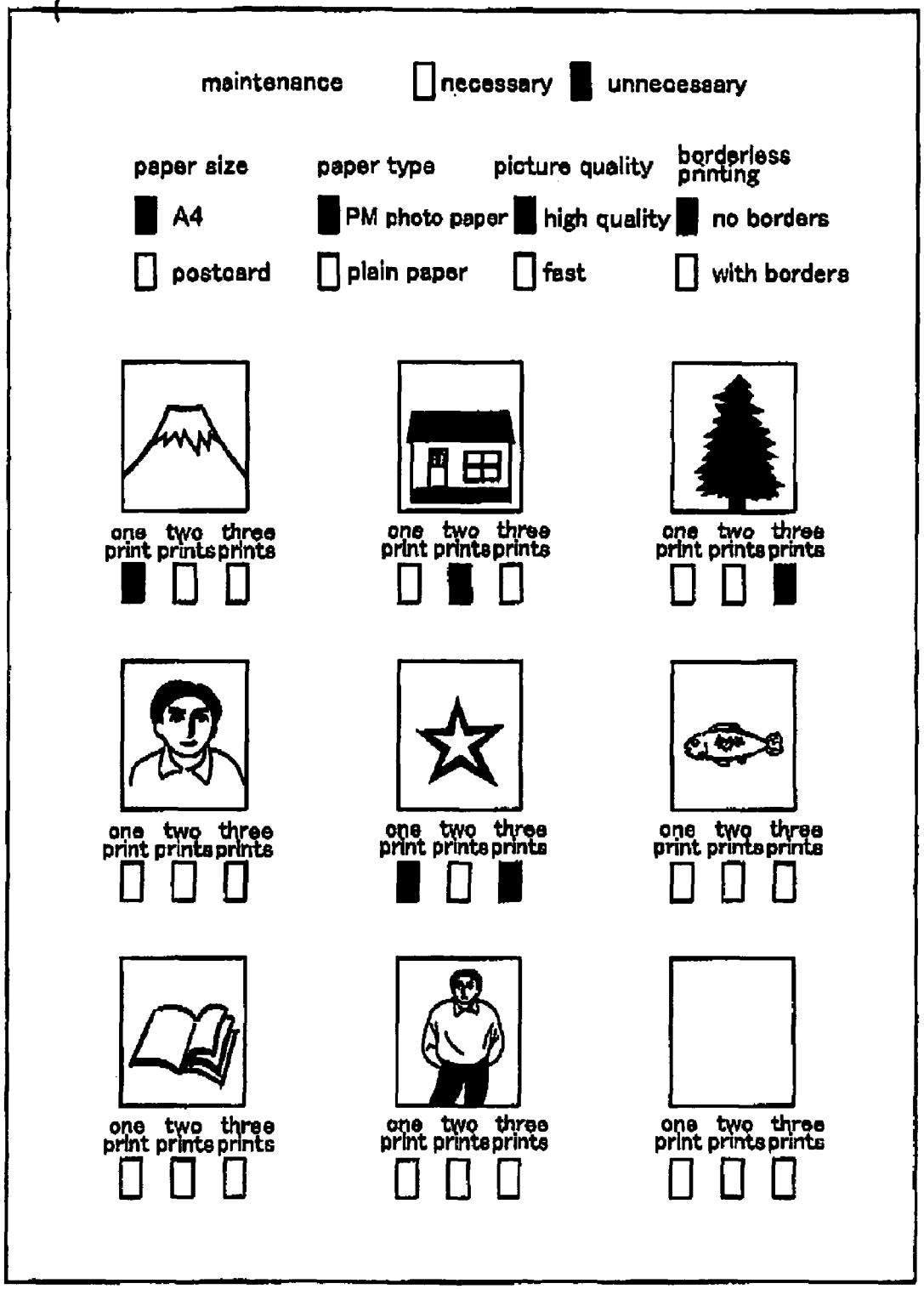
FIG. 40 is an explanatory diagram of the mark sheet when maintenance is not necessary.

The user looks at the thumbnail images printed in the image selection region 1076 and determines whether or not maintenance of the printer is necessary, and then fills in a check box of the maintenance command region 1074. For example, if the thumbnail images have poor quality, then the user fills in the check box indicating that maintenance is necessary (FIG. 39). If maintenance is not necessary, then the user fills in the check boxes of the print format selection region 1075 to select the paper size, for example, and fills in the check boxes of the image selection region 1076 to select images that he/she would like to have printed and the number of those images to be printed (FIG. 40). After finishing filling in the mark sheet, the user sets the mark sheet in the paper supply opening 1002 of the printer. At this time the user sets the mark sheet in the printer in such a manner that the maintenance command region 1074 is fed before the image selection region 1076.

Next, the CPU 1061 of the printer starts feeding of the mark sheet (step S1303). First, the CPU 1061 causes the carrying mechanism to carry the mark sheet up to a position where the optical sensor 1053 can read the check boxes of the maintenance command region 1074. After this carrying, the CPU 1061 moves the carriage in the movement direction and causes the optical sensor 1053 to read the check boxes of the maintenance command region 1074. Then, the CPU 1061 determines whether or not maintenance is necessary based on the results of the reading by the optical sensor 1053 (step S1304).

If maintenance is not necessary, then the CPU 1061 causes the carrying mechanism to further carry the mark sheet up to a position where the optical sensor 1053 can read the check boxes of the print format selection region 1075. After this carrying, the CPU 1061 moves the carriage in the movement direction and causes the optical sensor 1053 to read the check boxes of the print format selection region 1075 (step S1305). The CPU 1061 then determines the print format based on the results of this reading and stores the print format that has been chosen on the RAM 1063.

The CPU 1061 then causes the carrying mechanism to further carry the mark sheet up to a position where the optical sensor 1053 can read the check boxes of the image selection region 1076. After this carrying, the CPU 1061 moves the carriage in the movement direction and causes the optical sensor 1053 to read the check boxes of the image selection region 1076 (step S1306). The CPU 1061 specifies the images selected by the user and determines the number of prints of those images based on the reading results.

Next, the CPU 1061 reads the main image data of the image data sets corresponding to the images selected by the user from the memory card (step S1307). The CPU 1061 develops the main data that have been read on the RAM 1063 and creates print signals according to the print format determined by the results of reading the print formation selection region 1075. The CPU 1061 then controls the various sections in the printer based on the print signals that are created so as to print the number of prints of the images that have been determined by reading the print format selection region 1075 (step S1308).

If in step S1304 it is determined that maintenance is necessary, then the CPU 1061 causes the carrying mechanism to discharge the mark sheet 1073 for image printing, and controls the various sections in the printer to print a mark sheet for maintenance. The mark sheet for maintenance is a mark sheet for performing maintenance of the various sections of the printer. Examples of the mark sheet for maintenance include a mark sheet for adjustment of the ink ejection timing during bidirectional printing (Bi-D adjustment) discussed above and a mark sheet for adjusting the carry amount (PF adjustment) discussed above. The process after printing of the mark sheet has been described previously, and thus is not described here. A mark sheet used for testing nozzle ejection is described below as an example of the mark sheet for maintenance.

<Regarding the Configuration of the Nozzles>

Figure 41:
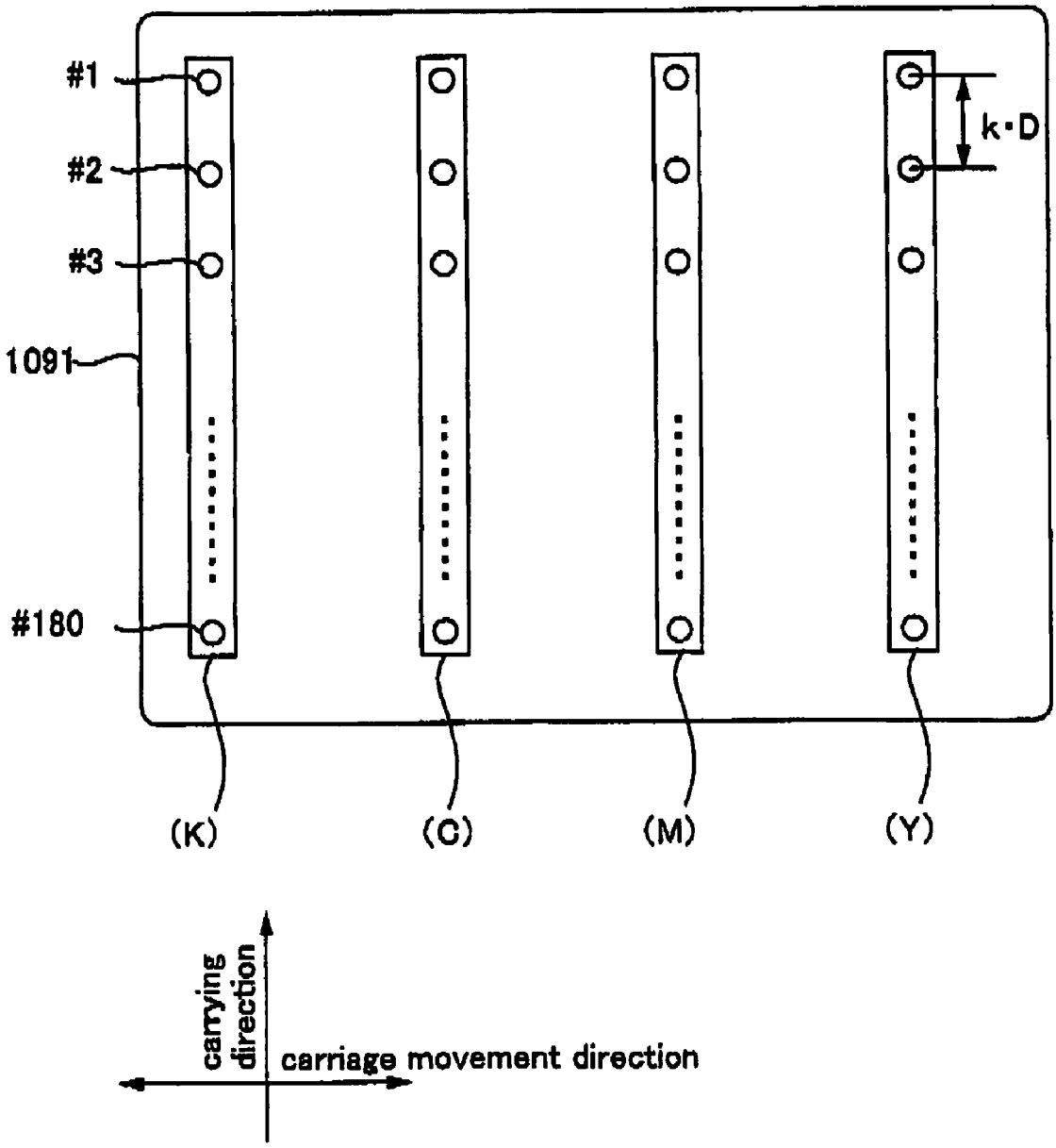
FIG. 41 is an explanatory diagram showing the arrangement of the nozzles.

First, the configuration of the nozzles to be tested is described. FIG. 41 is an explanatory diagram showing the arrangement of the nozzles.

A black ink nozzle row (K), a cyan ink nozzle row (C), a magenta ink nozzle row (M), and a yellow ink nozzle row (Y) are formed in the lower face of the print head. Each nozzle row is provided with a plurality of nozzles, which are ejection openings, for ejecting the various colors of ink (in the present embodiment, 180 nozzles).

The plurality of nozzles of in each nozzle row are arranged in a row at a spacing of 1/180 inch in the paper carrying direction. Further, the nozzles in each nozzle row are assigned numbers that decrease toward the downstream size.

When the printer does not execute printing for a prolonged period of time, there is a possibility that the ink within the nozzles will evaporate and the viscosity of the ink will increase, making it impossible to eject the ink from the nozzles during printing. If there are nozzles that cannot eject ink (ejection defective nozzles), then white stripes (banding) occur on the printed image, and thus, the picture quality deteriorates. For example, if the above mark sheet 1073 for image printing is printed when there are ejection defective nozzles, then white stripes occur in the thumbnail images that are printed in the image selection region 1076. In such a case, the user performs a command to carry out maintenance using the mark sheet 1073 for image printing, and the printer prints a mark sheet for testing nozzle ejection.

<Regarding the Mark Sheet for Testing Nozzle Ejection>

Figure 42:
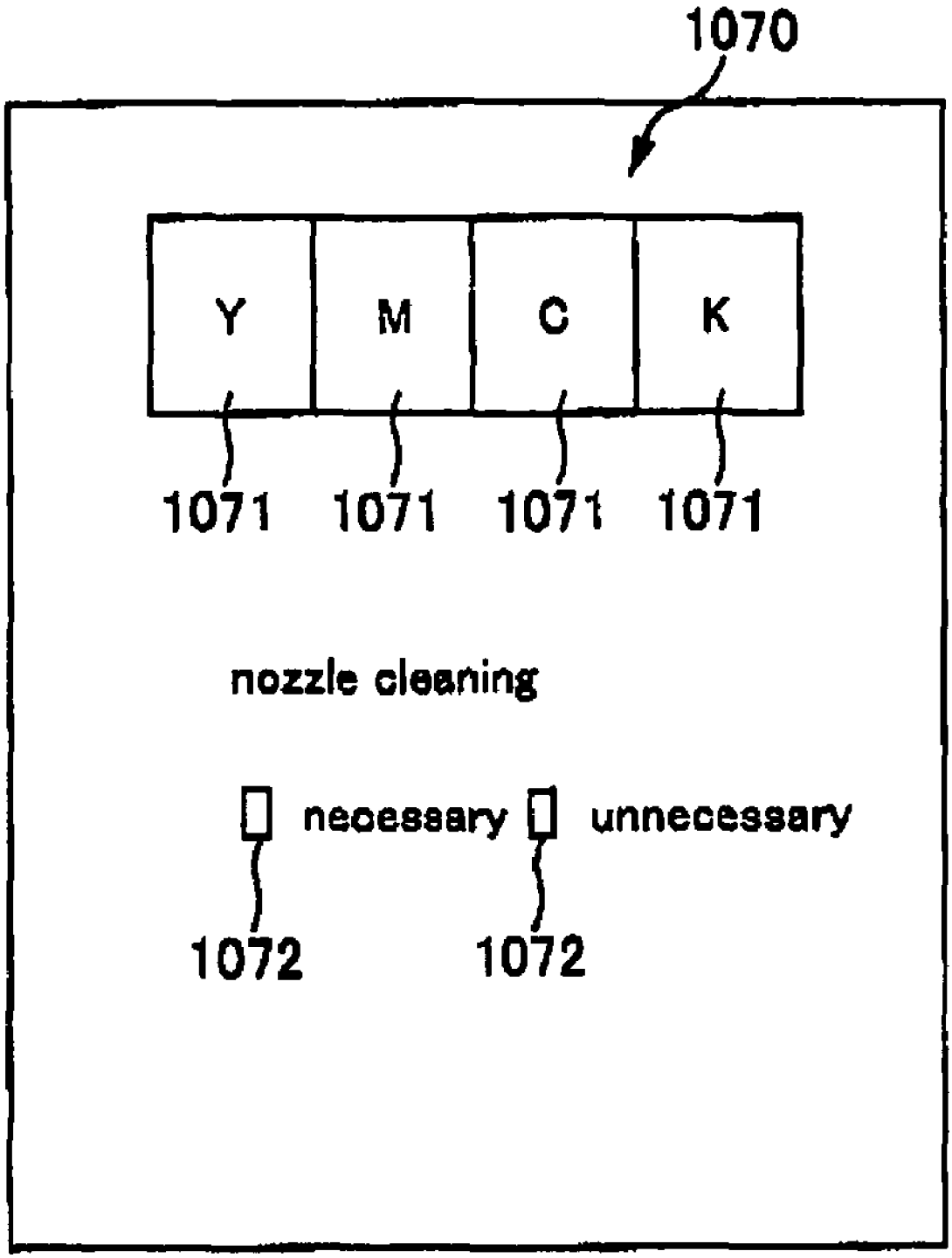
FIG. 42 is a mark sheet that is used to test nozzle ejection.
Figure 43A:
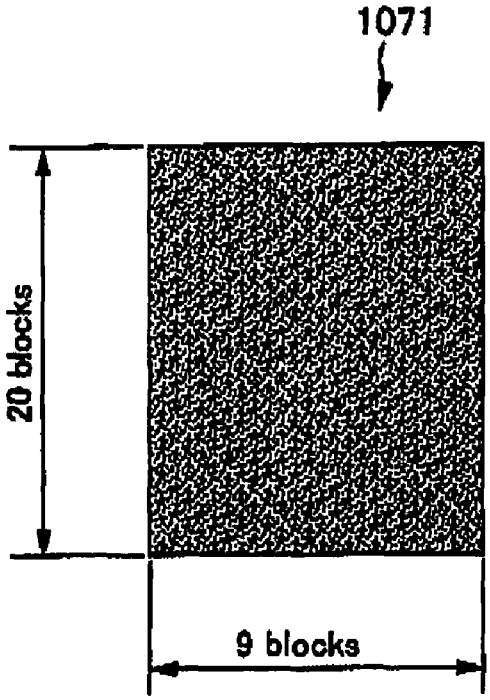
FIG. 43A is an explanatory diagram of a nozzle check pattern 1071 making up the nozzle check pattern group 1070.
Figure 43B:
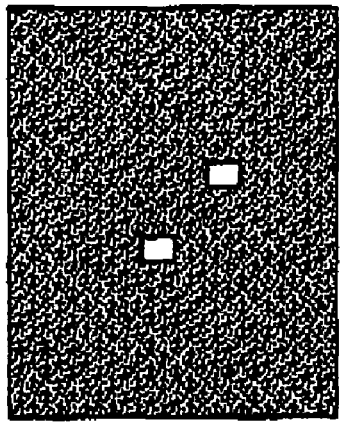
FIG. 43B is an example of a nozzle check pattern when there are nozzles that do not eject ink (when there are ejection defects).
Figure 44:
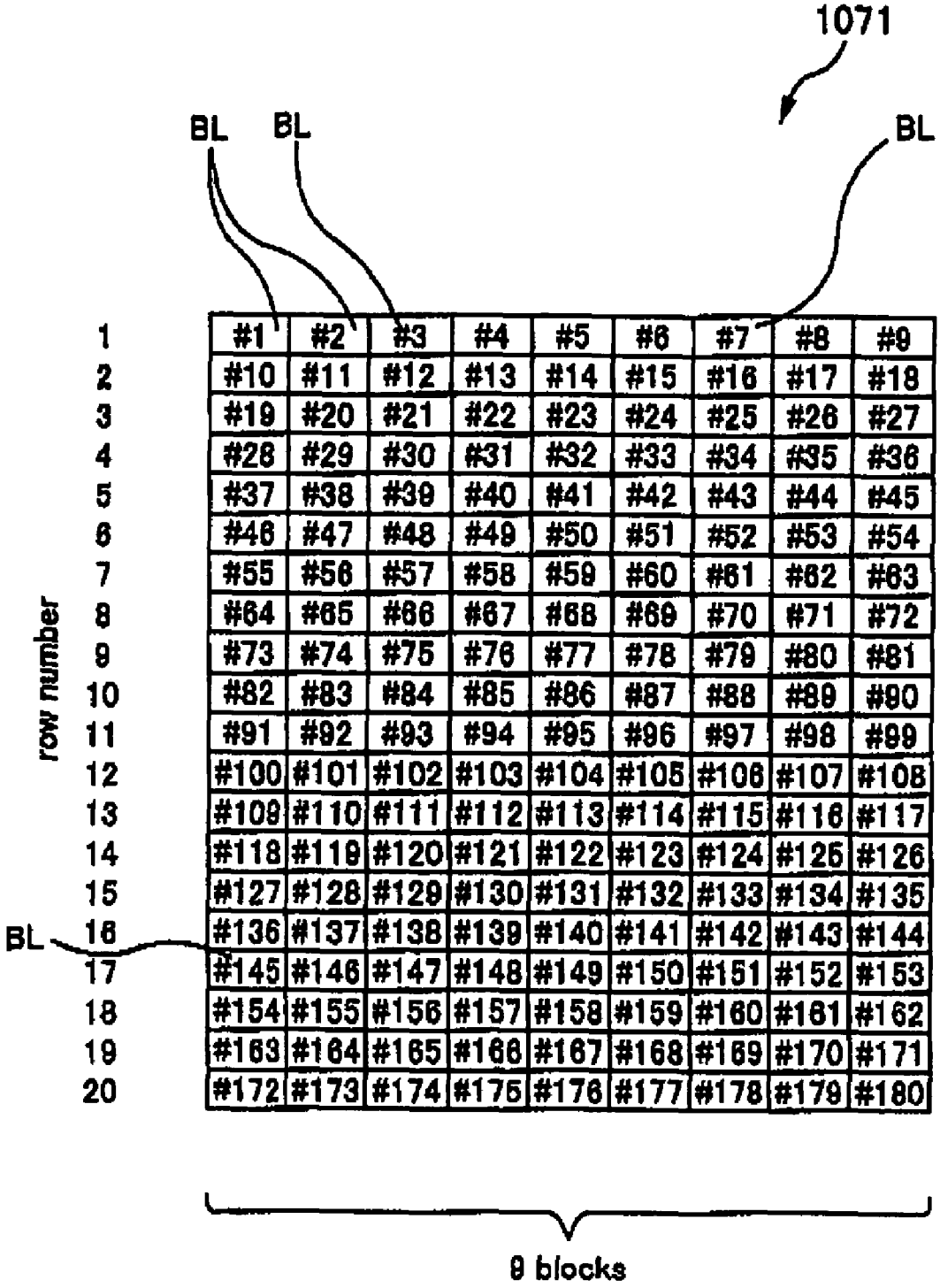
FIG. 44 is an explanatory diagram of the configuration of the nozzle check pattern 1071.
Figure 45:
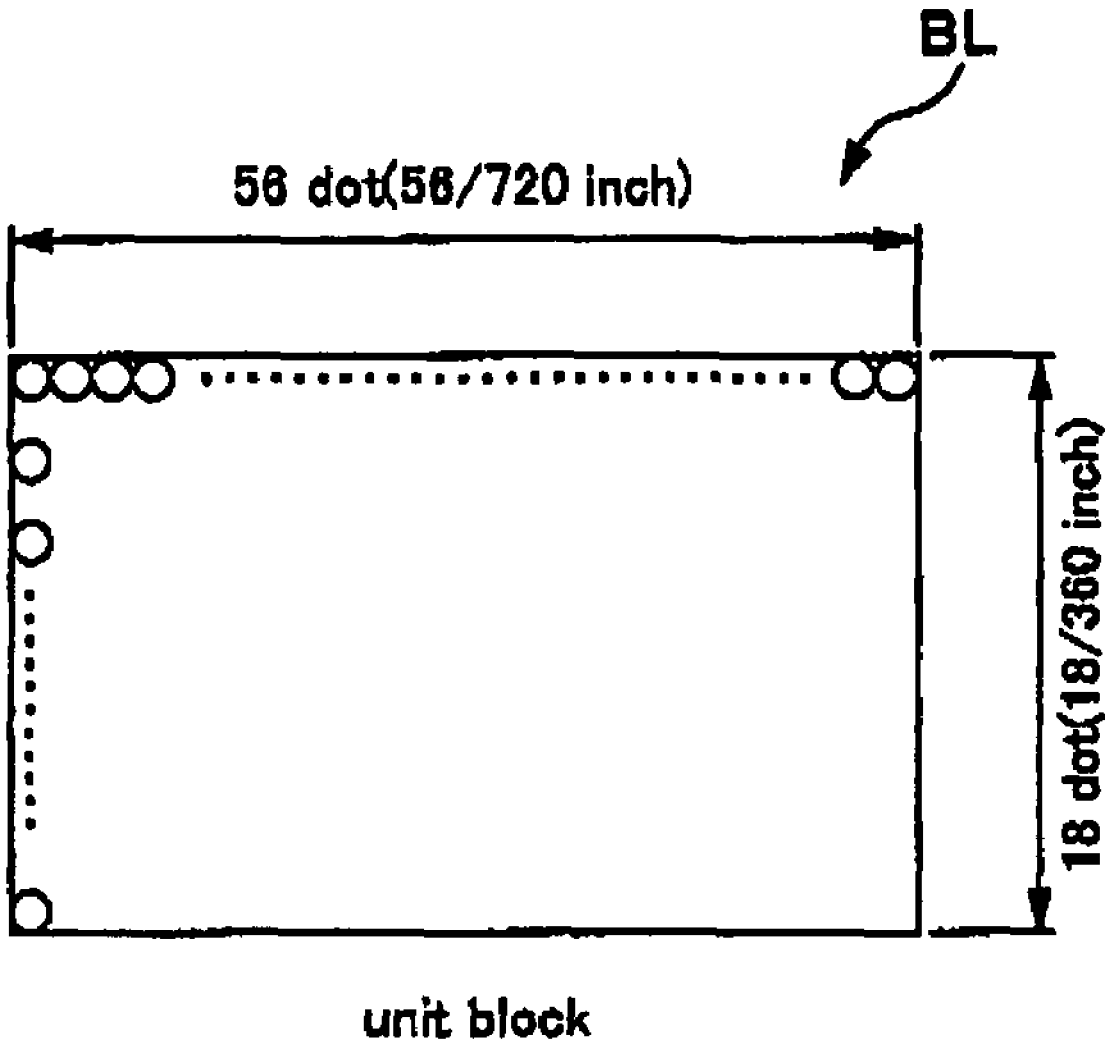
FIG. 45 is an explanatory diagram of a block pattern BL.

FIG. 42 is an explanatory diagram of the mark sheet used for testing nozzle ejection. A nozzle check pattern group 1070 and check boxes 72 for instructing whether or not cleaning is necessary are printed on this mark sheet. FIG. 43A is an explanatory diagram of one of the nozzle check patterns 1071 making up the nozzle check pattern group 1070. FIG. 43B is an example of a nozzle check pattern in a case where there are nozzles that do not eject ink (when there are ejection defects). FIG. 44 is an explanatory of the configuration of one of the nozzle check patterns 1071. FIG. 45 is an explanatory diagram of one of the block patterns BL making up the nozzle check patterns 1071.

The nozzle check pattern group 1070 is made of a plurality of nozzle pattern check patterns 1071. These plurality of patterns 1071 are formed adjacent to one another in the carriage movement direction. Each nozzle check pattern is made of a particular ink color. For example, the nozzle check pattern 1071 labeled "Y" in FIG. 42 is made of yellow ink only. That is, the nozzle check pattern 1071 labeled "Y" in this drawing is formed by the nozzles that eject yellow ink. Also, as will be discussed later, this nozzle check pattern 1071 is used for testing ejection of the nozzles that eject yellow ink. The nozzle check patterns 1071 for the other colors have the same structure.

A single nozzle check pattern 1071 is made of nine block patterns BL arranged in the carriage movement direction and 20 block patterns BL arranged in the carrying direction, amounting to a total of 180 block patterns BL. A single block pattern BL corresponds to a single nozzle. Thus, the 180 block patterns BL are patterns for testing the 180 nozzles.

Each block pattern BL is an elongate pattern made of 56 dots at a 1/720 inch spacing in the carriage movement direction and 18 dots at a 1/360 inch spacing in the carrying direction. The dots of one block pattern BL are formed by ink droplets that are ejected from the same nozzle. For example, the block pattern BL labeled "#1" in FIG. 44 is formed by ink droplets that are ejected from the nozzle #1 only. In this way, each block pattern BL corresponds to a nozzle for forming that block pattern BL. If there are ink non-ejecting nozzles (nozzles that do not eject ink), then, as shown in FIG. 43B, an elongate, blank pattern occurs in the nozzle check pattern 1071. That is, by detecting whether or not there are blank patterns, it is possible to test whether or not there are ink non-ejecting nozzles (i.e., it is possible to detect clogging of the nozzles).

Figure 46:
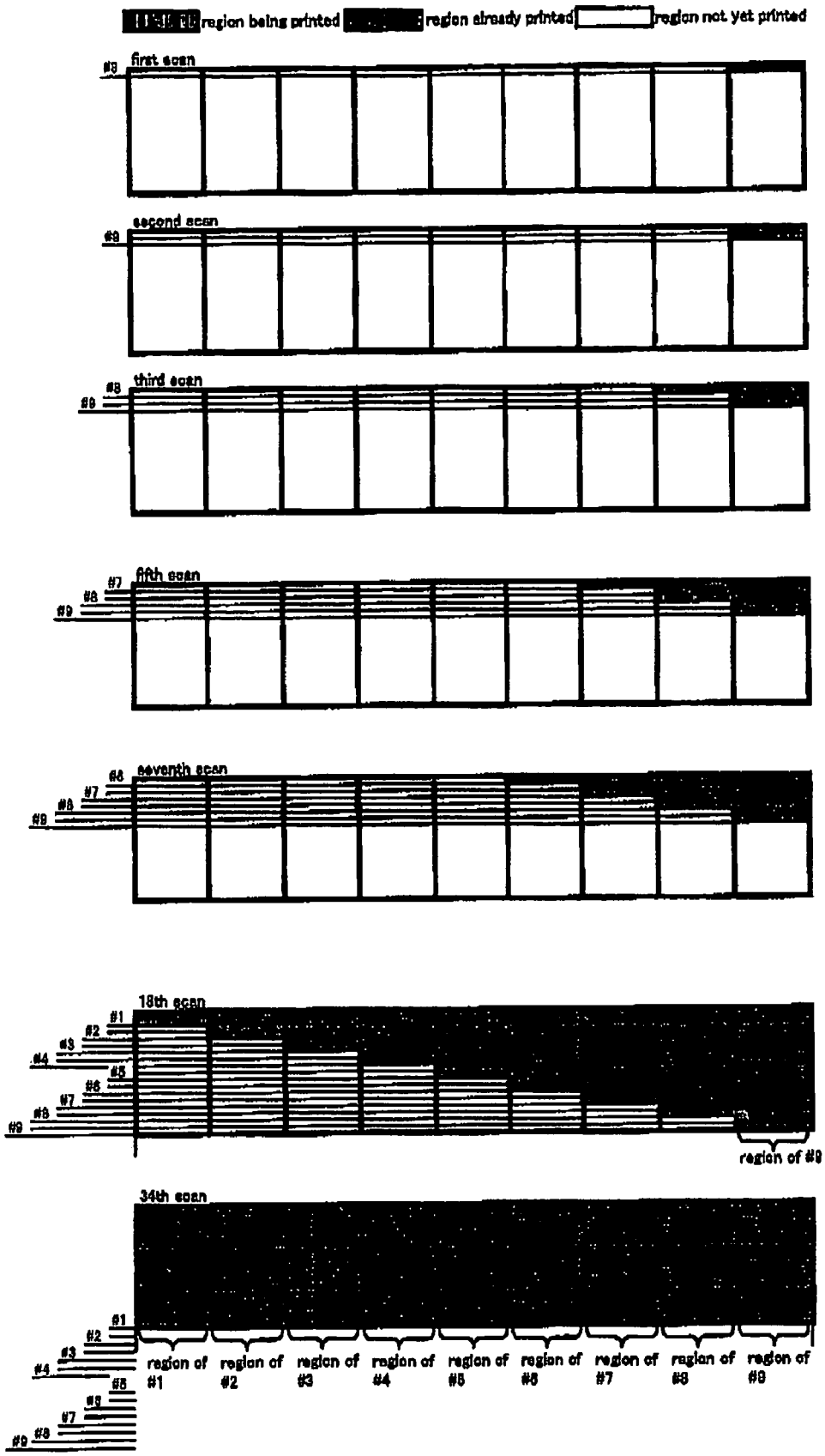
FIG. 46 is an explanatory diagram of the method for forming nine block patterns.

FIG. 46 is an explanatory diagram of the method for forming the nine block patterns of the first row of the nozzle check pattern 1071. The diagram shows the dot rows (56 dot rows lined up in the carriage movement direction of FIG. 45) that are formed by a single dot formation process (the process of ejecting ink from the head during movement of the carriage). Also, the numbers on the left side of the diagram indicate the nozzle number, and the position of the nozzle numbers indicates the position of the nozzles with respect to the block pattern BL.

First, the paper is fed until the front end position on the carrying direction downstream side of the block pattern EL is in opposition to nozzle #9. Then, the printer executes a first dot formation process, and when the carriage 36 has arrived at a predetermined position, ink is ejected intermittently from nozzle #9. Thus, a dot row is formed at a position on the downstream side of the block pattern corresponding to nozzle #9.

Next, the printer carries the paper by half of the nozzle pitch (1/360 inch) using the carrying unit. Then, the printer executes a second dot formation process, and when the carriage has arrived at a predetermined position, ink is ejected intermittently from nozzle #9. Thus, a dot row is formed adjacent on the carrying direction upstream side to the dot row that has been formed in the first dot formation process.

Next, the printer carries the paper by half of the nozzle pitch using the carrying unit. Then, the printer executes a third dot formation process. In the third dot formation process, the printer intermittently ejects ink from nozzle #9 and nozzle #8. A dot row is formed by the ink ejected from nozzle #9 adjacent on the carrying direction upstream side to the dot row that has been formed in the second dot formation process. Also, a dot row is formed by the ink that is ejected from nozzle #8 at a position on the downstream side of the block pattern BL corresponding to nozzle #8.

Next, the printer carries the paper by half of the nozzle pitch using the carrying unit. Then, the printer executes a fourth dot formation process. In the fourth dot formation process as well, the printer intermittently ejects ink from nozzle #9 and nozzle #8, thereby forming dot rows adjacent on the carrying direction upstream side to the dot rows that have been formed in the third dot formation process. In this manner, dot formation and carrying are executed to twice form dot rows while in every two dot formation processes, the number of nozzles ejecting ink is increased by one from the carrying direction upstream side.

In the 18th dot formation process, the block pattern corresponding to nozzle #9 is completed. Thus, in the 19th dot formation process, the ejection of ink from nozzle #9 is stopped. Thereafter, in every two dot formation processes, the ejection of ink is stopped one nozzle at a time in order from the nozzle positioned on the carrying direction upstream side.

Then, in the 34th dot formation process, the nine block patterns of the first row are completed.

The above description is for a method for forming the nine block patterns of the first row, which is positioned on the most downstream side in the carrying direction of the nozzle check pattern 1071, but the nine block patterns of the other rows are formed at the same time that the nine block patterns of the first row are being formed. That is, the 180 nozzles from nozzle #1 to nozzle #180 are grouped into 20 nozzle groups of nine consecutive nozzles per group, and nine block patterns are formed by each nozzle group using the same procedure. For example, when a dot row is being formed by nozzle #9, ink is being ejected at an identical timing from nozzle #9N (where N is an integer).

The user examines the nozzle check patterns 1071 that are printed on the mark sheet for testing nozzle ejection to search for whether or not there are blank patterns as in FIG. 43B. If there are no blank patterns, then the user fills in the check box 72 that indicates that cleaning is not necessary. If there are blank patterns, then the user fills in the check box 72 that indicates that cleaning is necessary. The user then sets the mark sheet for testing nozzle ejection into the printer.

The CPU 1061 of the printer causes the carrying mechanism to carry the mark sheet up to the position where the optical sensor 1053 can read the check boxes. After the carrying, the CPU 1061 moves the carriage in the movement direction and causes the optical sensor 1053 to read the check boxes. Then, the CPU 1061 determines whether or not cleaning is necessary based on the results of the reading by the optical sensor 1053.

If the CPU 1061 has determined that cleaning is necessary, then it controls the head drive mechanism, causing it to forcibly eject ink. This causes dirt within the nozzles to be ejected, allowing the problem of poor nozzle ejection to be eliminated. Further, when the CPU 1061 has determined that cleaning is necessary, it is also possible to place a cap (not shown) over the print head and set the inside of the cap to a negative pressure in order to suck out the ink within the nozzles.

In the above description, the CPU 1061 of the printer performs the process of steps S1301 to S1308 and the process of printing the mark sheet for maintenance, for example. However, this is not a limitation. For example, it is also possible for the printer driver installed on the computer 1303 to cause the printer to execute this processing.

According to the foregoing embodiment, a mark sheet for testing nozzle ejection is printed, checks added to the mark sheet by the user are detected, and cleaning is performed depending on the results of that detection, thereby adjusting the nozzles of the print head. Consequently, the problem of defective nozzle ejection can be eliminated, and thus the picture quality of the printed images can be increased.

Seventh Embodiment

First, an overview of the printing apparatus according to the seventh embodiment of the present invention is described with reference to FIG. 47 and FIG. 48.

Figure 47:
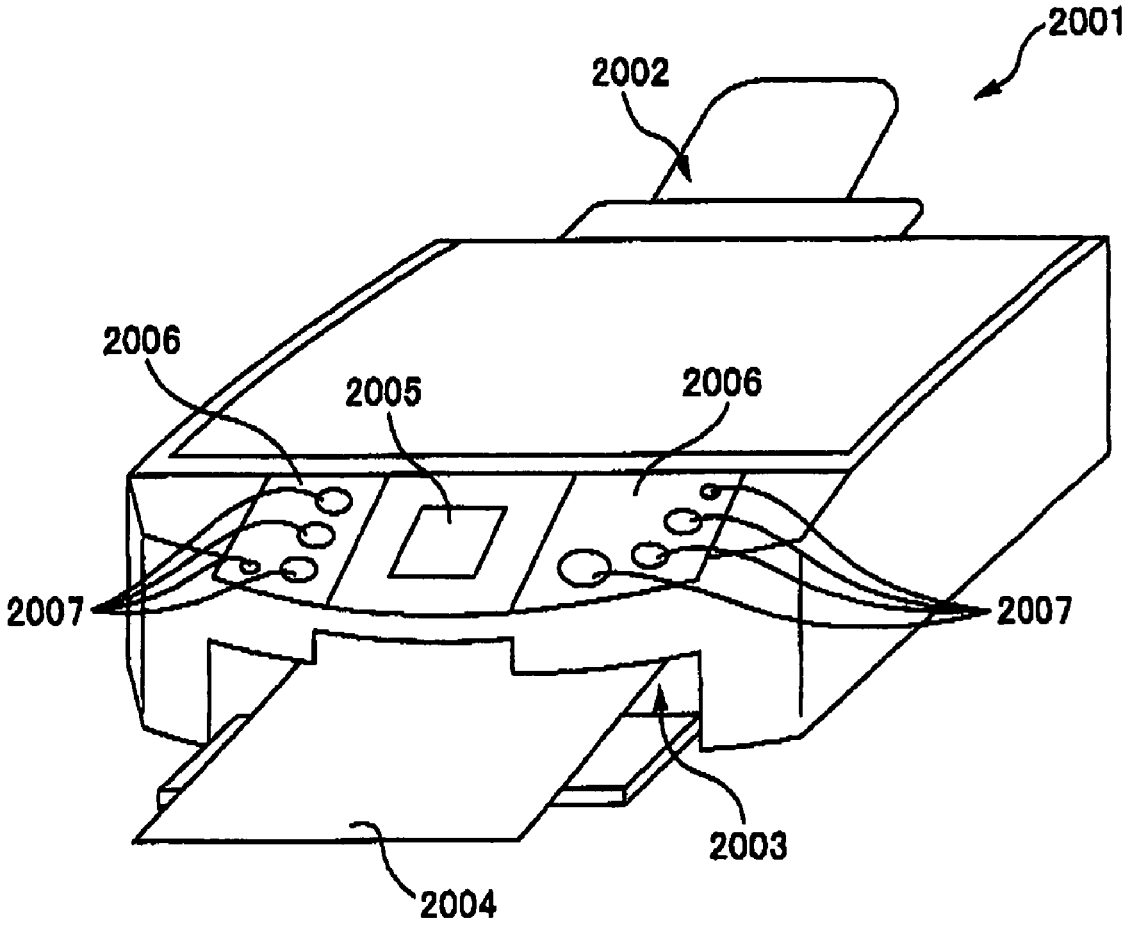
FIG. 47 is a diagram schematically showing the printing apparatus according to a seventh embodiment of the present invention.

FIG. 47 is a diagram showing the external appearance of a printer 2001, which is a printing apparatus.

The printer 2001 shown in FIG. 47 is a "stand-alone printer" that is capable of carrying out printing without being connected to a personal computer. A paper supply opening 2002 and a paper discharge opening 2003 are provided on the upper rear side and the lower front surface, respectively, of the printer 2001. A print paper 2004, which is an example of a printing medium, is inserted into the paper supply opening 2002, and when a print command has been made, the print paper 2004 is supplied into the printer 2001 and printed, and then discharged from the paper discharge opening 2003.

A liquid crystal display 2005 is disposed on the front surface of the printer 2001, and control panels 2006 each provided with various control buttons are provided on both sides of the liquid crystal display. Turning the power on and off, setting the print medium type, operations when exchanging ink cartridges, and head cleaning, for example, are performed by operating the various control keys 2007 on the control panels 2006. It should be noted that it is possible to adopt a CRT (Cathode Ray Tube) monitor in place of the liquid crystal display 2005.

Figure 48:
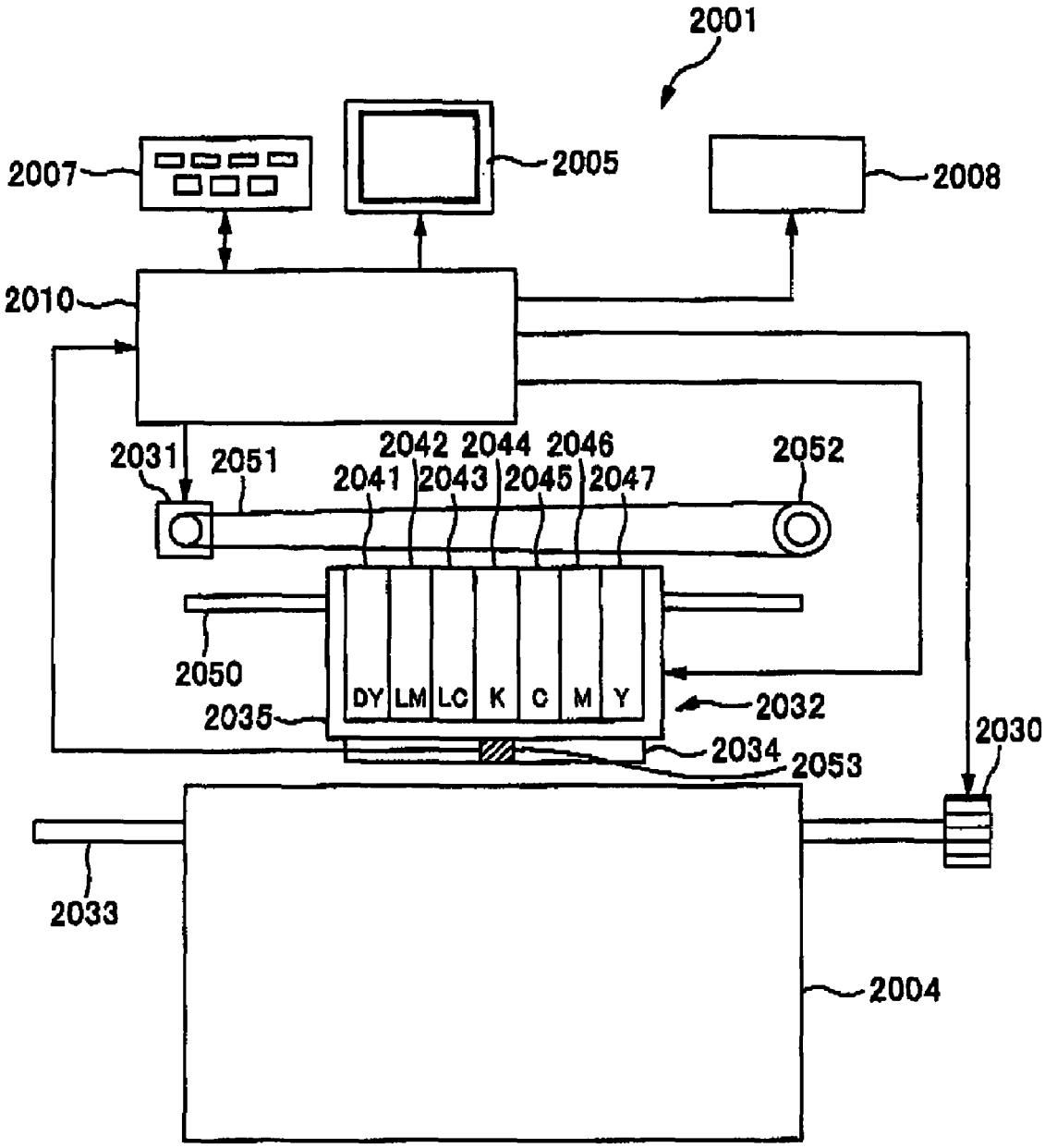
FIG. 48 is a block diagram showing an example of the. configuration of the primary components of the printing apparatus shown in FIG. 47.

FIG. 48 is a block diagram showing an example of the structure of the primary components of the printer 2001.

The printer 2001 is provided with a drive unit 2008 for reading data stored on an information recording medium, such as a memory card, and for storing information on that information recording medium. The printer 2001 is also provided with a control circuit 2010 for governing the sending and receiving of signals between its constitute components and the control panels 2006, the sending of video signals to the liquid crystal display 2005, and the sending and receiving of information to and from the drive unit 2008.

The printer 2001 has a carrying mechanism (sub-scan feed mechanism) and a carriage moving mechanism (main-scan feed mechanism). The carrying mechanism carries a print paper 2004 using a paper feed motor 2030. The carriage moving mechanism moves a carriage 2032 back and forth in the axial direction of a paper feed roller 2033 using a carriage motor 2031. Here, the direction in which the print paper 2004 is fed by the carrying mechanism is referred to as the carrying direction (also referred to as the sub-scanning direction), and the direction in which the carriage 2032 is moved by the carriage moving mechanism is referred to as the movement direction (also referred to as the main-scanning direction).

Also, the printer 2001 is provided with a print head unit 2035 that is mounted to the carriage 2032 and that is provided with a print head 2034, and a head drive mechanism for driving the print head unit 2035 and controlling the ejection of ink and dot formation.

As shown in FIG. 47, various ink cartridges 2041 to 2047 are detachably mounted to the carriage 2032. The ink cartridges 2041, 2042, 2043, 2044, 2045, 2046, and 2047 are cartridges containing dark yellow (DY), light magenta (LM), light cyan (LC), black (K), cyan (C), magenta (M), and yellow (Y) ink, respectively.

Nozzles serving as ink ejection locations are disposed in the print head 2034 in rows in the carrying direction of the print paper 2004, and each nozzle row respectively corresponds to a particular color of ink.

Further, piezo elements, which are a type of electrostrictive element with excellent responsiveness, are provided in a lower section of the carriage 2032 and disposed for each nozzle in the nozzle rows corresponding to the respective inks. The piezo elements are arranged at positions in contact with a member forming the ink path over which ink is guided to the nozzles. When voltage is applied to the piezo elements, their crystalline structure is deformed and they very quickly convert this electrical energy into mechanical energy.

In this embodiment, voltage of a predetermined duration is applied between electrodes provided on both sides of the piezo element, and the piezo element is elongated during this application of voltage and deforms one lateral wall of the ink path. As a result, the volume of the ink path is constricted by an amount corresponding to the elongation of the piezo element, and ink corresponding to this amount of constriction becomes an ink droplet and is quickly ejected from the tip of the nozzle. The ink droplet soaks into the print paper 2004, which is guided along the paper feed roller 2033, thereby forming a dot and carrying out printing. The size of the ink droplets can be changed depending on the method for applying voltage to the piezo elements. It is thus possible to form dots at, for example, three different sizes, these being large, medium, and small.

The carrying mechanism for carrying the print paper 2004 is provided with a gear train (not shown) that transmits the rotation of the paper feed motor 2030 to the paper feed roller 2033 and a paper carry roller (not shown). Further, the carriage moving mechanism for moving the carriage 2032 back and forth is provided with a slide shaft 2050 which runs parallel to the axis of the paper feed roller 2033 and which slidably retains the carriage 2032, a pulley 2052, with an endless drive belt 2051 being provided spanning between the pulley 2052 and the carriage motor 2031, and an optical sensor 2053 for detecting the position of origin of the carriage 2032 and for detecting marks on a mark sheet that is discussed later. It should be noted that the optical sensor 2053 is made of a light source for emitting light onto the paper 2004 and the mark sheet, and a photodiode (or a CCD (charge coupled device) element), for example, for converting light that is reflected by the print paper 2004 and the mark sheet into corresponding image signals. The optical sensor 2053 is mounted to the carriage 2032, and thus can move in the movement direction of the carriage 2032. The optical sensor 2053 can also detect whether or not the paper is present, and thus can detect the paper width by detecting the end portions of the paper during movement of the carriage 2032, and can detect the upper end and the lower end of the paper by detecting the end portions of the paper during carrying.

It should be noted that the "mark sheet" is a sheet on which marks such as check boxes have been printed. The user selectively fills in the marks using a pencil, and the optical sensor 2053 detects whether or not the marks have been filled in. Thus, the printer can receive commands from the user through the mark sheet.

Figure 49:
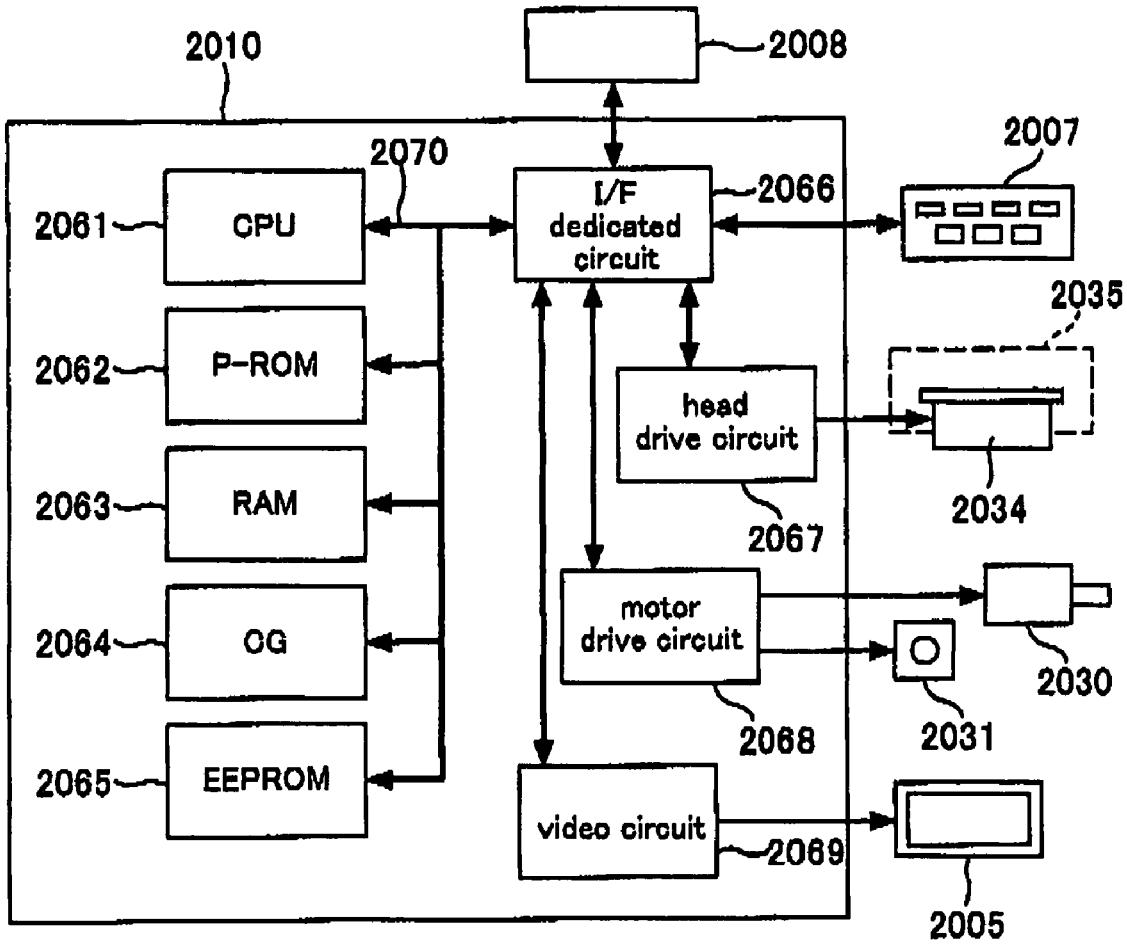
FIG. 49 is a diagram showing an example of the internal configuration of the control circuit in the printing apparatus shown in FIG. 47.

FIG. 49 is a diagram showing an example of the internal structure of the control circuit 2010 shown in FIG. 48.

As shown in FIG. 49, the control circuit 2010 is provided with a CPU (Central Processing Unit) 2061, a programmable ROM (P-ROM (Read Only Memory)) 2062, a RAM (Random Access Memory) 2063, a character generator (CG) 2064 storing character dot matrix, and an EEPROM (Electrically Erasable and Programmable ROM) 2065, which is a memory means. Here, the CPU 2061 of the control circuit 2010 performs various computer processing in accordance with programs stored on the ROM 2062. The CPU 2061 functions as a controller (controlling section) for controlling the various sections in the printer. For example, the CPU 2061 controls the carriage moving mechanism to move the carriage (and print head) and controls the carrying mechanism to carry the print paper in the carrying direction, and can control the head driving mechanism to cause the print head to eject ink. The CPU 2061 can also control the various sections in the printer based on the results of detection by the optical sensor 2053.

The control circuit 2010 is further provided with an I/F dedicated circuit 2066, which is an interface (I/F) between the control circuit 2010 and the external control panels 2007, the drive unit 2008, the motors, etc., a head drive circuit 2067 that is connected to the I/F dedicated circuit 2066 and that is for driving the print head unit 2035 and causing it to eject ink, a motor drive circuit 2068 for driving the paper feed motor 2030 and the carriage motor 2031, and a video circuit 2069 that executes rendering processes in accordance with picture commands supplied by the CPU 2061 to convert image data that has been obtained into video signals and outputs these to the liquid crystal display 2005. The structural components within the control circuit 2010 are connected by a bus 2070, allowing various signals to be sent and received between them.

A memory card, which is the storage medium of a digital camera that is not shown, is inserted into the drive unit 2008, and the information recorded on the memory card is read out and printed. It should be noted that in place of the drive unit 2008 it is also possible to provide a predetermined interface circuit, and to send and receive image information to and from the digital camera via wire or wirelessly. The memory card is made of a semiconductor memory device, is detachably mounted to a digital camera that is not shown, and is designed so as to store images that have been captured.

The method for setting image correction adjustment and the image effects (print properties) of the printer 2001 are described below using FIG. 50 to FIG. 59.

Figure 50:
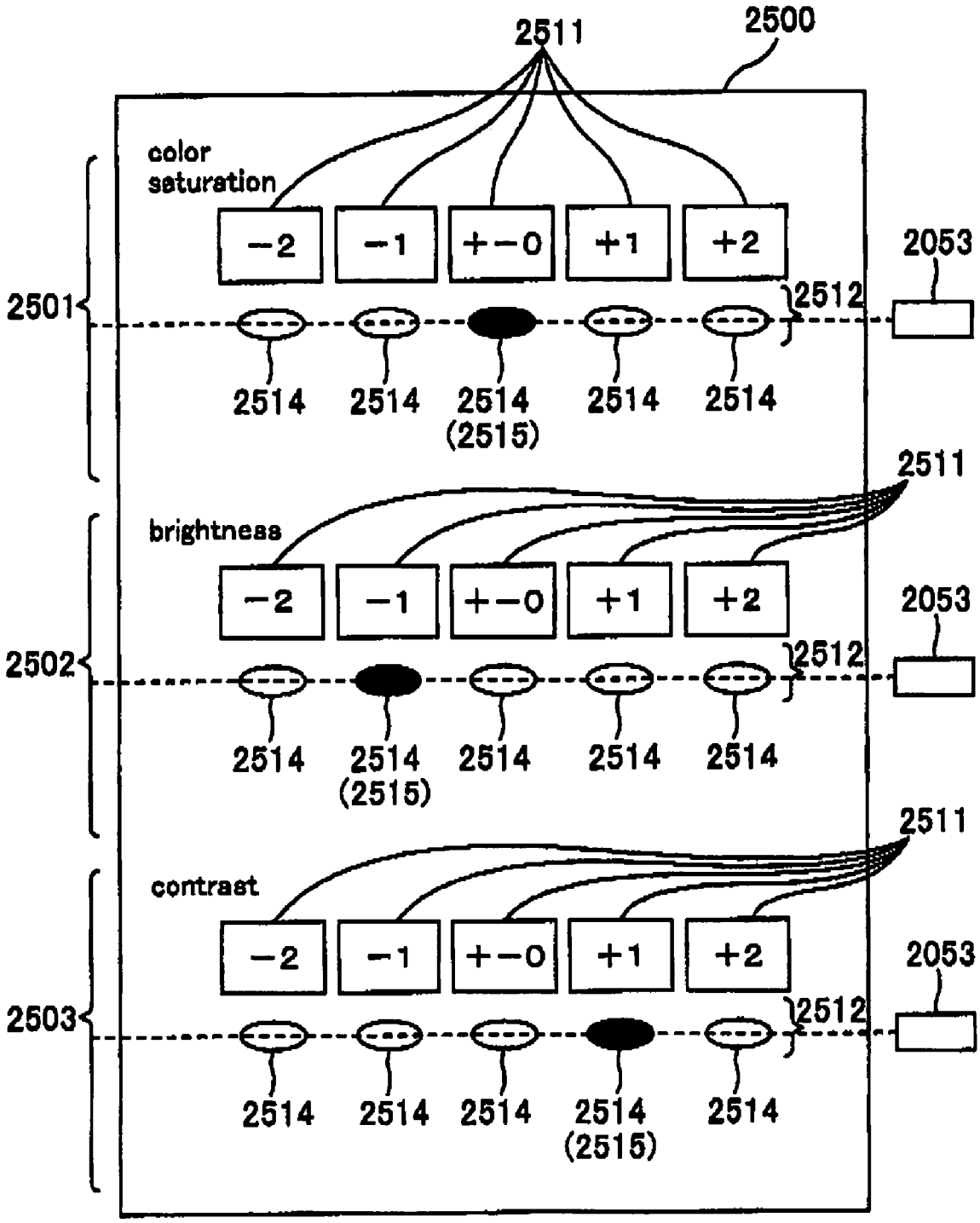
FIG. 50 is a diagram showing an example of a mark sheet for adjusting the print properties.

FIG. 50 is a diagram showing an example of a mark sheet 2500 for the user to designate print properties he/she thinks are suitable using a writing instrument.

The mark sheet 2500 has a color-saturation level pattern print region 2501 in which color-saturation level patterns are printed, a brightness level pattern print region 2502 in which brightness level patterns are printed, and a contrast level pattern print region 2503 in which contrast level patterns are printed. Level displays 2511 and a check box print region 2512 disposed below each level are printed in the print regions 2501, 2502, and 2503. Black marks 2515 are added to the mark sheet 2500 shown in FIG. 50, but initially the mark sheet 2500 is printed in a state where the user has not yet filled in the marks 2514.

Five level displays 2511, these being −2, −1, +−0, +1, and +2, as an example of print property patterns, are drawn in each print region 2501, 2502, and 2503. These five level displays 2511 are printed on the mark sheet 2500 before setting of the print properties.

On the other hand, check boxes 2514 for the user to mark are drawn in the check box print region 2512. The user selects the level display 2511 that he/she thinks is suitable on the mark sheet 2500 that is printed by the printer 2001, fills in the check box 2514 below that level display 2511, and feeds the mark sheet 2500 into the printer 2001. When a mark sheet 2500 in which a specific check box 2514 has been filled in is fed into the printer 2001, the optical sensor 2053 moves over the doted line in the movement direction in FIG. 50 and detects the black mark 2515 that has been made.

Figure 51:
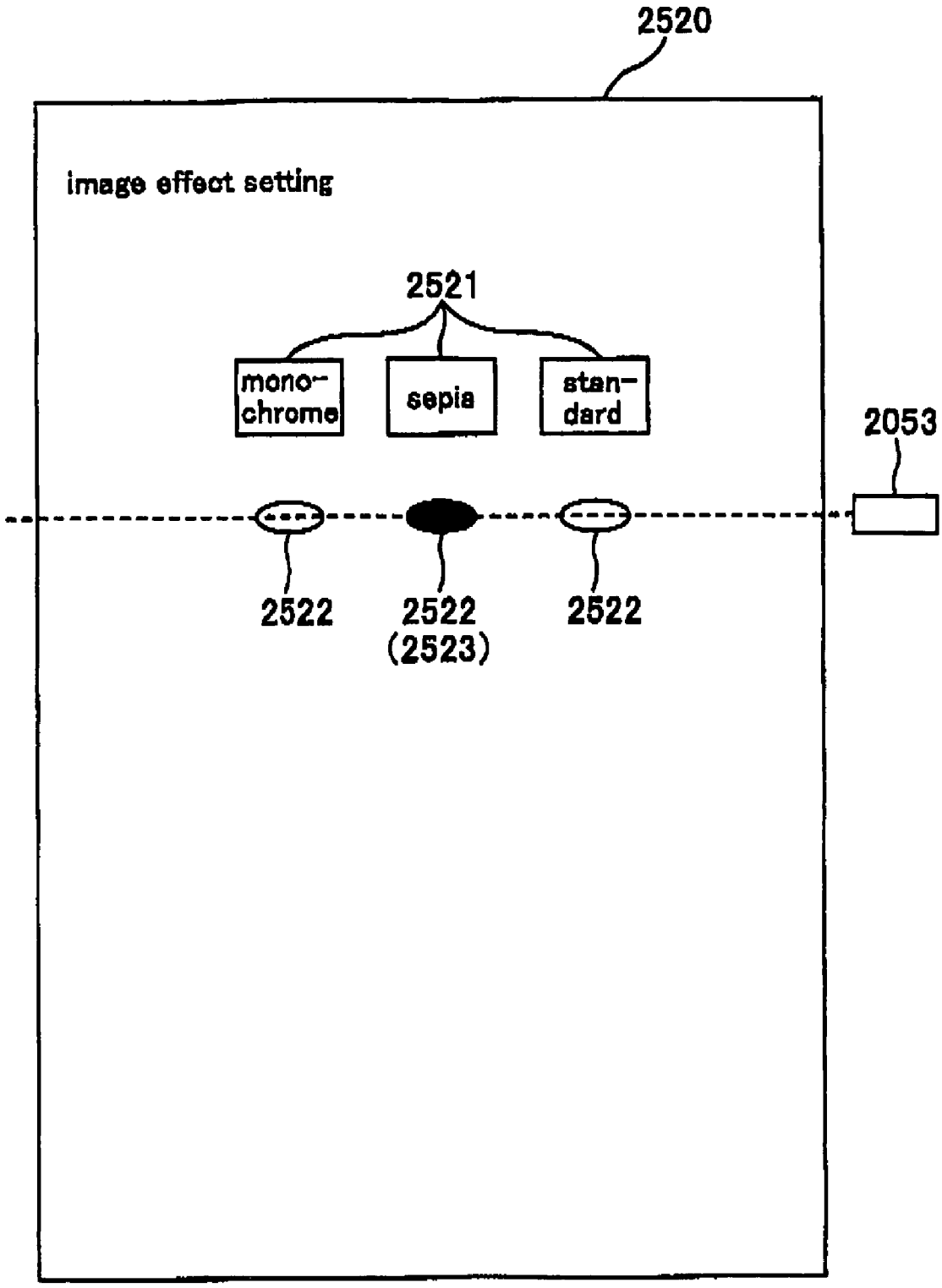
FIG. 51 is a diagram showing an example of a mark sheet with a different layout from that of the mark sheet of FIG. 50.

FIG. 51 is a diagram showing an example of a mark sheet 2520 for the user to designate desired print properties using a writing instrument.

On the mark sheet 2520 are printed a plurality of image effect setting items 2521 and check boxes 2522 disposed below each setting item 2521. Examples of the image effects include the three selections of monochrome, sepia, and standard. The mark sheet 2520 shown in FIG. 51, like the mark sheet 2500 shown in FIG. 50, is initially printed in a state where the user has not made marks 2523.

The user selects a desired setting item 2521 on the mark sheet 2520 that is printed by the printer 2001, fills in the check box 2522 below that setting item 2521, and then feeds the mark sheet 2520 into the printer 2001. When a mark sheet 2520 on which a specific check box 2522 has been filled in is fed into the printer 2001, the optical sensor 2053 is moved over the dotted line in the movement direction in FIG. 51 and detects the black mark 2523 that has been added. In the mark sheet 2520 shown in FIG. 51, sepia has been selected, and thus printing is performed with a sepia-color image. It should be noted that it is also possible for the optical sensor 2053 to move in the movement direction across only the section of the mark sheet 2520 with the check boxes 2522, instead of across the entire width of the mark sheet 2520 in the movement direction.

Figure 52:
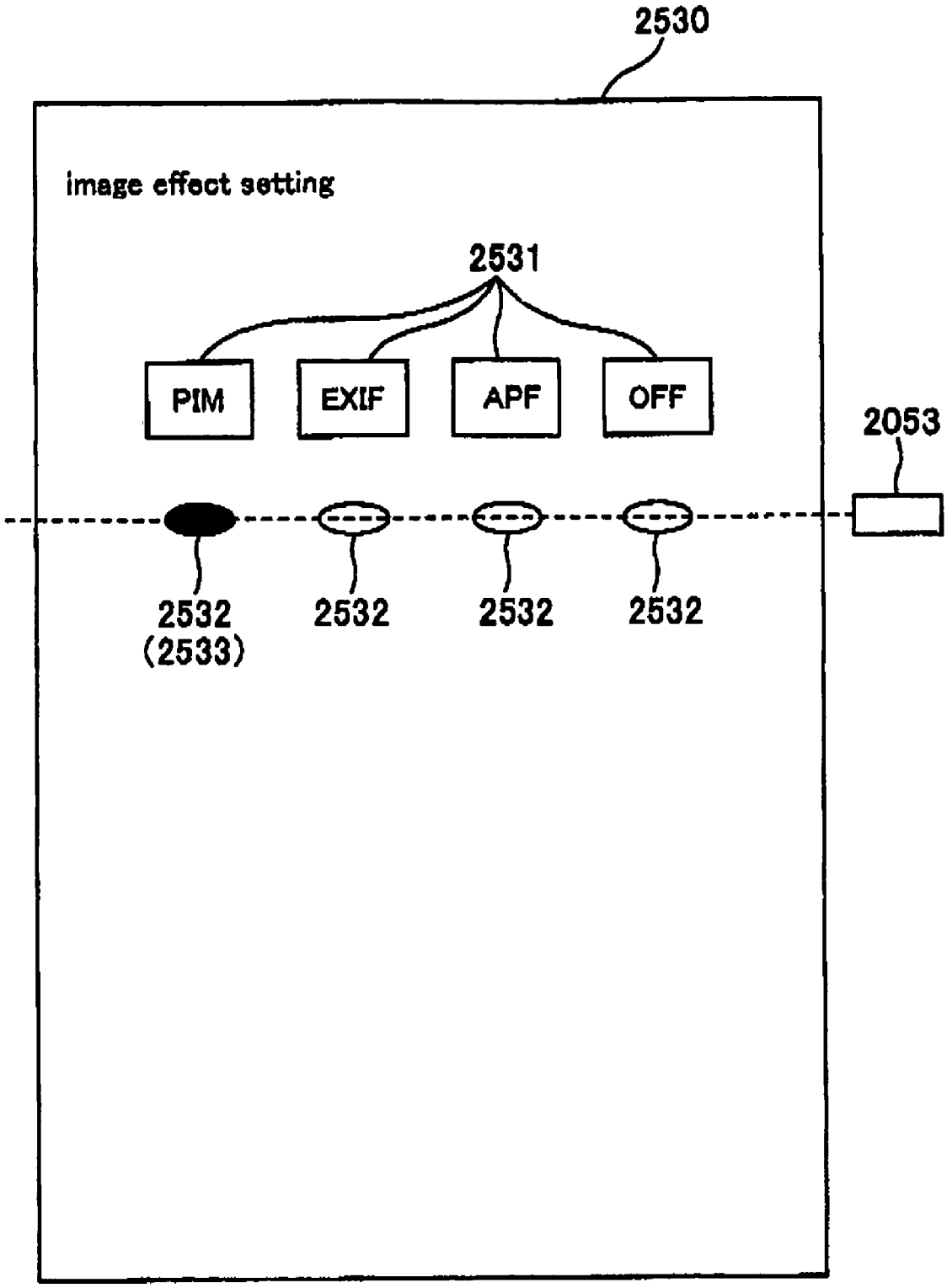
FIG. 52 is a diagram showing an example of a mark sheet with a different layout from that of the mark sheet of FIG. 51.

FIG. 52 is a diagram showing an example of a mark sheet 2530 for the user to designate desired print properties using a writing instrument.

On the mark sheet 2530 are printed a plurality of image effect setting items 2531 and check boxes 2532 disposed below each setting item 2531. Examples of image effects include the four S items PIM (Print Image Matching), EXIF (Exchangeable image file format), APF (Auto Photo Fine), and OFF. PIN is an adjustment standard with which the brightness or the like of the image can be printed with high fidelity in cooperation with the digital camera. EXIF is the JEITA (Japan Electronics and Information Technology industries Association) designated standard for preserving file compatibility. APF is an adjustment standard for correcting and then printing a photograph when the color saturation, brightness, or contrast, for example, is not suitable. The mark sheet 2530 shown in FIG. 52, like the mark sheet 2520 shown in FIG. 51, is initially printed in a state where the user has not yet added marks 2533.

The user selects a desired setting item 2531 on the mark sheet 2530 that is printed by the printer 2001, fills in the check box 2532 below that setting item 2531, and then feeds the mark sheet 2530 into the printer 2001. When a mark sheet 2530 in which a specific check box 2532 has been filled in is fed into the printer 2001, the optical sensor 2053 moves over the dotted line in the movement direction in FIG. 52 and detects the black mark 2533 that has been added. In the mark sheet 2530 shown in FIG. 52, PIM has been set, and thus printing is performed using an image adjusted with the PIM adjustment standard. It should be noted that it is also possible for the optical sensor 2053 to move across only the section of the mark sheet 2530 with the check boxes 2532 instead of across the entire width of the mark sheet 2530 in the movement direction.

Figure 53:
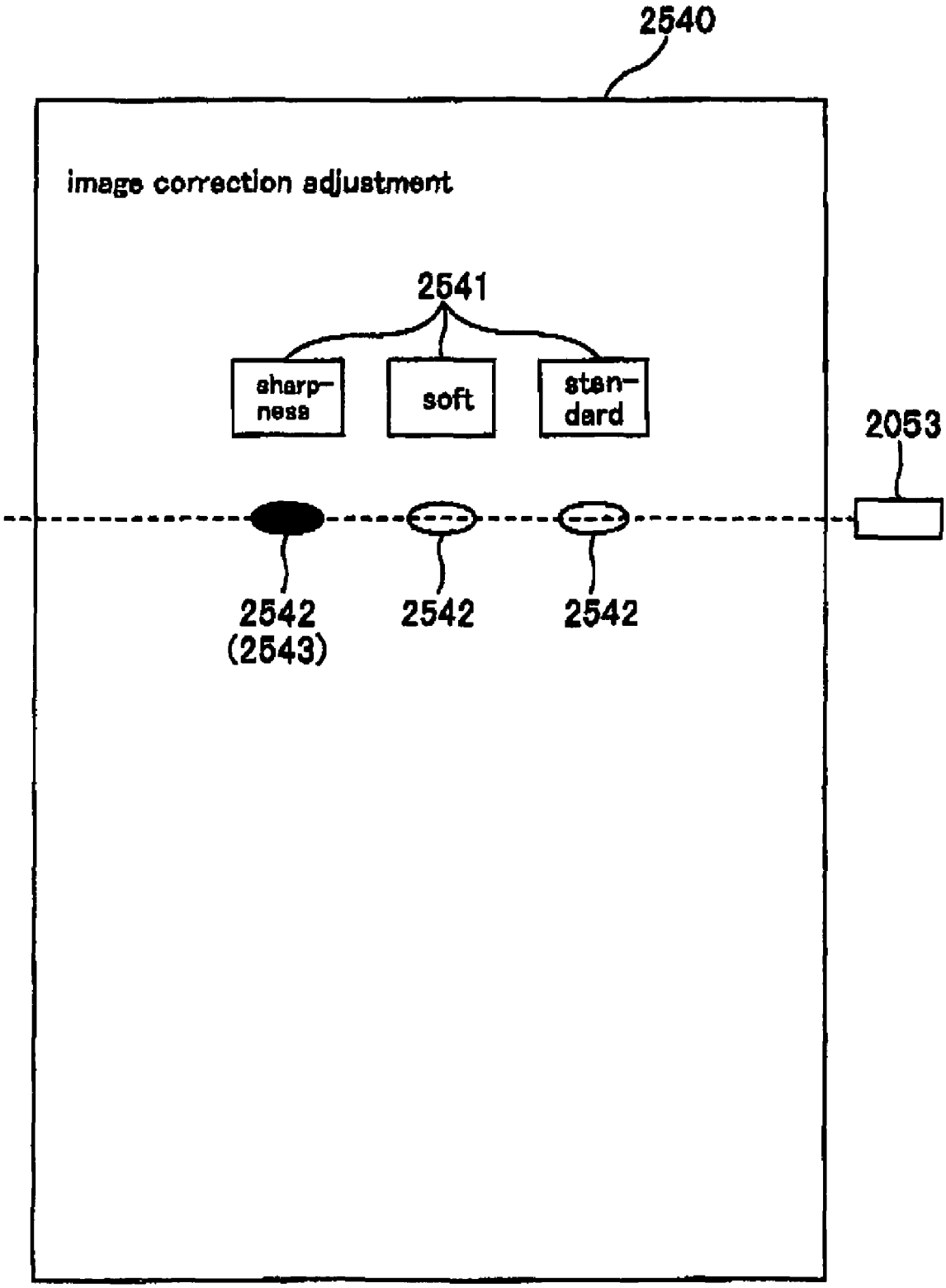
FIG. 53 is a diagram showing an example of a mark sheet with a different layout from that of the mark sheet of FIG. 50.

FIG. 53 is a diagram showing an example of a mark sheet 2540 for the user to designate desired print properties using a writing instrument.

On the mark sheet 2540 are printed a plurality of image correction adjustment pattern setting items 2541 and check boxes 2542 disposed below each setting item 2541. Examples of the image correction adjustment patterns include the three items of sharpness, soft, and standard. The mark sheet 2540 shown in FIG. 53, like the mark sheet 2530 shown in FIG. 52, is initially printed in a state where the user has not yet added marks 2543.

The user selects a desired setting item 2541 on the mark sheet 2540 printed by the printer 2001, fills in the check box 2542 below that setting item 2541, and then feeds the mark sheet 2540 into the printer 2001. When a mark sheet 2540 in which a specific check box 2542 has been filled in is fed into the printer 2001, the optical sensor 2053 moves over the dotted line in the movement direction in FIG. 53 and detects the black mark 2543 that has been added. With the mark sheet 2540 shown in FIG. 53, sharpness has been set, and thus printing is carried out based on an image that has been corrected and adjusted such that it becomes sharp. It should be noted that it is also possible for the optical sensor 2053 to move across only the section of the mark sheet 2540 with the check boxes 2542, instead of across the entire width of the mark sheet 2540 in the movement direction.

Figure 54:
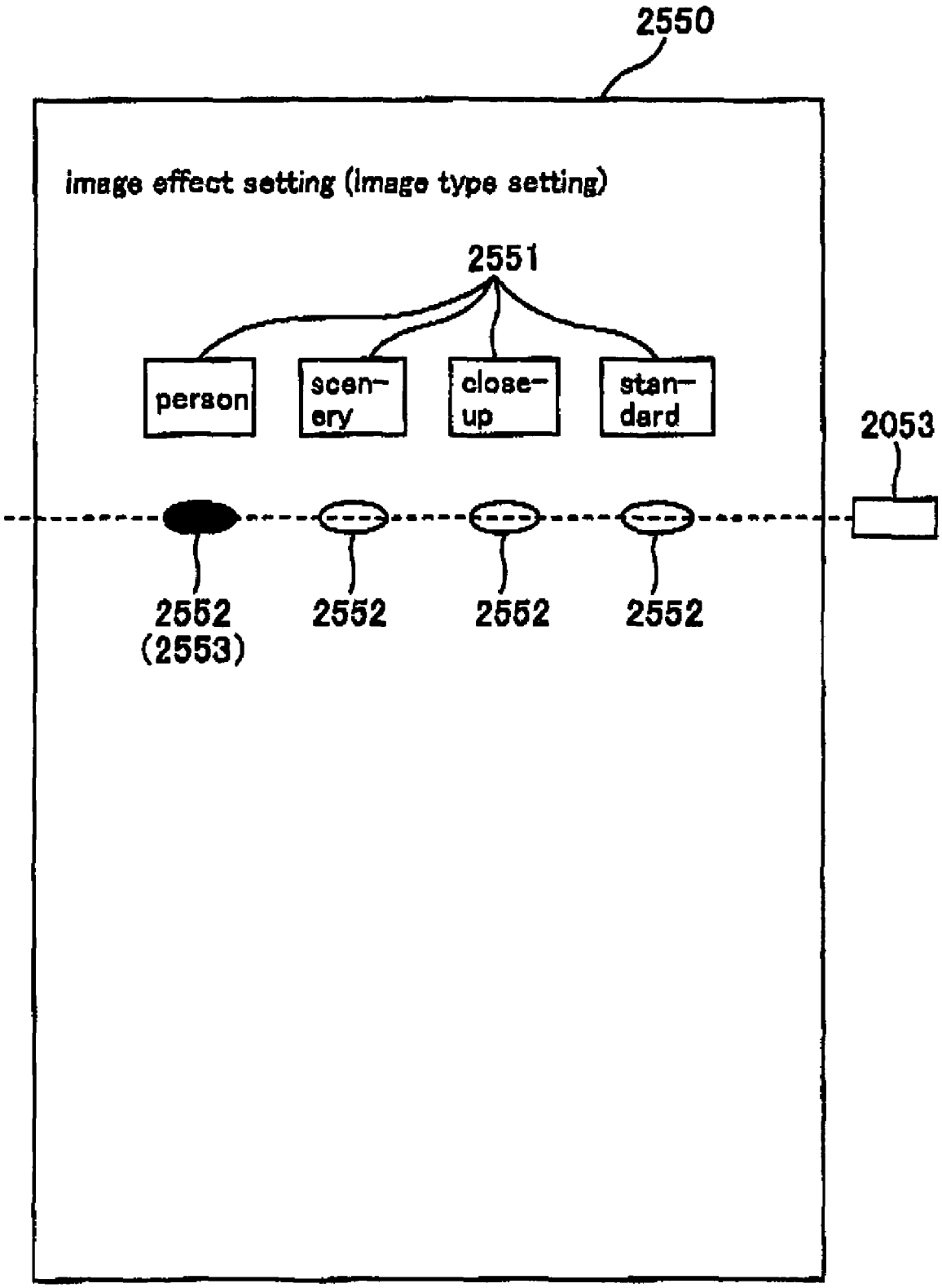
FIG. 54 is a diagram showing an example of a mark sheet with a different layout from that of the mark sheet of FIG. 51.

FIG. 54 is a diagram showing an example of a mark sheet 2550 for the user to designate appropriate print properties for the image capture conditions using a writing instrument.

On the mark sheet 2550 are printed a plurality of image effect setting items 2551 and check boxes 2542 disposed below each setting item 2541. Examples of the image effects include the four items of: effects suited for when a person is the captured object, effects suited for when natural scenery is the captured object, effects suited for close-up shots, and standard. The mark sheet 2550 shown in FIG. 54, like the mark sheet 2540 shown in FIG. 53, is initially printed in a state where the user has not yet added marks 2553.

The user selects the setting item 2551 that he/she thinks is suited for the image capture conditions on the mark sheet 2550 that is printed by the printer 2001, fills in the check box 2552 below that setting item 2551, and then feeds the mark sheet 2550 into the printer 2001. When a mark sheet 2550 in which a specific check box 2552 has been filled in is fed into the printer 2001, the optical sensor 2053 moves over the dotted line in the movement direction in FIG. 54 and detects the black mark 2553 that has been made. With the mark sheet 2550 shown in FIG. 54, effects suited for when a person is the captured object have been set, and thus suitable printing of a person is performed. It should be noted that it is also possible for the optical sensor 2053 to move across only the section of the mark sheet 2550 with the check boxes 2552, instead of across the entire width of the mark sheet 2550 in the movement direction.

Figure 55:
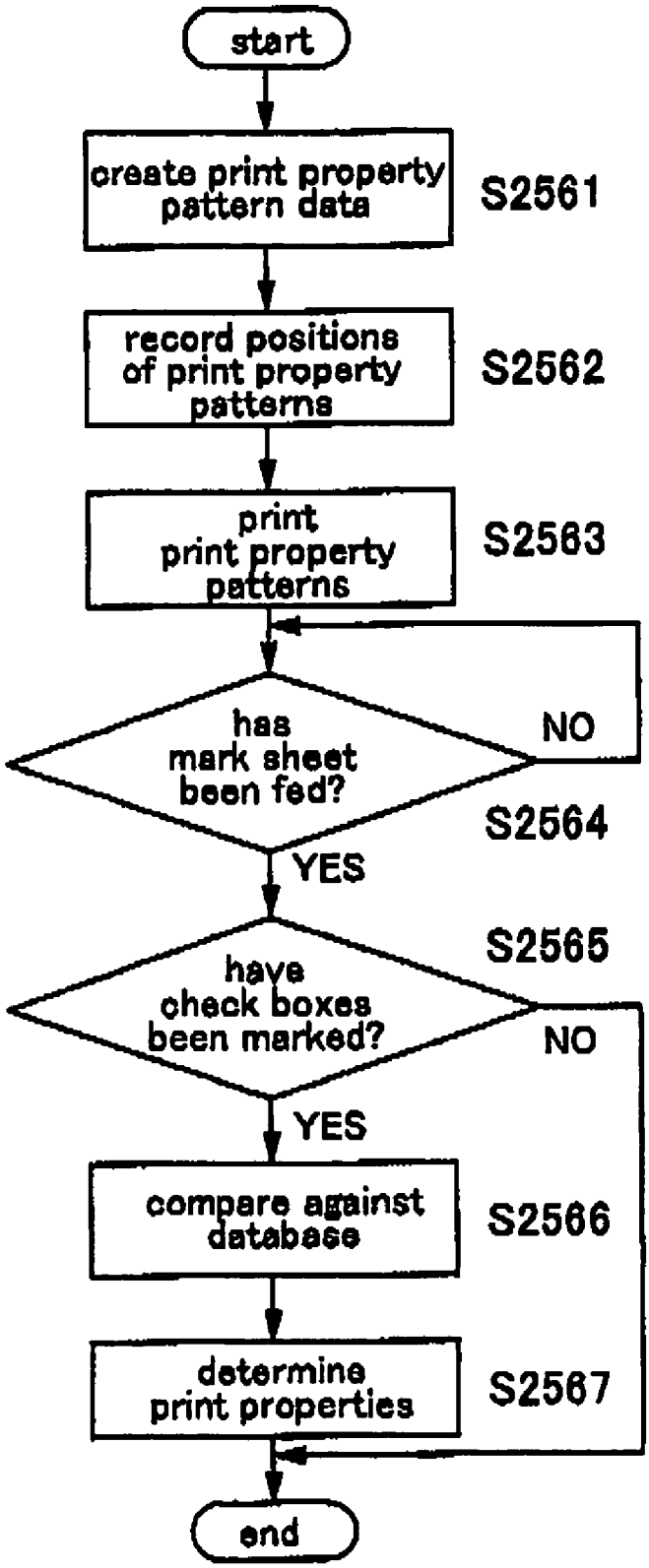
FIG. 55 is a flowchart showing the procedure for adjusting the print properties using the mark sheets shown in FIGS. 50 to 54.

FIG. 55 is a flowchart indicating the sequence in which the print properties are adjusted using the mark sheets 2500, 2520, 2530, 2540, and 2550 shown in FIGS. 50 to 54 (hereinafter, referred to as "mark sheet 2500 etc.").

When the user inserts the print paper 2004 into the printer 2001 and designates setting of the print properties, such as image correction adjustment or the image effect, through the control keys 2007, the printer 2001 creates print property pattern data (step S2561).

Next, the printer 2001 stores the print position of this print property pattern (step S2562), and feeds the print paper 2004 that has been inserted while printing the print property pattern (step S2563). The user next looks at the mark sheet 2500 etc., selects a desired setting display, fills in the check box 2514, 2522, 2532, 2542, 2552 (hereinafter, referred to as "check box 2514 etc."), and inserts the mark sheet 2500 etc. on which that check box 2514 etc. has been filled in into the paper supply opening 2002 of the printer 2001.

The printer 2001 determines whether or not the mark sheet 2500 etc. has been fed (step S2564), and if the paper has not been fed due to reasons such as feeding having failed or the mark sheet 2500 etc. not being present, then the printer 2001 enters a standby state and the determination of step S2564 is performed again. On the other hand, if the mark sheet 2500 etc. has been fed, then the printer 2001 continues on to determine whether or not a check box 2514 etc. has been marked (step S2565).

If the result of the determination of step S2565 is that a mark has been added to a check box 2514 etc., then the printer 2001 compares the position of the mark 2515, 2523, 2533, 2543, 2553 (hereinafter, referred to as "mark 2515 etc.") that has been filled in against the database stored in step S2562 (step S2566), and determines the print property corresponding to the position of that mark 2515 etc. (step S2567). On the other hand, if, in step S2565, it is determined that there is no mark 2515 etc. in the check boxes 2514 etc., then the printer 2001 does not adjust the print properties using the mark sheet 2500 etc. and maintains the current print properties. After this series of processes, the process for adjusting the print properties is finished.

When the printer prints an image on the print paper, the image data are converted into print signals in accordance with the print properties that have been adjusted. If the print signals are to be created on the printer side, then the CPU 2061 of the printer creates print data (print signals) based on the image data and prints the image by controlling the printing mechanisms (carrying mechanism, carriage moving mechanism, head drive mechanism, etc.) according to this print data.

Figure 56:
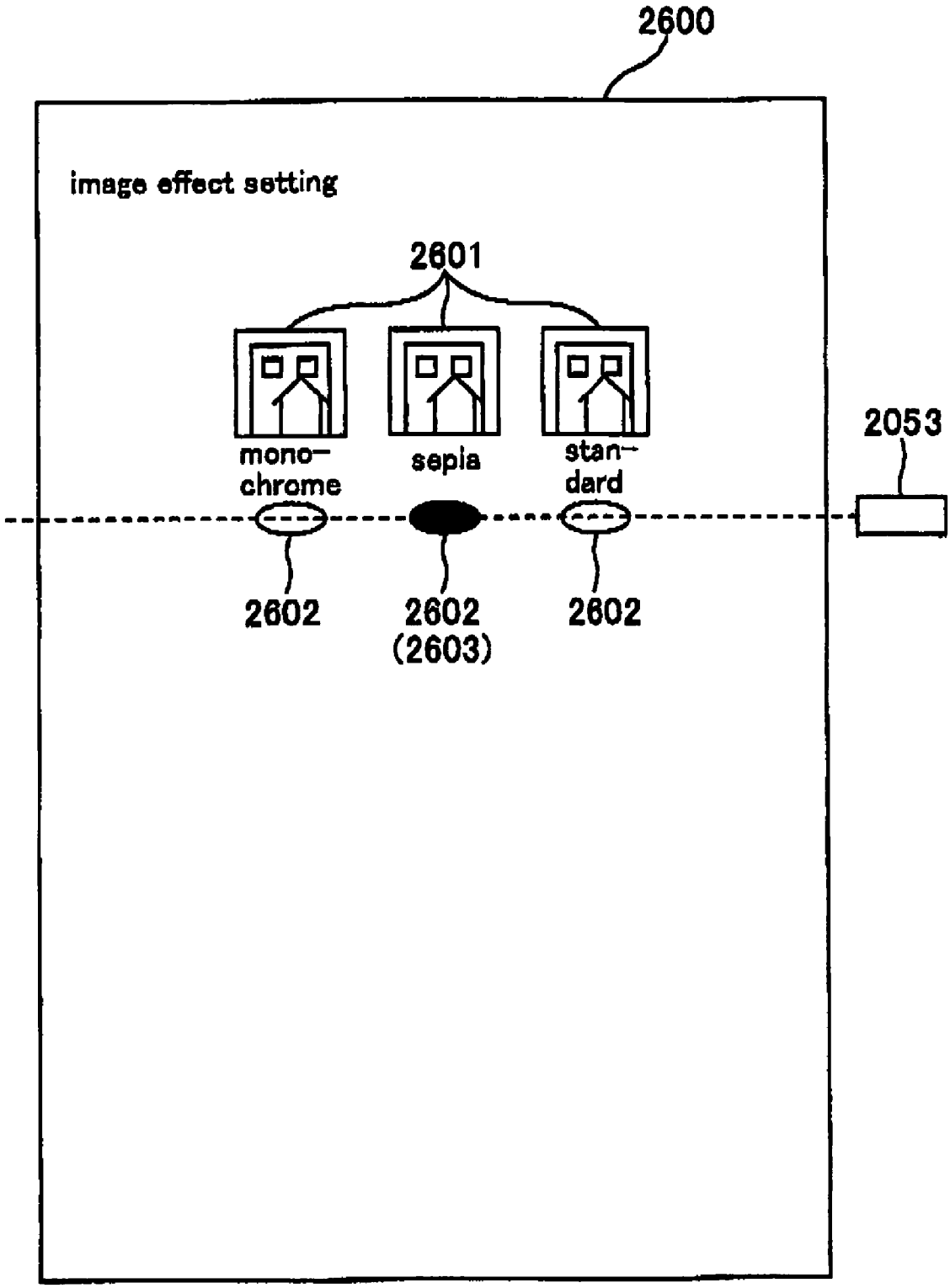
FIG. 56 is a diagram showing an example of a mark sheet with a different layout from that of the mark sheet of FIG. 51.

FIG. 56 is a diagram showing an example of a mark sheet 2600 for the user to designate desired print properties using a writing instrument.

The mark sheet 2600, like the mark sheet 2520 shown in FIG. 51, is for setting which image effect, from among monochrome, sepia, and standard, should be used to perform printing. The mark sheet 2600 differs from the above mark sheet 2520 in that images 2601 printed according to the various image effects are printed in place of the setting items 2521. By showing this mark sheet 2600 to the user, the user can visually select the preferred image effect. When the user blackens in one of the check boxes 2602, the position of the mark 2603 that has been added is read by the optical sensor 2053. In FIG. 56 the sepia-color image 2601 has been selected, and thus the sepia-color image is printed.

Figure 57:
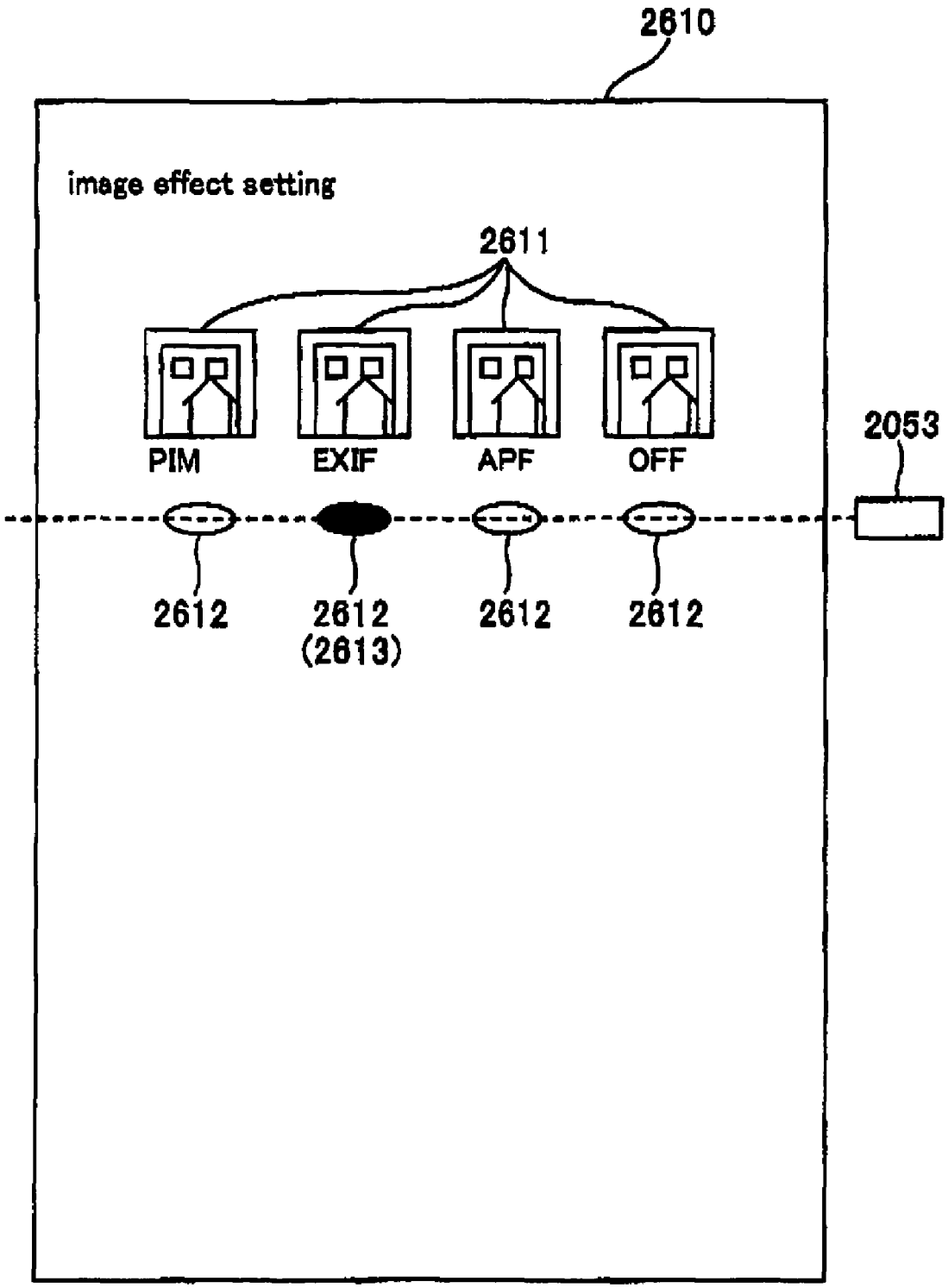
FIG. 57 is a diagram showing an example of a mark sheet with a different layout from that of the mark sheet of FIG. 52.

FIG. 57 is a diagram showing an example of a mark sheet 2610 for the user to designate a desired print property using a writing instrument.

The mark sheet 2610, like the mark sheet 2530 shown in FIG. 52, is for setting which image effect, from among PIM, EXIF, APF, and OFF, should be used to perform printing. The mark sheet 2610 differs from the above mark sheet 2530 in that images 2611 that have been printed at the various image effects are printed in place of the setting items 2531. By showing this mark sheet 2610 to the user, the user can visually select the preferred image effect. When the user blackens in one of the check boxes 2612, the position of the mark 2613 that has been added is read by the optical sensor 2053. In FIG. 57 the EXIF image 2611 has been selected, and thus printing of an image adjusted according to EXIF is executed.

Figure 58:
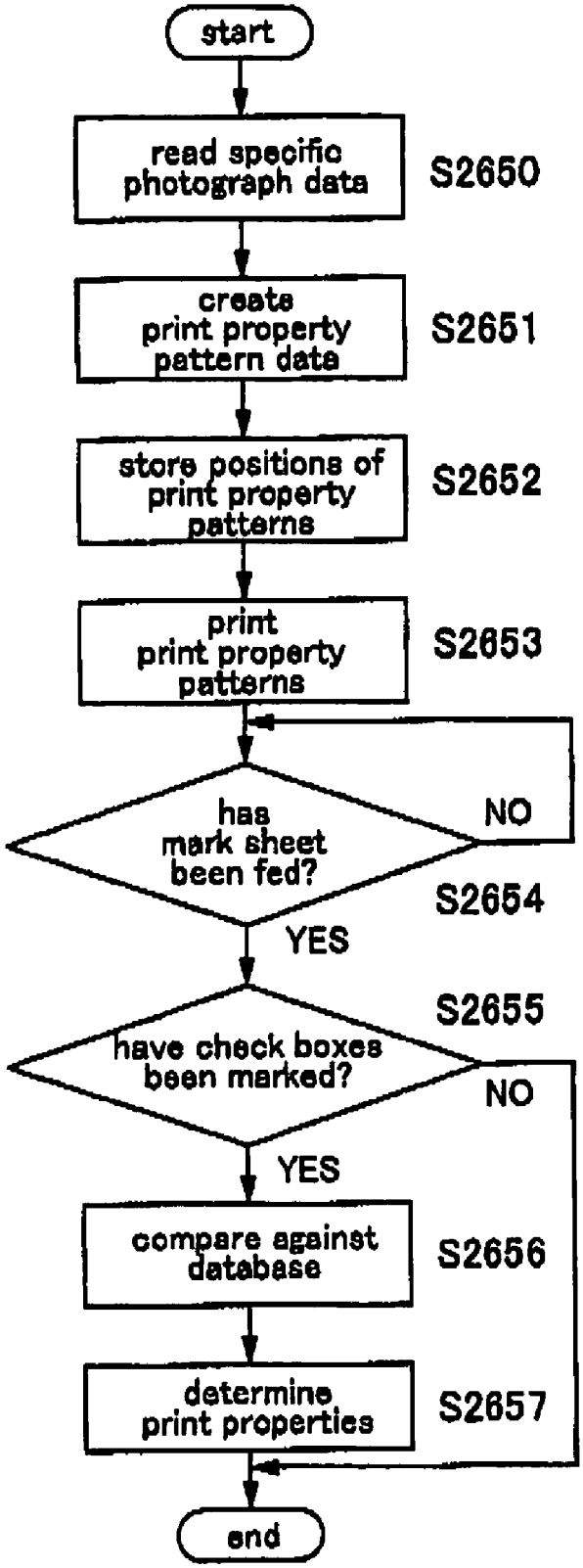
FIG. 58 is a flowchart showing the procedure for adjusting the print properties using the mark sheets shown in FIG. 56 and FIG. 57.

FIG. 58 is a flowchart showing the sequence through which the print properties are adjusted using the mark sheets 2600 and 2610 (hereinafter, referred to as "mark sheet 2600 etc.") shown in FIG. 56 and FIG. 57.

When the user inserts the print paper 2004 into the printer 2001 and designates setting of print properties, such as the image correction adjustment or the image effect, through the control keys 2007, the printer 2001 reads specific photograph data from the connected digital camera, for example (step S2650). The printer 2001 uses the photograph data that have been read to create specific print property pattern data (step S2651).

Next, the printer 2001 stores the print position of this print property pattern (step S2652), and feeds the print paper 2004 that has been inserted while printing the print property pattern (step S2653). As a result, the mark sheet 2600 etc. is printed. The subsequent steps S2654 to S2657 are the same as the steps S2564 to S2567 shown in FIG. 55, and thus description thereof is omitted.

Figure 59:
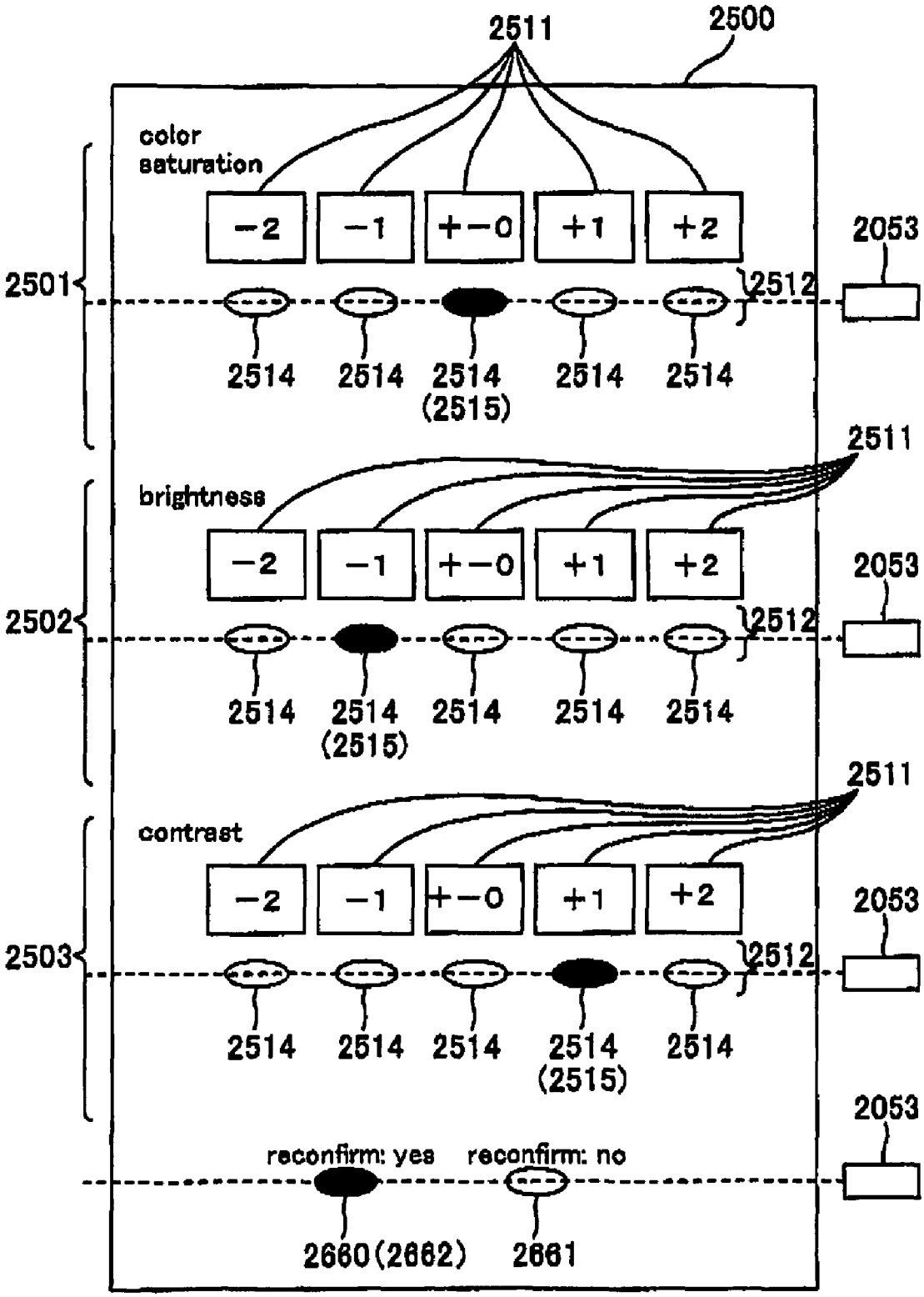
FIG. 59 is a diagram showing an example of a mark sheet with a different layout from that of the mark sheet of FIG. 50.
Figure 60:
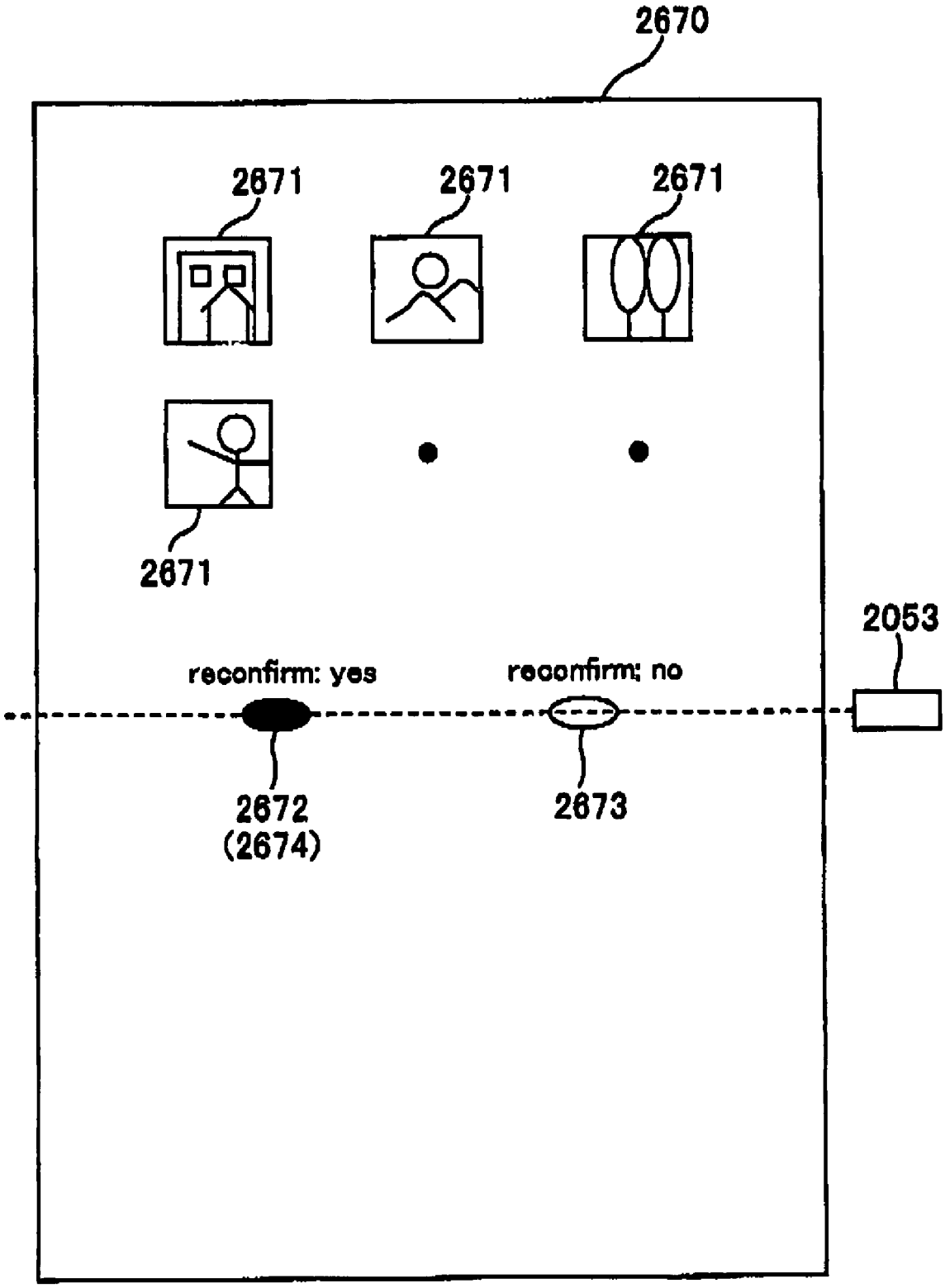
FIG. 60 is a diagram showing how a list of images is printed using the image correction adjustments that have been set on a new print sheet that is fed after the mark sheet shown in FIG. 59 has been fed.

FIG. 59 is a diagram showing an example of a mark sheet 2500 on which confirmation check boxes 2660 and 2661 that allow a confirmation mark 2662 to be written are added to the mark sheet 2500 shown in FIG. 50. Further, FIG. 60 is a diagram showing how a list of image data 2671 is printed at the color saturation, brightness, and contrast set by designation after the mark sheet 2500 shown in FIG. 59 has been fed.

Sections of the mark sheet 2500 shown in FIG. 59 that are shared with the mark sheet 2500 shown in FIG. 50 are not described below. Confirmation check boxes 2660 and 2661 are disposed on a lower section of the mark sheet 2500 of FIG. 59. The confirmation check boxes 2660 and 2661 are: a confirmation check box 2660 that is filled in if the user would like to confirm how printing is performed at the conditions of the added marks 2515, and a confirmation check box 2661 that is filled in when reconfirmation is not necessary.

It is not uncommon to obtain an image that is different from that expected, even though color saturation, brightness, and contrast have been selected and designated on the mark sheet 2500 shown in FIG. 50, unless printing is actually performed. Thus, the confirmation check boxes 2660 and 2661 are furnished to provide a function for allowing a list of actual images to be printed.

The user fills in the confirmation check box 2660 and feeds the mark sheet 2500 into the printer 2001. At this time the optical sensor 2053 moves in the movement direction over the check box print regions 2512 and the positions of the confirmation check boxes 2660 and 2661 as shown by the dotted lines in FIG. 59, and detects the positions of the marks 2515 and the position of the confirmation mark 2662. After performing image correction adjustment according to this detection, the image can be printed under those conditions.

More specifically, after the mark sheet 2500 shown in FIG. 59 has been fed, a separate, new print paper 2004 is fed into the printer 2001 so that a mark sheet 2670 on which new post-adjustment images 2671 are printed can be output as shown in FIG. 60. The user looks at this mark sheet 2670, and if he/she would like to set the color saturation, brightness, or contrast again, he/she adds a mark 2674 to a check box 2672 (for readjusting the settings). If it is not necessary to readjust the settings, then the user adds a mark 2674 to a check box 2673.

It should be noted that the confirmation check box 2661 is not essential, and it is possible to provide only the confirmation check box 2660 and determine whether or not it is necessary to print a list based only on whether or not there is a confirmation mark 2662 in the confirmation check box 2660. The resetting check box 2673 also is not essential, and it is possible to provide only the resetting check box 2672.

Figure 61:
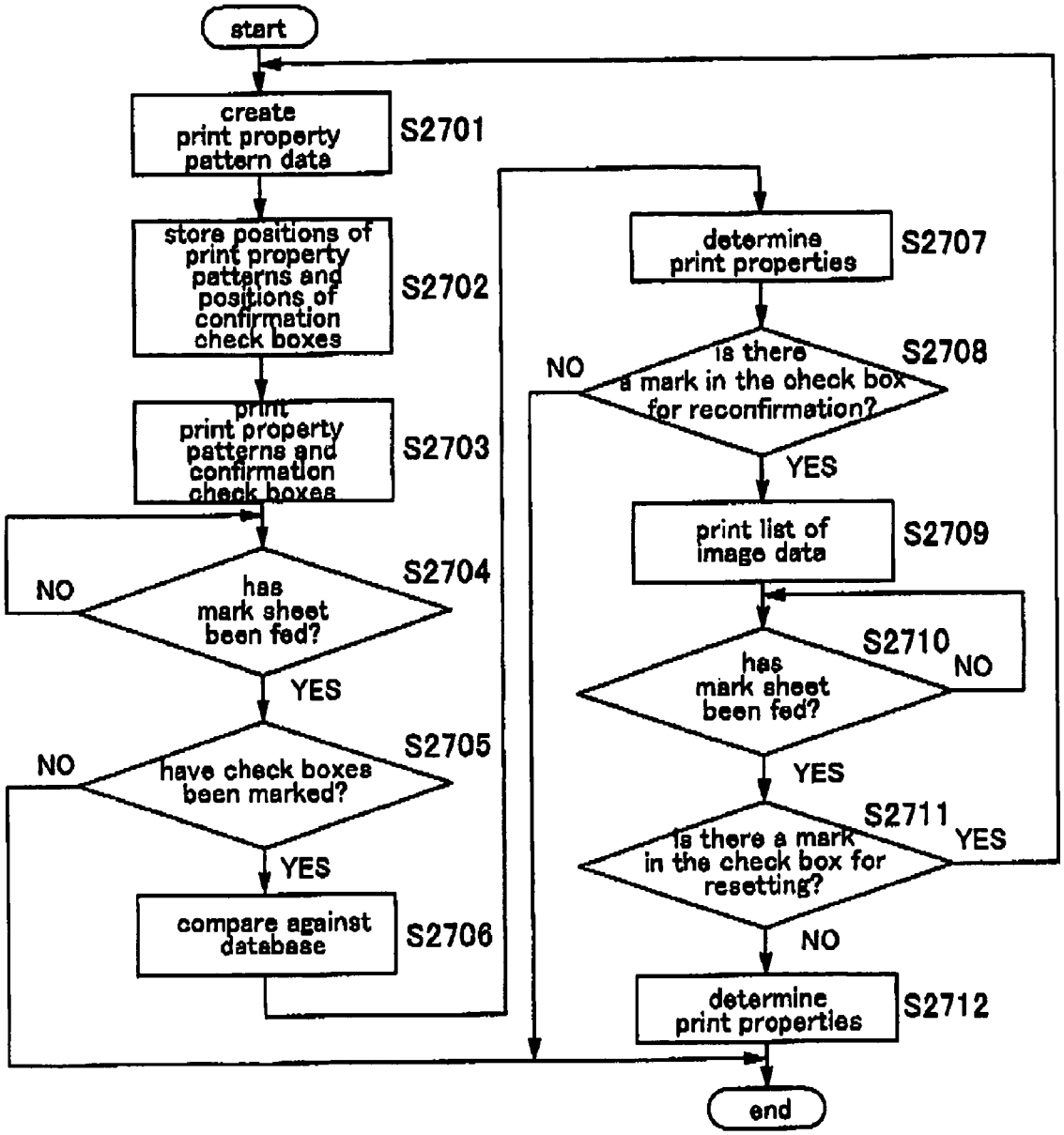
FIG. 61 is a flowchart showing the procedure for adjusting the print properties using the mark sheets shown in FIG. 59 and FIG. 60.

FIG. 61 is a flowchart showing the procedure for adjusting the print properties using the mark sheets 2500 and 2670 shown in FIG. 59 and FIG. 60.

When the user has inserted the print paper 2004 into the printer 2001 and designated adjustment of the print properties using the control keys 2007, the printer 2001 creates print property pattern data (step S2701).

Next, the printer 2001 stores the print positions of the check boxes 2514 below the print property patterns 2511 and the confirmation check boxes 2660 and 2661 (step S2702), and prints the print property patterns and the confirmation check boxes 2660 and 2661 etc. while feeding the print paper 2004 that has been inserted (step S2703). The user then looks at the mark sheet 2500, selects a desired image correction adjustment, and fills in the check box 2514 below that pattern and either the confirmation check box 2660 and 2661, and then inserts the mark sheet 2500 into the paper supply opening 2002 of the printer 2001.

The printer 2001 then determines whether or not the mark sheet 2500 has been fed (step S2704), and if the paper has not been fed due to reasons such as feeding having failed or the mark sheet 2500 not being present, then the printer 2001 enters a standby state and performs the determination of step S2704 again. On the other hand, if the mark sheet 2500 has been fed, then the printer 2001 determines whether or not a mark has been added to the check box 2514 (step S2705).

If the result of the determination of step S2705 is that there is a mark 2515 in a check box 2514, then the printer 2001 compares the position of the mark 2515 that has been added against the database stored in step S2702 (step S2706), and determines the print property corresponding to the position of that mark 2515 (step S2707). On the other hand, if in step S2705 it is determined that there no mark 2515 in the check boxes 2514, then the printer 2001 does not adjust the print properties using the mark sheet 2500 and maintains the current print properties.

After step S2707, the printer 2001 determines whether or not a mark 2674 has been added to the reconfirmation check box 2672 (step S2708). If the result is that there is no mark 2674, then processing is ended. On the other hand, if there is a mark 2674, then the printer 2001 prints a list of the image data 2671 (step S2709). Next, the printer 2001 determines whether or not the mark sheet 2670 has been fed (step S2710). If the paper has not been fed due to reasons such as feeding having failed or the mark sheet 2500 not being present, then the printer 2001 enters a standby state and performs the determination of step S2710 again. On the other hand, if the mark sheet 2500 has been fed, then the printer 2001 determines whether or not a mark has been added to the resetting check box 2672 (step S2711).

As a result, if a mark 2674 has been added to the resetting check box 2672, then the procedure returns to step S2701 and the creation of print property pattern data and subsequent processing is performed again on the other hand, if there is no mark 2674 in the resetting check box 2672, then the printer 2001 accepts the print properties (step S2712) and ends processing.

Eighth Embodiment

Next, an embodiment of a printing apparatus made of a printer and a computer is described with reference to FIG. 62 to FIG. 65.

Figure 62:
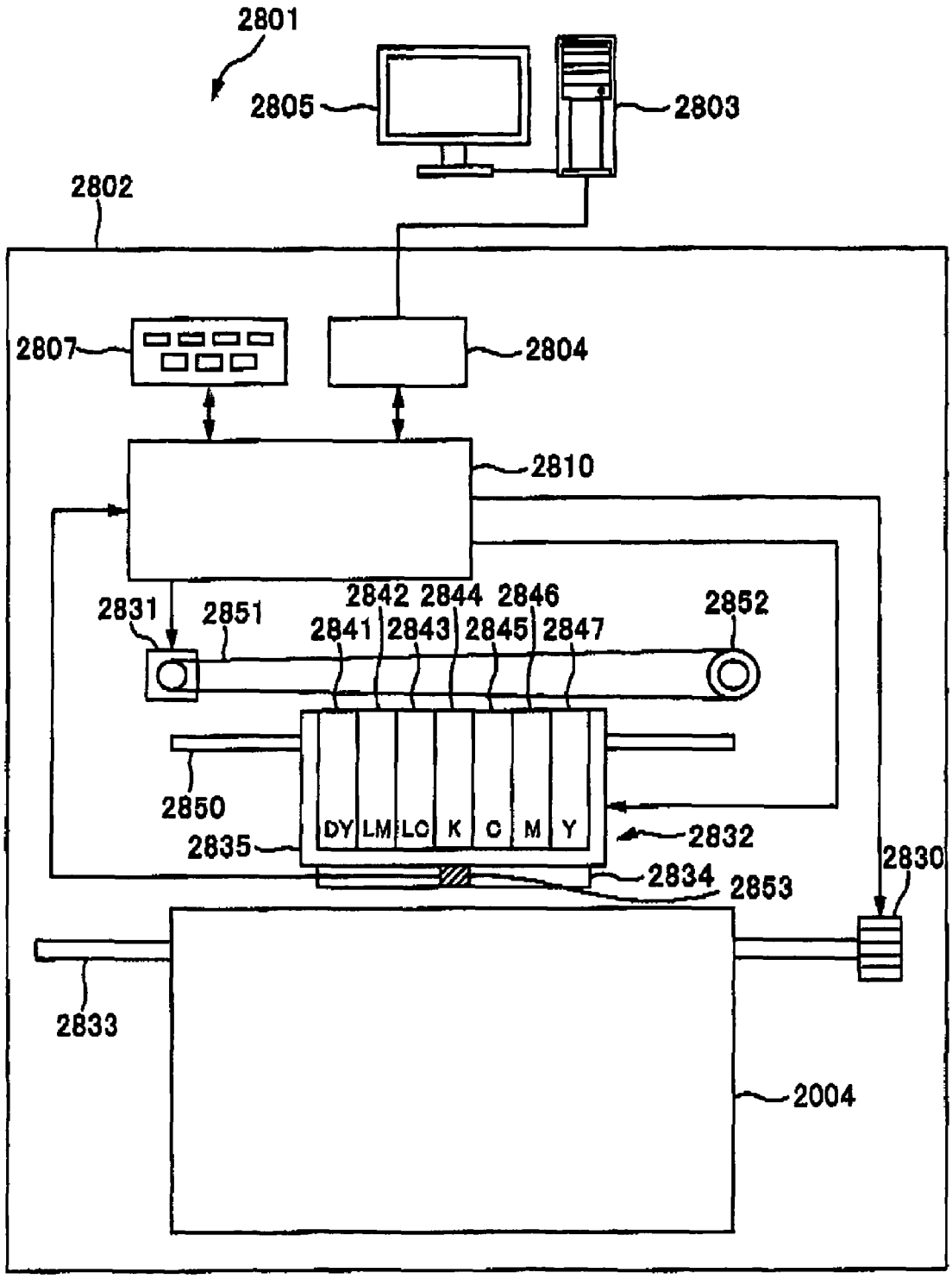
FIG. 62 is a diagram that schematically shows the configuration of the printing apparatus according to an eighth embodiment of the present invention.
Figure 63:
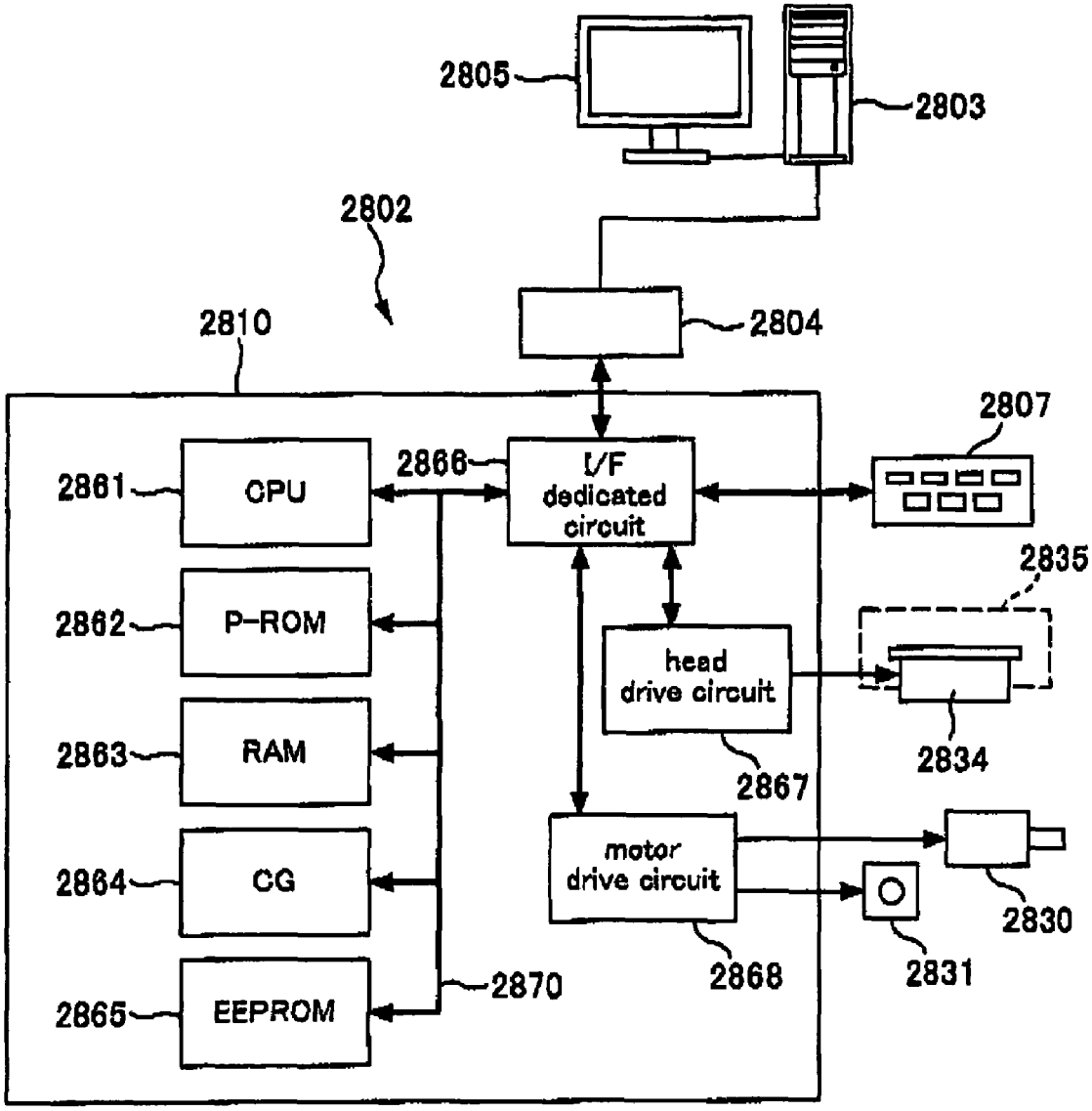
FIG. 63 is a diagram showing the configuration of the printer in the printing apparatus shown in FIG. 62.
Figure 64:
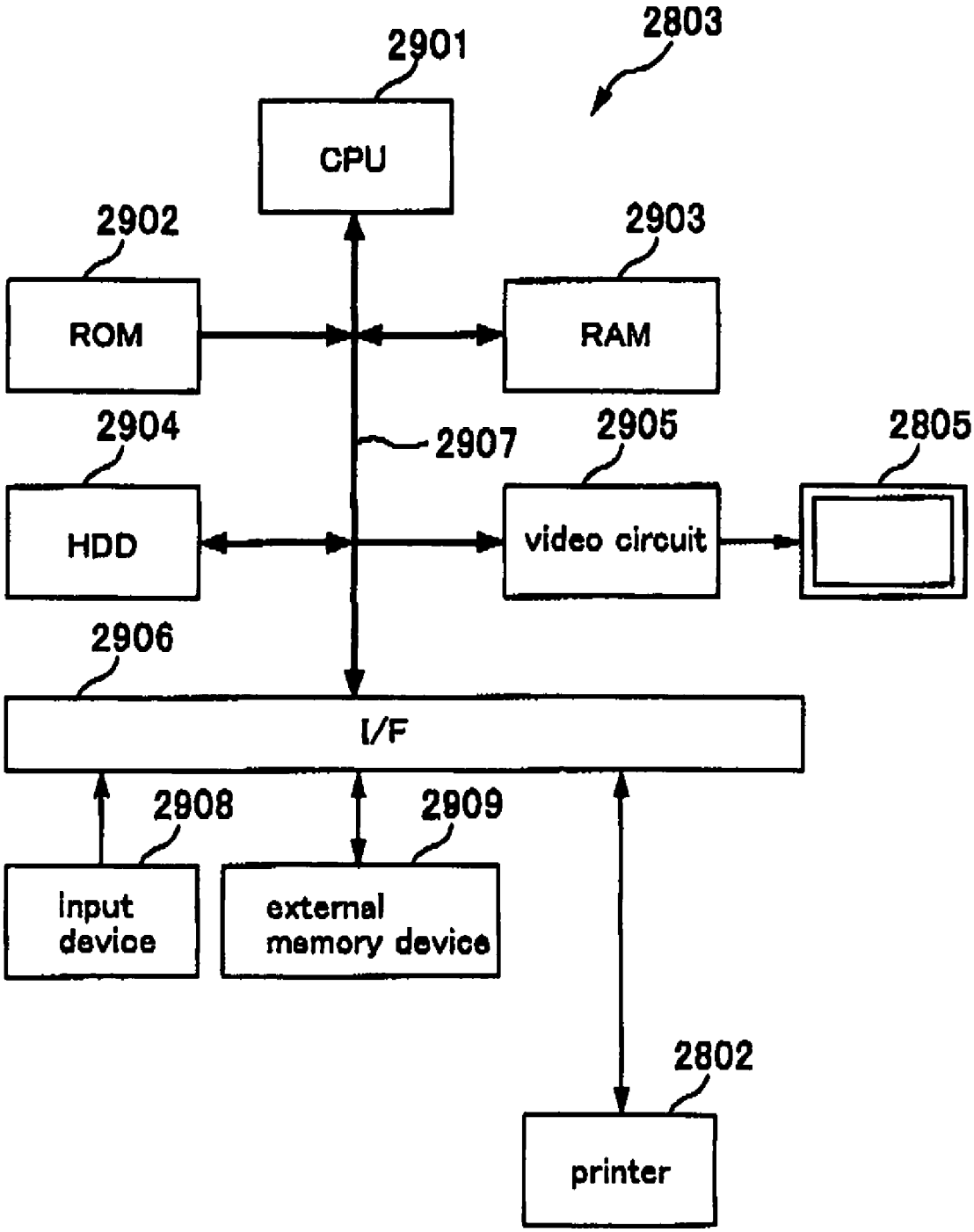
FIG. 64 is a diagram showing the configuration of the computer in the printing apparatus shown in FIG. 62.
Figure 65:
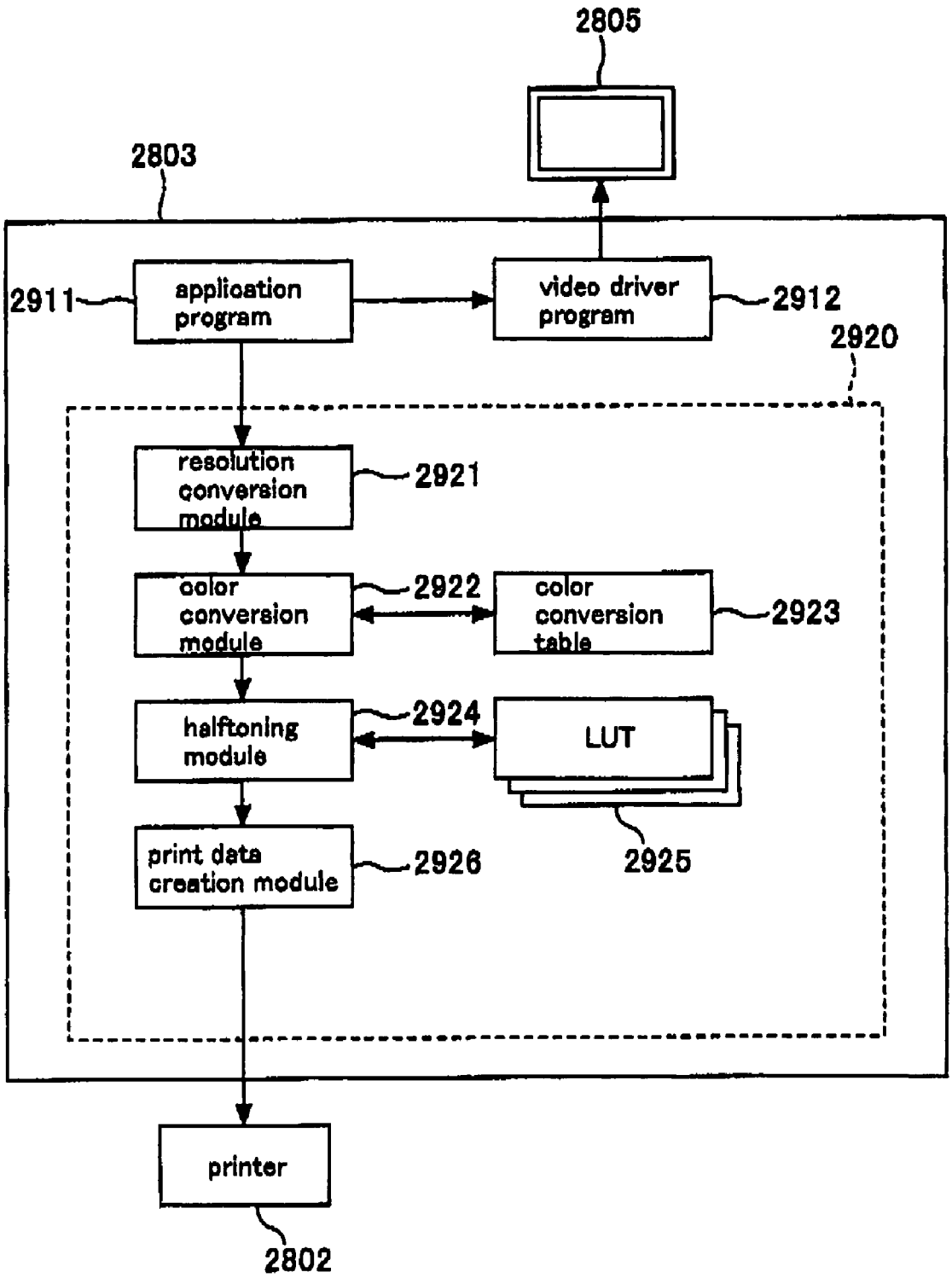
FIG. 65 is a diagram for describing the functions of the program and printer driver installed on the computer in the printing apparatus shown in FIG. 62.

FIG. 62 is a structural diagram schematically showing a printing apparatus 2801 made of a printer 2802 and a computer 2803. FIG. 63 is a block diagram showing an example of the structure of the printer 2802. FIG. 64 is a diagram showing an example of the structure of the computer 2803. FIG. 65 is a diagram describing the functions of the programs and drivers installed on the computer 2803.

As shown in FIG. 62, the printer 2802 has a carrying mechanism that carries a print paper 2004 using a paper feed motor 2830 and a carriage moving mechanism for moving a carriage 2832 back and forth in the axial direction of a paper feed roller 2833 using a carriage motor 2831. The definitions of the movement direction and the carrying direction are the same as the definitions provided in the seventh embodiment.

Also, the printer 2802 is provided with a print head unit 2835 that is mounted to the carriage 2832 and that is provided with a print head 2834, a head drive mechanism for driving the print head unit 2835 to control the ejection of ink and dot formation, and a control circuit 2810 for governing the sending and receiving of signals to and from the paper feed motor 2830, the carriage motor 2831, the print head unit 2835, and a control panel 2807.

The control circuit 2810 is connected to the computer 2803 via a connector 2804. The computer 2803 is provided with a driver for the printer 2802, and constitutes a user interface for receiving commands made by a user operating an input device such as a keyboard or a mouse and for presenting various types of information in the printer 2802 through a screen display on a display device.

As shown in FIG. 62, various ink cartridges 2841 to 2847 are detachably mounted to the carriage 2832. The ink cartridges 2841, 2842, 2843, 2844, 2845, 2846, and 2847 are cartridges containing dark yellow (DY), light magenta (LW), light cyan (LC), black (K), cyan (C), magenta (M), and yellow (Y) ink, respectively.

The print head 2834 is provided in a lower section of the carriage 2832. Nozzles serving as ink ejection locations are disposed in the print head 2834 in rows in the carrying direction of the print paper 2004, and each nozzle row respectively corresponds to a particular color of ink.

Further, piezo elements, which are a type of electrostrictive element with excellent responsiveness, are provided in a lower section of the carriage 2832 and disposed for each nozzle in the nozzle rows corresponding to the respective inks. The piezo elements are arranged at positions in contact with a member forming the ink path over which ink is guided to the nozzles when voltage is applied to the piezo elements, their crystalline structure is deformed and they very quickly convert this electrical energy into mechanical energy.

In this embodiment, voltage of a predetermined duration is applied between electrodes provided on both sides of the piezo element, and the piezo element is elongated during application of the voltage and deforms one lateral wall of the ink path. As a result, the volume of the ink path is constricted by an amount corresponding to the elongation of the piezo element, and ink corresponding to this amount of constriction becomes an ink droplet and is quickly ejected from the tip of the nozzle. The ink droplet soaks into the print paper 2004, which is guided along the paper feed roller 2833, thereby forming a dot and carrying out printing. The size of the ink droplets can be changed depending on the method for applying voltage to the piezo elements. It is thus possible to form dots of, for example, three different sizes, these being large, medium, and small.

The carrying mechanism for carrying the print paper 2004 is provided with a gear train (not shown) that transmits the rotation of the paper feed motor 2830 to the paper feed roller 2833 and a paper carry roller (not shown). Further, the carriage moving mechanism for moving the carriage 2832 back and forth is provided with a slide shaft 2850 which runs parallel to the axis of the paper feed roller 2833 and which slidably retains the carriage 2832, a pulley 2852, with an endless drive belt 2851 being provided spanning between the pulley 2852 and the carriage motor 2831, and an optical sensor 2853 as an example of a sensor for detecting the print start position of the print paper 2004 and mark 2515 etc. on the mark sheet 2500 etc. described above.

The optical sensor 2853 is made of a light source (such as a LED (Light Emitting Diode)) for emitting light onto the paper 2004, and a detection section (such as a photodiode) for converting light that is reflected by the print paper 2004 into corresponding electrical signals. The optical sensor 2853 is mounted to the carriage 2832, and thus can move in the movement direction of the carriage 2832. The optical sensor 2853 can also detect whether or not the paper is present, and thus can detect the paper width by detecting the end portions of the paper during movement of the carriage 2832, and can detect the upper end and the lower end of the paper by detecting the end portions of the paper during carrying.

As shown in FIG. 63, the control circuit 2810 is constituted by an arithmetic and logic circuit that is provided with a CPU (Central Processing unit) 2861, a programmable ROM (P-ROM (Read only Memory)) 2862, a RAM (Random Access Memory) 2863, a character generator (CG) 2864 storing character dot matrix, and an EEPROM (Electrically Erasable and Programmable ROM) 2865, and that is capable of sending and receiving signals between these through a bus 2870. The EEPROM 2865 is a memory means for storing a database correlating image correction adjustment patterns and image effect setting patterns with information on the positions of the marks on the mark sheet.

The control circuit 2810 is further provided with an I/F dedicated circuit 2866, which is an interface (I/F) between the control circuit 2810 and external motors etc., a head drive circuit 2867 that is connected to the I/F dedicated circuit 2866 and that is for driving the print head unit 2835 and causing it to eject ink, and a motor drive circuit 2868 for driving the paper feed motor 2830 and the carriage motor 2831.

The I/F dedicated circuit 2866 is internally provided with a parallel interface circuit, and via the connector 2804, is capable of receiving print signals PS that are supplied from the computer 2803.

As shown in FIG. 64, the personal computer 2803 is constituted by a CPU 2901, a ROM 2902, a RAM 2903, a HDD (Hard Disk Drive) 2904, a video circuit 2905, an I/F 2906, a bus 2907, the display device 2805, an input device 2908, and an external memory device 2909.

Here, the CPU 2901 is a controller (controlling section) that performs various computer processing in accordance with the programs stored on the ROM 2902 and the HDD 2904, and controls the various sections of the apparatus. The CPU 2901 sends, to the printer, control codes for controlling the various sections in the printer to control the carriage moving mechanism to move the carriage (and print head) and control the carrying mechanism to carry the print paper in the carrying direction, and can control the head drive mechanism to cause the print head to eject ink. The CPU 2901 also receives the results of detection by the optical sensor 2853, analyzes those detection results, and sends control codes based, on the results of this analysis to the printer.

The ROM 2902 is a memory storing basic programs and data executed by the CPU 2901. The RAM 2903 is a memory for temporarily storing programs being executed by the CPU 2901 and data being computed, for example.

The HDD 2904 is a storage device for reading out data and programs stored on a hard disk, which is a storage medium, in accordance with requests from the CPU 2901, and for storing data generated as the outcome of computer processing by the CPU 2901 on that hard disk.

The video circuit 2905 is a circuit that executes rendering processes in accordance with picture commands supplied from the CPU 2901 to convert obtained image data into a video signal, and outputs this signal to the display device 2805. The I/F 2906 is a circuit for suitably converting the expression format of signals that are output from the input device 2908 and the external memory device 2909 and outputting print signals PS to the printer 2802.

The bus 2907 is a signal line that connects the CPU 2901, the ROM 2902, the RAM 2903, the HDD 2904, the video circuit 2905, and the I/F 2906 to one another, allowing data to be sent and received between them.

The display device 2805 is a device such as a LCD (Liquid Crystal Display) monitor or a CRT (Cathode Ray Tube) monitor, and displays images corresponding to video signals output from the video circuit 2905. The input device 2908 is a device such as a keyboard or a mouse, and is for generating signals corresponding to operations performed by a user and supplying these to the I/F 2906.

The external memory device 2909 is a device such as a CD-ROM (Compact Disk-ROM) drive unit, a MO (Magneto optic) drive unit, or a FDD (Flexible Disk Drive) unit, and is for reading data and programs stored on CD-ROM disks, MO disks, or FDS and supplying these to the CPU 2901. If the external memory device 2909 is a MO drive unit or a FDD unit, then it also functions as a device for storing data supplied from the CPU 2901 on a MO disk or a FD.

FIG. 65 is a diagram for describing the functions of the programs and the drivers installed on the computer 2803. It should be noted that these functions are achieved through cooperation between the hardware of the computer 2803 and software stored on the HDD 2904. As shown in the drawing, an application program 2911, a video driver program 2912, and a printer driver program 2920 are installed on the computer 2803. These operate under a predetermined operating system (OS).

The application program 2911 is an image processing program, for example, and outputs data that have been subjected to image processing to the printer driver program 2920 and the video driver program 2912.

The video driver program 2912 is a program for driving the video circuit 2905, and for example performs gamma processing or adjusts the white balance of data supplied from the application program 2911, and then creates image signals and supplies these to and displays them on the display device 2805.

The printer driver program 2920 is made of a resolution conversion module 2921, a color conversion module 2922, a color conversion table 2923, a halftoning module 2924, a LUT (Look Up Table) 2925, and a print data creation module 2926, and subjects the data created by the application program 2911 to various processes described later to create print data that it supplies to the printer 2802. The printer driver program 2920 also updates the LUT 2925 in accordance with the type of the print medium that is to be printed.

Here, the resolution conversion module 2921 performs processing for converting the resolution of the data supplied form the application program 2911 in accordance with the resolution of the print head 2834.

The color conversion module 2922 performs processing for converting image data expressed in the RGB (Red, Green, Blue) color system into image data of a C, M, Y, K, LC, LM, and DY (Cyan, Magenta, Yellow, Black, Light Cyan, Light Magenta, Dark Yellow) color system with reference to the color conversion table 2923.

The halftoning module 2924 converts, through dithering, image data expressed in the C, M, Y, K, LC, LM, and DY color system into bitmap data made of a combination of three types of dots, namely large, medium, and small, with reference to the LUT 2925.

The print data creation module 2926 creates print data including raster data indicating the manner in which dots are recorded and data indicating the carry amount (sub-scan feed amount) from the bitmap data output from the halftoning module 2924, and supplies these to the printer 2802.

It should be noted that the process of the eighth embodiment is the same as that of the seventh embodiment described with reference to FIGS. 50 to 61, and thus description thereof is omitted. In this case, the settings of the color conversion module and the halftoning module are adjusted based on the results of adjusting the print properties. Thus, the printer driver program (the CPU 2901 of the computer 2803 on which the printer driver program is installed) can reflect the adjustments to the print properties when converting the image data from the application program into print data (print signals). It is also possible for the printer driver program to adjust the image data obtained from the application program based on the results of adjusting the print properties and to supply the adjusted image data to the resolution conversion module 2921.

Embodiments of the present invention have been described above, but various modifications other than these can be made to the present invention. For example, in the foregoing embodiments, oval check boxes are used, but it is also possible to use, for example, rectangular or circular check boxes. It is also possible to dispose the optical head 2053, 2853 in a reciprocating movement member such as the drive belt 2051, 2851, instead of on the print head 2034, 2834.

It is also possible to print, on the mark sheet 2500 etc., a code (such as a bar code) for identifying the type of mark sheet 2500 etc. so as to determine which mark sheet 2500 etc. has been inserted. With such an embodiment, even if an incorrect mark sheet 2500 etc. is inadvertently inserted, it is possible to keep that mark sheet from being incorrectly recognized.

Also, when printing the mark sheet 2500 etc., it is also possible to print a plurality of image correction adjustment patterns or image effect setting patterns when a print paper 2004 on which the check box print region 2512 has been printed in advance is inserted from the paper supply opening 2002. Moreover, it is also possible for the optical sensor 2053, 2853 to detect whether or not there is a hole (subordinate concept of a "marks) provided in a check box 2514 etc. instead of a mark 2515 etc. on the mark sheet 2500 etc. Moreover, in place of the optical sensor 2053, 2853, it is also possible to adopt a sensor made of a light source and a light-receiving element disposed on the rear side of the light source, sandwiching the print paper 2004 and the mark sheet 2500 etc. between them, and to detect the position of the end portions of the print paper 2004 and the marks 2515 etc. on the mark sheet 2500 etc. based on the transmissivity of the light. Also, it is possible to employ a magnetic sensor as the sensor and to detect whether or not magnetic particles included in the marks 2515 etc. are present. It is also possible to employ a CCD camera as the sensor and to scan the CCD camera in the carrying direction or the movement direction, which is perpendicular to the carrying direction, to read information on the position of the marks 2515 etc.

Also, in the above embodiments, information on the position of the check boxes 2514 etc. is stored on the EEPROM 2065, 2865, but this information can also be stored on the P-ROM 2062, 2862 or the HDD 2904 of the personal computer 2803, for example.

As the print properties, it is possible to use Bi-D adjustment, PF adjustment, paper feed amount (carry amount), paper size, paper type, picture quality, borderless printing, and image layout if a plurality of images are to be printed on a single sheet of print paper, for example.

Also, in the foregoing embodiments, the four colors of CMYK were used for the ink, but in place of these four colors, or in addition to these four colors, it is also possible to use light-colored ink (light cyan (LC), light magenta (LM), dark yellow (DY)). Also, in the foregoing embodiments, a printer provided with a head for ejecting ink using piezo elements is employed, but it is also possible to adopt various ejection drive elements other than piezo elements. For example, the present invention can also be adopted for printers provided with a type of ejection drive element that ejects ink through bubbles generated within the ink path by passing a current through a heater disposed in the ink path. It is of course also possible to use the present invention for so-called laser printers or the like.

It should be noted that the program in which the above processes and functions are written can be stored on a computer-readable storage medium. Examples of a computer-readable storage medium include magnetic recording devices, optical disks, magneto optic recording media, and semiconductor memories. Magnetic recording devices include hard disk drives (HDD), flexible disks (FD), and magnetic tapes. Examples of optical disks include DVDs, DVD-RAMs (Random Access Memory), CD-ROMs, and CD-R (Recordable)/RW (ReWritable) disks. Magneto optic recording media include MOs.

If the program is to be distributed, then, for example, transportable recording media such as DVDs or CD-ROMs storing the program will be sold commercially. It is also possible to store the program on a storage device of a server computer and to transfer the program from the server computer to other computers over a network.

A computer for executing the program, for example, stores the program that is stored on a transportable recording medium or the program that is transferred from the server computer on its own memory device. Then, the computer reads the program from its own memory device and executes processing in accordance with the program. It should be noted that it is also possible for the computer to read the program directly from the transportable recording medium and to execute processing in accordance with the program. It is also possible for the computer to consecutively execute processing in accordance with the obtained program each time the program is transferred from a server computer.

Ninth Embodiment

<Regarding the Mark Sheet for Image Printing 2700>

The structure of the printer of the ninth embodiment is the same as that of the seventh embodiment, and thus description thereof is omitted.

Figure 66:
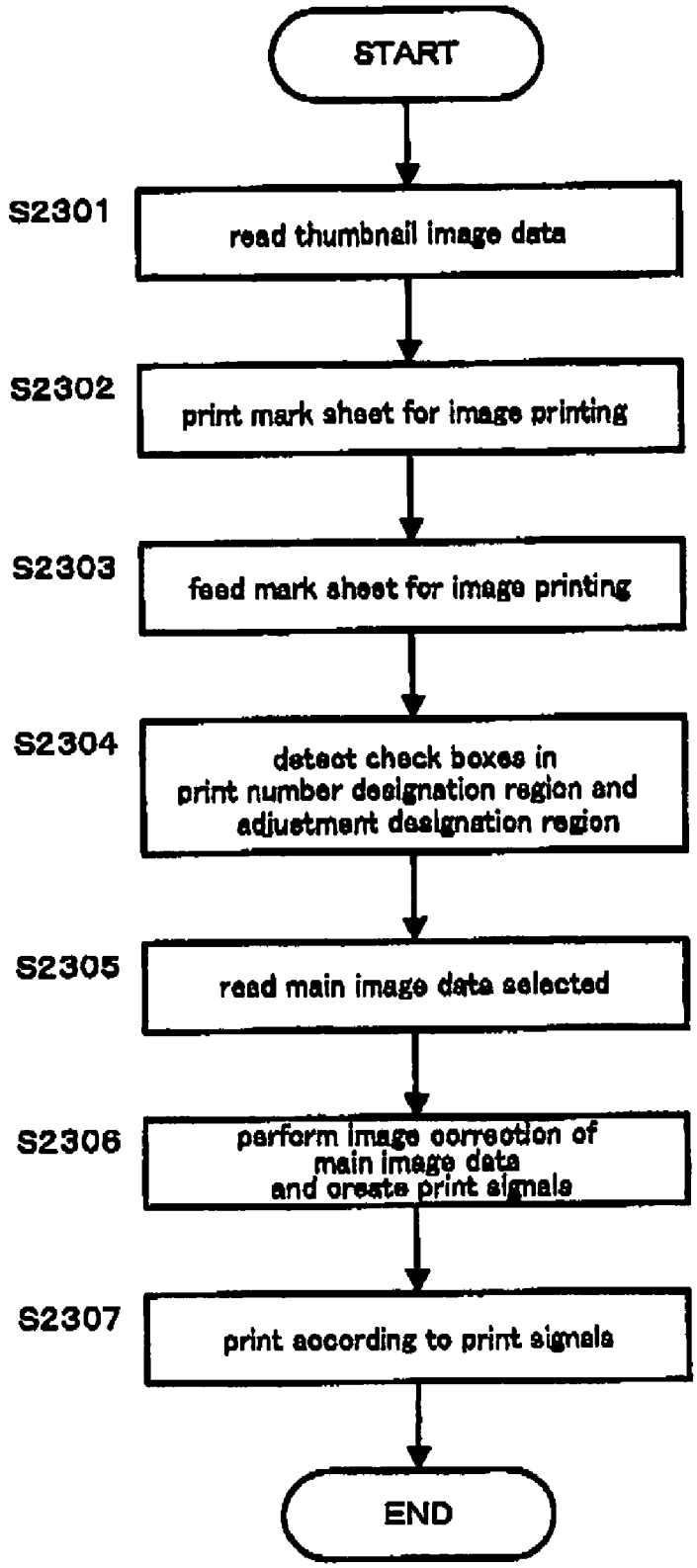
FIG. 66 is a flowchart for a ninth embodiment.

FIG. 66 is a flowchart of the ninth embodiment. The procedure is started when the memory card has been inserted into the drive unit 2008 or when a digital camera (with a memory card inserted in the digital camera) has been connected to the printer.

The memory card stores a plurality of image data sets recorded with the digital camera. When the user has captured a scenery or the like with the digital camera, the digital camera creates main data using set conditions and creates thumbnail image data based on this main image data, and stores the main image data and the thumbnail image data on the memory card as an image data set. Thus, each image data set on the memory card contains a main image data of high resolution and a thumbnail image data created from the main image data. Also, depending on the file format, the image data sets also includes the image capture conditions when the image was captured by the digital camera.

First, the CPU 2061 of the printer reads the thumbnail image data of all the image data sets from the memory card (step S2301). The CPU 2061 develops the thumbnail image data that have been read on the RAM 2063 and creates print data (print signals) for printing a mark sheet 2700 for image printing. The CPU 2061 controls the printing mechanisms in the printer (the carriage moving mechanism, the carrying mechanism, the head drive mechanism, etc.) based on the print data that are created and prints a mark sheet 2700 for image printing (step S2302).

Figure 67:
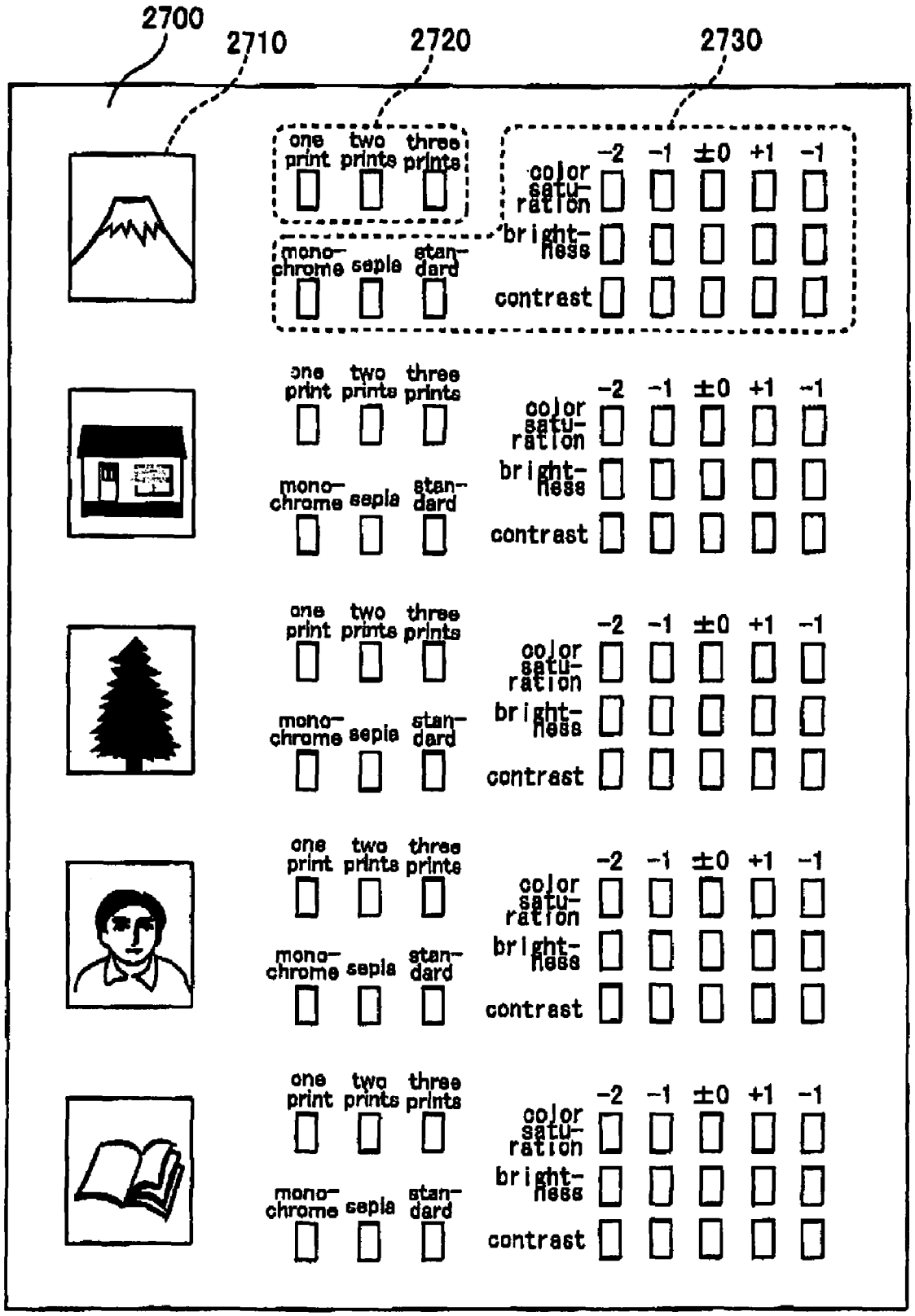
FIG. 67 is an explanatory diagram of a mark sheet for image printing.

FIG. 67 is an explanatory diagram of a mark sheet 2700 for image printing. This mark sheet includes a thumbnail image region 2710 in which thumbnail images of an image to be printed are printed, a print number designation region 2720 in which check boxes for designating a number of prints are printed, and an adjustment designation region 2730 in which check boxes for adjusting the image correction (print properties) are printed.

The user looks at the thumbnail images printed on the mark sheet and determines which image(s)to print. If there is an image that the user would like to print, the user then fills in a check box in the print number designation region 2720, thus filling in the check box for the desired number of prints. If the user does not wish to print the image(s), he/she does not fill in a check box in the print number designation region 2720.

Also, if the user wishes to adjust image correction, then he/she fills in a check box in the adjustment designation region 2730. For example, if the user would like to print the image "Mt. Fuji" in monochrome, then he/she fills in the check box for "monochrome" next to the thumbnail image of Mt. Fuji. As a further example, if the user would like to print the image "House" at high contrast, then he/she fills in the check box for "+1" or "+2" of the check boxes for "contrast" next to the thumbnail image of "House." After filling in the mark sheet, the user sets the mark sheet in the paper supply opening 2002 of the printer.

Next, the CPU 2061 of the printer starts feeding the mark sheet (step S2303). First, the CPU 2061 causes the carrying mechanism to carry the mark sheet up to a position where the optical sensor 2053 can read the check boxes for the image "Mt. Fuji." After this carrying, the CPU 2061 moves the carriage in the movement direction and causes the optical sensor 2053 to read the check boxes (step S2304). In this way, the CPU 2061 stores the designations made by the user for the image "Mt. Fuji" (designation of the number of prints, designation for adjusting the image correction) based on the results of the reading by the optical sensor 2053. It should be noted that the check boxes for the other images are read in the same manner.

After the check boxes of the mark sheet have been read, the CPU 2061 causes the carrying mechanism to discharge the mark sheet and reads the main image data of the image data sets corresponding to the images selected by the user from the memory card (step S2305). The CPU 2061 then develops the main data that have been read on the RAM 2063 and performs image correction of the main image data in accordance with the adjustments designated by the user to create print data (print signals) (step S2306). For example, the CPU 2061 performs image correction to adjust the main image data of "Mt. Fuji" to monochrome and creates print data. The CPU 2061 then controls the various sections in the printer based on print data that have been created to print the number of prints of the image that has been designated by the user (step S2307).

In the foregoing description, "monochrome," "sepia," and color saturation, for example, were described as examples for adjusting image correction (print properties), but the other adjustments for image correction that have been described in the previous embodiments are also possible.

In the foregoing description, the CPU 2061 of the printer creates print data and controls the printing mechanisms (carrying mechanism, carriage moving mechanism, head drive mechanism, etc.) in accordance with that print data to print the image. However, it is also possible for these processes to be carried out by the CPU 2901 of the computer 2803.

In this case, first the printer driver program (the CPU 2901 of the computer 2803 on which the printer driver program is installed) uses the image data stored on the HDD 2904 to create print data for printing the mark sheet 2700 for image printing and sends these to the printer. The printer that receives these print data prints the mark sheet, the user fills in the mark sheet, the printer performs detection of the mark sheet, and the printer sends the results of this detection to the computer. Then, the printer driver program performs adjustment of the image correction based on the results of this detection and creates print data that reflect these adjustments to the image correction. Then, when the printer driver program sends these print data to the printer, the printer prints the images at the picture quality desired by the user.

What is claimed is:

1. A printing method comprising the steps of:

carrying a medium and ejecting ink from a print head to print, on said medium, marks that can be filled in by a user;

detecting, with a sensor, whether or not each of said marks has been filled in; and performing a process in accordance with a result of the detection by said sensor;

wherein at least one of a carrying operation of carrying said medium and an ink ejection operation of ejecting ink from said print head is adjusted in accordance with said result of the detection by said sensor, wherein a plurality of patterns are printed on said medium, each of said patterns having a different adjustment amount by which said carrying operation or said ink ejection operation is adjusted; and wherein when said sensor detects that said marks corresponding to two patterns, from among said plurality of patterns, have been filled in, said carrying operation or said ink ejection operation is adjusted by an adjustment amount that is between the two adjustment amounts corresponding to said two patterns.

2. A printing method according to claim 1, wherein said sensor moves together with said print head.

3. A printing method according to claim 2, wherein data indicating the position of each of said marks is read from a memory; and wherein based on said data, said sensor detects whether or not each of said marks has been filled in.

4. A printing method according to claim 2, wherein said print head prints a position-adjustment mark on said medium;

wherein said sensor detects said position-adjustment mark; and wherein said sensor detects whether or not each of said marks has been filled in at a position corresponding to a result of this detection.

5. A printing method according to claim 2, wherein a list of a plurality of images and a plurality of the marks respectively corresponding to said images are printed on said medium; and wherein an image to be printed is determined according to a result of detecting said marks with said sensor.

6. A printing method according to claim 2, wherein a print signal is created in accordance with said result of the detection; and wherein an image is formed on said medium in accordance with said print signal.

7. A printing method according to claim 6, wherein said print signal is created after adjusting at least one of brightness, color saturation, and contrast in accordance with said result of the detection.

8. A printing method according to claim 6, wherein said print signal is created after adjusting a dot recording ratio in accordance with said result of the detection.

9. A printing method according to claim 2, wherein adjustment of a printing mechanism for carrying said medium and ejecting ink from said print head is performed in accordance with said result of the detection.

10. A printing method according to claim 9, wherein an ink ejection timing when ink is ejected during back and forth movement of said print head is adjusted in accordance with said result of the detection.

11. A printing method according to claim 1, wherein said ink ejection operation is an operation for ejecting said ink from said print head that moves back and forth; and wherein an ink ejection timing for a return pass with respect to an ink ejection timing for a forward pass is adjusted in accordance with said result of the detection by said sensor.

12. A printing method according to claim 1, wherein a carry amount of said carrying mechanism is adjusted in accordance with said result of the detection by said sensor.

13. A printing method according to claim 1, wherein a confirmation mark is printed on said medium; and wherein when said sensor detects that said confirmation mark has been filled in, each of said marks that can be filled in by the user is again printed on said medium in accordance with the operation that has been adjusted.

14. A printing method according to claim 1, wherein said print head is provided with a plurality of nozzles; and wherein clogging of said nozzles is adjusted in accordance with said result of the detection by said sensor.

15. A printing method according to claim 1, wherein a print signal is created based on said result of the detection by said sensor; and wherein an image is printed on said medium in accordance with said print signal.

16. A printing method according to claim 15, wherein each of said marks is a mark for setting print properties; and wherein based on said result of the detection by said sensor, said print signal is created in correspondence with the print properties that have been set.

17. A printing method according to claim 16, wherein a confirmation mark is printed together with each of said marks for setting print properties; and wherein when said sensor detects that said confirmation mark has been filled in, said mark for setting print properties is again printed on said medium at said print properties that have been set.

18. A printing method according to claim 15, wherein each of said marks is a mark for adjusting at least one of color saturation, brightness, and contrast; and wherein said print signal is created after adjusting at least one of color saturation, brightness, and contrast based on said result of the detection by said sensor.

19. A printing method according to claim 15, wherein each of said marks is a mark for selecting monochrome, sepia, or others; and wherein said print signal is created based on said result of the detection by said sensor.

20. A printing method according to claim 15, wherein each of said marks is a mark for selecting an adjustment standard; and wherein said print signal corresponding to said adjustment standard is created based on said result of the detection by said sensor.

21. A printing method according to claim 15, wherein each of said marks is a mark for selecting a sharpness; and wherein said print signal is created based on said result of the detection by said sensor.

22. A printing method according to claim 15, wherein each of said marks is a mark for selecting an image-capturing condition; and wherein said print signal corresponding to said image-capturing condition is created based on said result of the detection by said sensor.

23. A printing method comprising the steps of:

carrying a medium and ejecting ink from a print head to print, on said medium, a mark that can be filled in by a user;

detecting, with a sensor, whether or not said mark has been filled in; and performing a process in accordance with a result of the detection by said sensor, wherein at least one of a carrying operation of carrying said medium and an ink ejection operation of ejecting ink from said print head is adjusted in accordance with said result of the detection by said sensor;

wherein a list of images to be printed and marks for selecting said images are printed on said medium, and a mark for determining whether or not it is necessary to adjust said operation is printed on said medium;

wherein when said sensor detects said marks for selecting said images, said sensor detects said mark for determining whether or not it is necessary to adjust said operation; and wherein if it is determined that adjustment of said operation is necessary based on the result of the detection by said sensor, then said mark for determining whether or not it is necessary to adjust said operation is printed on said medium.

24. A printing method according to claim 23, wherein said sensor detects said mark for determining whether or not it is necessary to adjust said operation before detecting said marks for selecting said images.

25. A printing method comprising the steps of:

carrying a medium and ejecting ink from a print head to print, on said medium, marks that can be filled in by a user;

detecting, with a sensor, whether or not each of said marks has been filled in; and performing a process in accordance with a result of the detection by said sensor;

wherein at least one of a carrying operation of carrying said medium and an ink ejection operation of ejecting ink from said print head is adjusted in accordance with said result of the detection by said sensor;

wherein said ink ejection operation is an operation for ejecting said ink from said print head that moves back and forth;

wherein an ink ejection timing for a return pass with respect to an ink ejection timing for a forward pass is adjusted in accordance with said result of the detection by said sensor;

wherein a carry amount of said carrying mechanism is adjusted in accordance with said result of the detection by said sensor;

wherein a plurality of patterns are printed on said medium, each of said patterns having a different adjustment amount by which said carrying operation or said ink ejection operation is adjusted;

wherein when said sensor detects that said marks corresponding to two patterns, from among said plurality of patterns, have been filled in, said carrying operation or said ink ejection operation is adjusted by an adjustment amount that is between the two adjustment amounts corresponding to said two patterns;

wherein a confirmation mark is printed on said medium; wherein when said sensor detects that said confirmation mark has been filled in, said mark that can be filled in by the user is again printed on said medium in accordance with the operation that has been adjusted;

wherein said print head is provided with a plurality of nozzles;

wherein clogging of said nozzles is adjusted in accordance with said result of the detection by said sensor;

wherein a list of images to be printed and marks for selecting said images are printed on said medium, and a mark for determining whether or not it is necessary to adjust said operation is printed on said medium;

wherein when said sensor detects said marks for selecting said images, said sensor detects said mark for determining whether or not it is necessary to adjust said operation;

wherein if it is determined that adjustment of said operation is necessary based on the result of the detection by said sensor, then said mark for adjusting said operation is printed on said medium; and wherein said sensor detects said mark for determining whether or not it is necessary to adjust said operation before detecting said marks for selecting said images.

* * * * *